US005206104A

United States Patent [19]

Kato

[11] Patent Number: 5,206,104

[45] Date of Patent: Apr. 27, 1993

[54] ELECTROPHOTOGRAPHIC LIGHT-SENSITIVE MATERIAL

[75] Inventor: Eiichi Kato, Shizuoka, Japan

[73] Assignee: Fuji Photo Film Co., Ltd., Kanagawa, Japan

[21] Appl. No.: 655,608

[22] Filed: Feb. 15, 1991

[30] Foreign Application Priority Data

Feb. 16, 1990 [JP] Japan ..... 2-33955
May 10, 1990 [JP] Japan ..... 2-118532

[51] Int. Cl.[5] ..... G03G 5/08

[52] U.S. Cl. ..... 430/96; 430/49; 430/127

[58] Field of Search ..... 430/96, 49, 127; 525/71, 95

[56] References Cited

U.S. PATENT DOCUMENTS 4,925,765 5/1990 Madeleine ..... 430/110
5,009,975 4/1991 Kato et al. ..... 430/96
5,021,311 6/1991 Kato et al. ..... 430/96

*Primary Examiner*—Marion E. McCamish
*Assistant Examiner*—Rosemary Ashton
*Attorney, Agent, or Firm*—Sughrue, Mion, Zinn, Macpeak & Seas

[57] ABSTRACT

An electrophotographic light-sensitive material comprising a support having provided thereon at least one photoconductive layer containing an inorganic photoconductive substance and a binder resin, wherein the binder resin comprises at least one resin (A) or (A') and at least one resin (B) as described above. The electrophotographic light-sensitive material according to the present invention is excellent in electrostatic characteristics, moisture resistance and durability.

6 Claims, No Drawings

ELECTROPHOTOGRAPHIC LIGHT-SENSITIVE MATERIAL

FIELD OF THE INVENTION

The present invention relates to an electrophotographic light-sensitive material, and more particularly to an electrophotographic light-sensitive material which is excellent in electrostatic characteristics, moisture resistance and durability.

BACKGROUND OF THE INVENTION

An electrophotographic light-sensitive material may have various structures depending upon the characteristics required or an electrophotographic process to be employed.

An electrophotographic system in which the light-sensitive material comprises a support having thereon at least one photoconductive layer and, if necessary, an insulating layer on the surface thereof is widely employed. The electrophotographic light-sensitive material comprising a support and at least one photoconductive layer formed thereon is used for the image formation by an ordinary electrophotographic process including electrostatic charging, imagewise exposure, development, and, if desired, transfer.

Furthermore, a process using an electrophotographic light-sensitive material as an offset master plate precursor for direct plate making is widely practiced.

Binders which are used for forming the photoconductive layer of an electrophotographic light-sensitive material are required to be excellent in the film-forming properties by themselves and the capability of dispersing photoconductive powder therein. Also, the photoconductive layer formed using the binder is required to have satisfactory adhesion to a base material or support. Further, the photoconductive layer formed by using the binder is required to have various excellent electrostatic characteristics such as high charging capacity, small dark decay, large light decay, and less fatigue due to prior light-exposure and also have an excellent image forming properties, and the photoconductive layer stably maintains these electrostatic characteristics regardless of change of humidity at the time of image formation.

Further, extensive investigations have been made on lithographic printing plate precursors using an electrophotographic light-sensitive material, and for such a purpose, binder resins for a photoconductive layer which satisfy both the electrostatic characteristics as an electrophotographic light-sensitive material and printing properties as a printing plate precursor are required.

However, conventional binder resins used for electrophotographic light-sensitive materials have various problems particularly in electrostatic characteristics such as a charging property, dark charge retention and photosensitivity, and smoothness of the photoconductive layer.

Also, binder resins which have been developed for lithographic printing master plate by an electrophotographic system have been found, upon practical evaluations, that they have also problems in the above-described electrostatic characteristics, background staining of prints, etc.

In order to overcome these problems, JP-A-63-217354 and JP-A-1-70761 (the term "JP-A" as used herein means an "unexamined Japanese patent application") disclose improvements in the smoothness of the photoconductive layer and electrostatic characteristics by using, as a binder resin, a resin containing from 0.05 to 10% by weight of a copolymer having an acidic group in a side chain of the polymer or a resin having a weight average molecular weight of from $1\times10^3$ to $1\times10^4$ and having an acidic group bonded at only one terminal of the polymer main chain thereby obtaining an image having no background stains.

Also, JP-A-1-100554 and JP-A-1-214865 disclose a technique using, as a binder resin, a resin containing an acidic group in a side chain of the copolymer or at the terminal of the polymer main chain, and containing a polymerizable component having a heat- and/or photo-curable functional group; JP-A-1-102573 and JP-A-2-874 disclose a technique using a resin containing an acidic group in a side chain of the copolymer or at the terminal of the polymer main chain, and a crosslinking agent in combination; JP-A-64-564, JP-A-63-220149, JP-A-63-220148, JP-A-1-280761, JP-A-1-116643 and JP-A-1-169455 disclose a technique using a resin having a low molecular weight (a weight average molecular weight of from $1\times10^3$ to $1\times10^4$) and a resin having a high molecular weight (a weight average molecular weight of $1\times10^4$ or more) in combination; and JP-A-1-211766 and JP-A-2-34859 disclose a technique using the above low molecular weight resin and a heat- and/or photo-curable resin in combination. These references disclose that, according to the proposed techniques, the film strength of the photoconductive layer can be increased sufficiently and also the mechanical strength of the light-sensitive material can be increased without adversely affecting the above-described electrostatic characteristics achieved by using a resin containing an acidic group in a side chain or at the terminal of the polymer main chain.

However, it has been found that, even in the case of using the above-described resins, when the environmental condition charges severely from high humidity and high temperature to low humidity and low temperature, the use of these resins is insufficient for keeping the stable performance of the electrophotographic photosensitive material.

In particular, in a scanning exposure system using a semiconductor laser beam, the exposure time is longer than the exposure time in a conventional overall simultaneous exposure system by visible light, and also there is a restriction on the intensity of the light exposure. Accordingly, a higher performance is required for electrostatic characteristics, in particular, dark charge retention and light sensitivity.

Furthermore, in the case of employing a scanning exposure system using a semiconductor laser beam for a lithographic printing master plate by an electrophotographic system, when a conventional electrophotographic photosensitive material is used for the practical test, the above-described electrostatic characteristics are unsatisfactory, particularly in that the difference between $E_{\frac{1}{2}}$ and $E_{1/10}$ becomes large, thereby making it difficult to reduce the residual potential after light exposure, the formation of fog on copied images becomes severe. Also, there is a serious problem in that, when printing is carried out using the master plate formed as an offset master plate, edge marks of cutting appear on the prints.

SUMMARY OF THE INVENTION

The present invention has been made for solving the above-described problems of conventional electrophotographic light-sensitive material.

An object of the present invention is to provide an electrophotographic light-sensitive material stably maintaining good electrostatic characteristics and giving clear images of good quality even when the environmental conditions during the formation of duplicated images are changed to low temperature and low humidity or to high temperature and high humidity.

Another object of the present invention is to provide an electrophotographic light-sensitive material for CPC having excellent electrostatic characteristics and showing less dependency on environmental conditions.

A still another object of the present invention is to provide an electrophotographic light-sensitive material effective for a scanning exposure system using a semiconductor laser beam.

A further object of the present invention is to provide a lithographic printing master plate having excellent electrostatic characteristics (in particular, dark charge retention and light sensitivity) as a lithographic printing master plate by an electrophotographic system, capable of reproducing faithfully duplicated images to an original, causing neither overall uniform background stains nor dot-like background stains on the prints, having an excellent printing durability, and causing no edge marks of cutting on the prints.

As the result of various investigations, it has now been found that the above-described objects can be achieved by an electrophotographic light-sensitive material comprising a support having provided thereon a photoconductive layer containing at least an inorganic photoconductive substance and a binder resin, wherein the binder resin comprises at least one kind of binder resin (A) or (A') and at least one kind of binder resin (B):

Binder Resin (A)

a graft copolymer having a weight average molecular weight of from $1\times10^3$ to $2\times10^4$ comprising at least a monofunctional macromonomer (MA) and a monomer represented by formula (III), wherein the monofunctional macromonomer (MA) has a weight average molecular weight of not more than $2\times10^4$ and has a polymerizable double bond group represented by following formula (I) at only one terminal of the main chain of a polymer containing at least one of the polymer components represented by following formula (IIa) and (IIb), wherein the copolymer has at least one acidic group selected from $-PO_3H_2$,

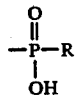

carbon group or —OR' (wherein R' represents a hydrocarbon group)), and a cyclic acid anhydride-containing group bonded to only one terminal of the main chain of the copolymer;

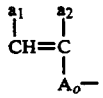

(I)

wherein $A_o$ represents —COO—, —OCO—, $-(CH_2)_{l_1}-$—OCO—, $-(CH_2)_{l_2}$OCO— (wherein $l_1$ and $l_2$ each represents an integer of from 1 to 3),

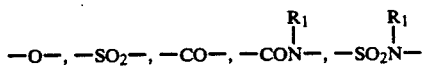

(wherein $R_1$ represents a hydrogen atom or a hydrocarbon group), —CONHCOO—, —CONHCONH—, $-CONHSO_2-$ or

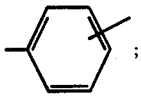

;

and $a_1$ and $a_2$, which may be the same or different, each represents a hydrogen atom, a halogen atom, a cyano group, a hydrocarbon group, $-COO-D_1$ or $-COO-D_1$ via a hydrocarbon group (wherein $D_1$ represents a hydrocarbon group which may be substituted);

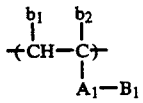

(IIa)

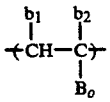

(IIb)

wherein $A_1$ has the same meaning as $A_o$ in formula (I) described above; $B_1$ represents an aliphatic group having from 1 to 18 carbon atoms or an aromatic group having 6 to 12 carbon atoms; $b_1$ and $b_2$, which may be the same or different, have the same meaning as $a_1$ and $a_2$ in formula (I); and $B_o$ represents —CN, $-CONH_2$ or

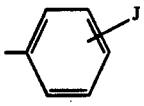

(wherein J represents a hydrogen atom, a halogen atom, an alkoxy group or $-COOD_4$ (wherein $D_4$ represents an alkyl group, an aralkyl group, or an aryl group));

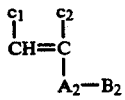

(III)

wherein $A_2$ has the same meaning as $A_1$ in formula (IIa): $B_2$ has the same meaning as $B_1$ in formula (IIa); and $c_1$ and $c_2$, which may be the same or different, have the same meaning as $a_1$ and $a_2$ in formula (I);

Binder Resin (A')

a copolymer having a weight average molecular weight of from $1\times10^3$ to $2\times10^4$ comprising at least a monofunctional macromonomer (MA') and a monomer represented by the above formula (III), wherein the monofunctional macromonomer (MA') has a weight average molecular weight of not more than $2\times10^4$ and has a polymerizable double bond group represented by the above formula (I) at only one terminal of the main chain of a polymer containing at least one of the polymer components represented by the above formulae (IIa) and (IIb) and a polymer component containing at least one acidic group selected from

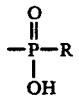

(wherein R represents a hydrocarbon group or —OR' (wherein R' represents a hydrocarbon group));

Binder Resin (B)

a graft type copolymer having a weight average molecular weight of from $3\times10^4$ to $1\times10^6$ containing as a copolymer component at least one kind of a monofunctional macromonomer (M) having a weight average molecular weight of from $1\times10^3$ to $2\times10^4$ having a polymerizable double bond group at the terminal of the polymer main chain of a B block of an AB block copolymer composed of an A block containing at least one polymer component containing at least one acidic group selected from

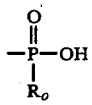

(wherein $R_o$ has the same meaning as R described above), and a cyclic acid anhydride-containing group and a B block containing at least a polymer component represented by the following formula (IV);

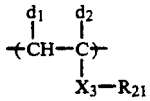

(IV)

wherein $d_1$ and $d_2$ each represents a hydrogen atom, a halogen atom, a cyano group, a hydrocarbon group, —COO—$R_{24}$ or —COO—$R_{24}$ via a hydrocarbon group (wherein $R_{24}$ represents a hydrocarbon group which may be substituted), and $X_3$ represents —COO—, —OCO—, $-(CH_2)_{l3}OCO-$, $-(CH_2)_{l4}COO-$, (wherein $l_3$ and $l_4$ each represents an integer of from 1 to 3),

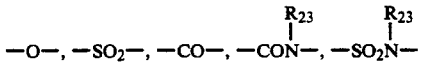

(wherein $R_{23}$ represents a hydrogen atom or a hydrocarbon group), —CONHCOO—, —CONHCONH—, or

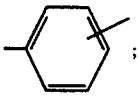

and $R_{21}$ represents a hydrocarbon group, provided that, when $X_3$ is

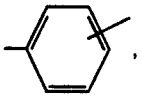

$R_{21}$ represents a hydrogen atom or a hydrocarbon group.

DETAILED DESCRIPTION OF THE INVENTION

The present invention is described hereinafter in greater detail.

In the first embodiment of the present invention, the binder resin used in the present invention contains at least the low molecular weight resin (A) and the high molecular weight resin (B) described above, and, in the second embodiment of the present invention, the binder resin used in the present invention contains at least the low molecular weight resin (A') and the high molecular weight resin (B) described above.

First, the binder resin in the first embodiment of the present invention is described in detail.

The binder resin in the first embodiment is composed of at least the low molecular weight resin (A) which is a graft copolymer containing the monofunctional macromonomer (MA) and the monomer (monomer A) represented by formula (III) described above and has the specific acidic group at only one terminal of the main chain of the polymer, and the high molecular weight resin (B) composed of a graft type copolymer containing, as a copolymerizable component, at least one monofunctional macromonomer (M) comprising an AB block copolymer being composed of an A block comprising a polymerizable component containing the specific acidic group described above and a B block comprising a polymerizable component represented by the general formula (IV) described above and having a polymerizable double bond group bonded to the terminal of the main chain of the B block polymer.

According to a preferred embodiment of the present invention, the low molecular weight resin (A) is a low molecular weight resin (hereinafter referred to as resin ($A_1$)) having an acidic group bonded to the terminal of the polymer main chain thereof and containing a methacrylate component having a specific substituent containing a benzene ring which has a specific substituent(s) at the 2-position or 2- and 6-positions thereof or a specific substituent containing an unsubstituted naphthalene ring represented by the following general formula (Va) or (Vb):

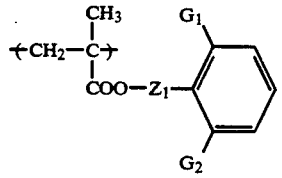

(Va)

-continued

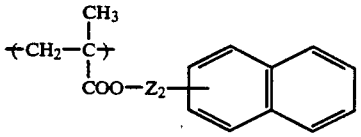

(Vb)

wherein $G_1$ and $G_2$ each represents a hydrogen atom, a hydrocarbon group having from 1 to 10 carbon atoms, a chlorine atom, a bromine atom, —$COL_1$ or —$COOL_2$, wherein $L_1$ and $L_2$ each represents a hydrocarbon group having from 1 to 10 carbon atoms; and $Z_1$ and $Z_2$ each represents a mere bond or a linking group containing from 1 to 4 linking atoms, which connects —COO— and the benzene ring.

According to another preferred embodiment of the present invention, the high molecular weight resin (B) is a graft type copolymer containing at least one macromonomer (M) described above and a polymer component represented by the following general formula (VI):

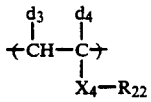

(VI)

wherein $d_3$, $d_4$, $X_4$ and $R_{22}$ each has the same meaning as defined for $d_1$, $d_2$, $X_3$ and $R_{21}$ in formula (IV) described above.

In the present invention, the acidic group bonded to the terminal of the polymer main chain of the resin (A) of a low molecular weight which comprises the specific macromonomer (MA) and the monomer (A) is adsorbed onto stoichiometrical defects of an inorganic photoconductive substance, and the resin has a function to improve covering power for the photoconductive substance due to its low molecular weight, to sufficiently cover the surface thereof, whereby electron traps of the photoconductive substance can be compensated for and humidity resistance can be greatly improved, while assisting the photoconductive substance to be sufficiently dispersed without forming aggregates. On the other hand, the resin (B) not only serves to sufficiently heighten the mechanical strength of a photoconductive layer, which may be insufficient in case of using the resin (A) alone, without damaging the excellent electrophotographic characteristics attained by the use of the resin (A), but also provides sufficiently high image forming performance in the case of changing the environmental conditions or in the case of using a laser beam of small power.

It is believed that the excellent characteristics of the electrophotographic light-sensitive material can be obtained by employing the resin (A) and the resin (B) as binder resins for inorganic photoconductive substance, wherein the weight average molecular weight of the resins and the content and position of the acidic group therein are specified, whereby the strength of interactions between the inorganic photoconductive substance and the resins can be appropriately controlled.

That is, it is assumed that the resin (A) having a low molecular weight, a high content of acidic groups and a stronger interaction selectively and adequately adsorbs onto the inorganic photoconductive substance and the molecular chains of the macromonomer (MA) component (graft portion) of the resin (A) and the monomer component (main chain portion) of formula (III) cause sufficient interaction with the molecular chain of the main chain portion of the resin (B), while, on the other hand, in the resin (B) having a weak interaction as compared to the resin (A), the acidic group bonded to a specific position to the main chain of the polymer in the resin loosely interacts with the inorganic photoconductive substance to an extent of obstructing the electrophotographic characteristics and the molecular chains of a long molecular chain length and the graft portion chain length interact with each other in the resin (B), whereby both the electrophotographic characteristics and the mechanical strength of the photoconductive layer can be greatly improved.

In case of using the resin ($A_1$), the electrophotographic characteristics, particularly, $V_{10}$, DRR and $E_{1/10}$ of the electrophotographic material can be furthermore improved as compared with the use of the resin (A). While the reason of this fact is not fully clear, it is believed that the polymer molecular chain of the resin ($A_1$) suitably arranges on the surface of inorganic photoconductive substance such as zinc oxide in the layer depending on the plane effect of the benzene ring having a substituent at the ortho position or the naphthalene ring which is an ester component of the methacrylate whereby the above described improvement is achieved.

Further, according to the present invention, the smoothness of the photoconductive layer is improved.

On the contrary, when an electrophotographic light-sensitive material having a photoconductive layer with a rough surface is used as an electrophotographic lithographic printing plate precursor, the dispersion state of inorganic particles as photoconductive substance and a binder resin is improper and thus a photoconductive layer is formed in a state containing aggregates of the photoconductive substance, whereby the surface of the non-image portions of the photoconductive layer is not uniformly and sufficiently rendered hydrophilic by applying thereto an oil-desensitizing treatment with an oil-desensitizing solution to cause attaching of printing ink at printing, which results in the formation of background stains in the non-image portions of the resulting prints.

According to the present invention, the interaction of adsorption and covering between the inorganic photoconductive substance and the binder resins is suitably performed, and the sufficient mechanical strength of the photoconductive layer is achieved by the combination of the resins described above.

In the resin (A), the weight average molecular weight is suitably from $1\times10^3$ to $2\times10^4$, preferably from $3\times10^3$ to $1\times10^4$.

The content of the monofunctional macromonomer (MA) having at least one of the polymer components represented by formulae (IIa) and (IIb) described above in the resin (A) is from 3 to 70% by weight, and preferably from 10 to 50% by weight.

The content of the monomer (A) represented by formula (III) in the resin (A) is from 10 to 95% by weight, and preferably from 30 to 90% by weight.

The content of the copolymer component of methacrylate corresponding to the repeating unit shown by formula (Va) and/or formula (Vb) in the resin ($A_1$) is from 30 to 97% by weight, and preferably from 50 to 95% by weight, and the content of the above-described acidic group-containing component is from 1 to 20% by weight, and preferably from 2 to 10% by weight per 100 parts by weight of the resin (A).

The glass transition point of the resin (A) is preferably from −40° C. to 110° C., and more preferably from −20° C. to 90° C.

If the molecular weight of the resin (A) is less than $1\times10^3$, the film-forming ability thereof is undesirably reduced, whereby the photoconductive layer formed cannot keep a sufficient film strength, while if the molecular weight thereof is larger than $2\times10^4$, the fluctuations of electrophotographic characteristics (in particular, dark decay retention rate and photosensitivity of $E_{1/10}$) of the photoconductive layer containing a spectral sensitizing dye for the sensitization in the range of from near-infrared to infrared become somewhat large and thus the effect for obtaining stable duplicated images according to the present invention is reduced under severe conditions of high temperature and high humidity or low temperature and low humidity.

If the content of the acidic group-containing component in the resin (A) is less than 1% by weight, the resulting electrophotographic light-sensitive material has an initial potential too low to provide a sufficient image density. If, on the other hand, it is more than 20% by weight, dispersibility of the photoconductive substance is reduced, the smoothness of the photoconductive layer and the electrophotographic characteristics thereof under a high humidity condition are deteriorated. Further, background stains are increased when it is used as an offset master.

Also, if the content of the copolymer component corresponding to the macromonomer (MA) is less than 5% by weight, the same phenomena as the case that the weight average molecular weight of the resin (A) becomes larger than $2\times10^4$ occur. On the other hand, if the content of the copolymer component is more than 80% by weight, the copolymerization with the monomer A is reluctant to sufficiently proceed, the polymer of the monomer of formula (III) only or of other monomers only forms in addition to the desired graft copolymer, which gives undesirable results. Furthermore, when an inorganic photoconductive substance is dispersed using such a resin, aggregates of the resin with the photoconductive substance are formed.

On the other hand, the weight average molecular weight of the resin (B) is from $3\times10^4$ to $1\times10^6$, and preferably from $5\times10^4$ to $5\times10^5$.

The content of the monofunctional macromonomer composed of the AB block copolymer component in the polymer is preferably from 1 to 60% by weight, and more preferably from 5 to 50% by weight. Furthermore, the content of the polymer content shown by formula (V) is preferably from 40 to 99% by weight, and more preferably from 50 to 95% by weight.

The glass transition point of the resin (B) is preferably from 0° C. to 110° C., and more preferably from 20° C. to 90° C.

If the molecular weight of the resin (B) is less than $3\times10^4$, a sufficient film strength may not be maintained. On the other hand, when the molecular weight thereof is larger than $1\times10^6$, the dispersibility of the photoconductive substance is reduced, the smoothness of the photoconductive layer is deteriorated, and image quality of duplicated images (particularly reproducibility of fine lines and letters) is degradated. Further, the background stains are increased in case of using it as an offset master.

Further, if the content of the macromonomer is less than 1% by weight in the resin (B), electrophotographic characteristics (particularly dark decay retention rate and photosensitivity) may be reduced and the fluctuations of electrophotographic characteristics of the photoconductive layer, particularly that containing a spectral sensitizing dye for the sensitization in the range of from near-infrared to infrared become large under severe conditions. The reason therefor is considered that the construction of the polymer becomes similar to that of a conventional homopolymer or random copolymer due to the presence of only a small amount of macromonomer portion which constitutes the graft portion.

On the other hand, the content of the macromonomer in the resin (B) is more than 60% by weight, the copolymerizability of the macromonomer with other monomers corresponding to other copolymerizable components may become insufficient, and the sufficient electrophotographic characteristics can not be obtained as the binder resin.

Now, the resin (A) and the resin (B) which can be used in the present invention will be explained in detail below.

The resin (A) of the present invention has the feature that the resin is a low molecular weight comb type copolymer composed of at least the monofunctional macromonomer (MA) and the monomer (A) shown by formula (III), and has the specific acidic group at only one terminal of the main chain of the polymer.

The monofunctional macromonomer (MA) used in the present invention is a macromonomer having a weight average molecular weight of not more than $2\times10^4$ having the polymerizable double bond group represented by formula (I) to only one terminal of the main chain of the polymer containing a least one of the polymer components represented by formula (IIa) and formula (IIb).

In formulae (I), (IIa) and (IIb), the hydrocarbon groups shown by $a_1$, $a_2$, $A_o$, $b_1$, $b_2$, $A_1$, $B_1$, and $B_o$ each has each carbon atom number (as unsubstituted hydrocarbon group) shown in each case and these hydrocarbon groups each may have a substituent.

Then, the macromonomer (MA) is described in detail.

In formula (I), $A_o$ represents —COO—, —OCO—, $-(CH_2)_{l_1}OCO-$, $-(CH_2)_{l_2}COO-$ (wherein $l_1$ and $l_2$ each represents an integer of from 1 to 3), —O—, $-SO_2-$, —CO—,

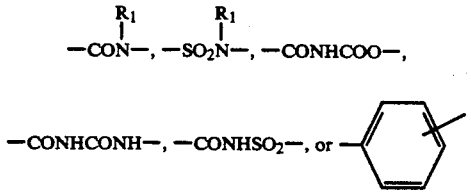

(wherein $R_1$ represents a hydrogen atom or a hydrocarbon group).

Preferred examples of the hydrocarbon group represented by $R_1$ include an alkyl group having from 1 to 18 carbon atoms which may be substituted (e.g., methyl, ethyl, propyl, butyl, pentyl, hexyl, heptyl octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, and 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, and dimethoxybenzyl), an alicyclic group having from 5 to 8 carbon atoms which may be substituted (e.g., cyclohexyl, 2-cyclohexylethyl, and 2-cyclopentylethyl), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, and dodecyloylamidophenyl).

When $A_o$ represents

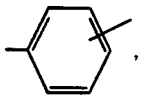

the benzene ring may further be substituted. Suitable examples of the substituents include a halogen atom (e.g., chlorine, and bromine), an alkyl group (e.g., methyl, ethyl, propyl, butyl, chloromethyl, and methoxymethyl), and an alkoxy group (e.g., methoxy, ethoxy, propoxy, and butoxy).

In formula (I), $a_1$ and $a_2$, which may be the same or different, each preferably represents a hydrogen atom, a halogen atom (e.g., chlorine, and bromine), a cyano group, an alkyl group having from 1 to 4 carbon atoms (e.g., methyl, ethyl, propyl, and butyl), $—COOD_2$ or $—COOD_2$ bonded via a hydrocarbon group, wherein $D_2$ represents a hydrocarbon group (preferably an alkyl group having 1 to 18 carbon atoms, an alkenyl group having 4 to 18 carbon atoms, an aralkyl group having 7 to 12 carbon atoms, an alicyclic group having 5 to 8 carbon atoms or an aryl group having 6 to 12 carbon atoms, each of which may be substituted). More specifically, the examples of the hydrocarbon groups are those described for $R_1$ above. The hydrocarbon group through which $—COOD_2$ is bonded includes, for example, a methylene group, an ethylene group, and a propylene group.

More preferably, in the general formula (I), $A_o$ represents —COO—, —OCO—, $—CH_2OCO—$, $—CH_2COO—$, —O—, —CONH—, $—SO_2NH—$, —CONHCOO—, —CONHCONH—, or

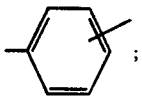

and $a_1$ and $a_2$, which may be the same or different, each represents a hydrogen atom, a methyl group, $—COOD_3$, or $—CH_2COOD_3$, wherein $D_3$ represents an alkyl group having from 1 to 6 carbon atoms (e.g., methyl, ethyl, propyl, butyl, and hexyl). Most preferably, either one of $a_1$ and $a_2$ represents a hydrogen atom.

Specific examples of the polymerizable double bond group represented by the general formula (I) include

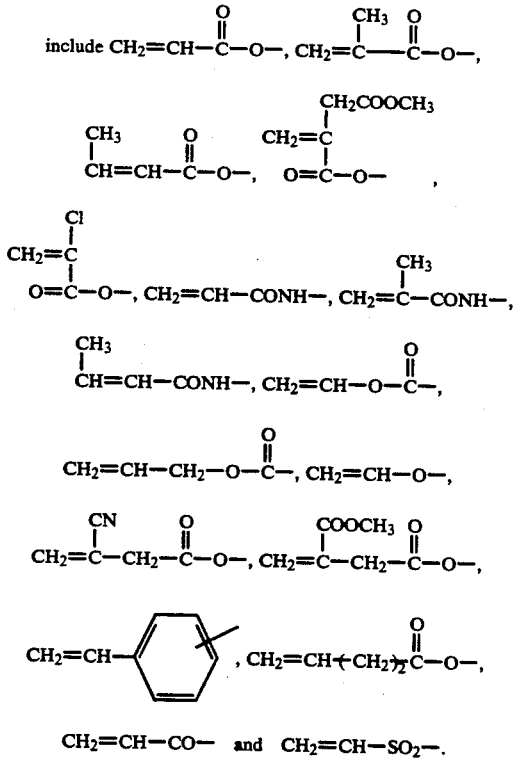

$CH_2=CH—CH=CH—CO—$ and $CH_2=CH—SO_2—$.

In formula (IIa) or (IIb), $A_1$ has the same meaning as $A_o$ in formula (I) and $b_1$ and $b_2$, which may be the same or different are the same as $a_1$ and $a_2$ in formula (I).

In formula (IIb), $B_o$ represents an aliphatic group having from 1 to 18 carbon atoms or an aromatic group having from 6 to 12 carbon atoms.

Specifically, the aliphatic group includes an alkyl group having from 1 to 18 carbon atoms, which may be substituted, (e.g., methyl, ethyl, propyl, butyl, heptyl, hexyl, octyl, decyl, dodecyl, tridecyl, hexadecyl, octadecyl, 2-chloroethyl, 2-bromoethyl, 2-hydroxyethyl, 2-methoxyethyl, 2-ethoxyethyl, 2-cyanoethyl, 3-chloropropyl, 2-(trimethoxysilyl)ethyl, 2-tetrahydrofuryl, 2-N,N-dimethylaminoethyl, 2-N,N-diethylaminoethyl), a cycloalkyl group having from 5 to 8 carbon atoms (e.g., cycloheptyl, cyclohexyl, and cyclooctyl), and an aralkyl group having from 7 to 12 carbon atoms, which may be substituted, (e.g., benzyl, phenethyl, 3-phenylpropyl, naphthylmethyl, 2-naphthylethyl, chlorobenzyl, bromobenzyl, dichlorobenzyl, methylbenzyl, chloromethylbenzyl, dimethylbenzyl, trimethylbenzyl, and methoxybenzyl.).

Furthermore, the aromatic group shown by $B_o$ include an aryl group having from 6 to 12 carbon atoms, which may be substituted, (e.g., phenyl, tolyl, xylyl, chlorophenyl, bromophenyl, dichlorophenyl, chloromethylphenyl, methoxyphenyl, methoxycarbonylphenyl, naphthyl, and chloronaphthyl), etc.

In formula (IIa), $A_1$ preferably represents

—COO—, —OCO—, $—CH_2COO—$, $CH_2OCO—$, —O—,

—CO—, —CONH—, $—SO_2NH—$, —CONHCOO—,

-continued

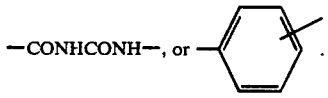

In formulae (IIa) and (IIb), preferred examples of $b_1$ and $b_2$ are same as those described above for $a_1$ and $a_2$.

In formula (IIb), $B_o$ represents —CN, —$CONH_2$,

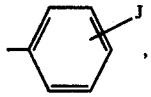

wherein J represents a hydrogen atom, a halogen atom (e.g., chlorine and bromine), an alkoxy group (e.g., methoxy, ethoxy, propoxy, and butoxy), or —$COOD_4$ (wherein $D_4$ preferably represents an alkyl group having from 1 to 8 carbon atoms, an aralkyl group having from 7 to 12 carbon atoms, or an aryl group).

The macromonomer (MA) may contain two or more polymer components shown by formula (IIa) and/or formula (IIb).

Furthermore, when $A_1$ in formula (IIa) is —COO—, it is preferred that the content of the polymer component shown by formula (IIa) in the total polymer components of the macromonomer (MA) is at least 30% by weight.

Also, in the macromonomer (MA), examples of a monomer corresponding to other repeating units copolymerizable with the polymer component represented by formula (IIa) and/or formula (IIb) are heterocyclic vinyls (e.g., vinylpyridine, vinyl imidazole, vinylpyrrolidone, vinylthiophene, vinylpyrazole, vinyl dioxane, and vinyloxazine).

The macromonomer (MA) which is used for the resin (A) of the present invention has the above-described chemical structure that the polymerizable double bond group represented by formula (I) is bonded to only one terminal of the main chain of the polymer composed of the repeating unit represented by formula (IIa) and/or formula (IIb) directly or through an appropriate linking group. The linking group which links the component of formula (I) and the component of formula (IIa) or (IIb) is composed of an appropriate combination of atomic group, such as a carbon-carbon bond (a single bond or a double bond), a carbon-hetero atom bond (examples of the hetero atom are oxygensulfur, nitrogen, and silicon), and a hetero atom-hetero atom bond.

The macromonomer (MA) used in the present invention is preferably a macromonomer represented by following formula (Va) or (Vb);

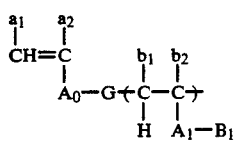

(Va)

-continued

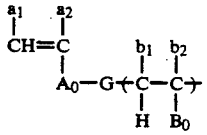

(Vb)

wherein $a_1$, $a_2$, $b_1$, $b_2$, $A_o$, $A_1$, $B_o$ and $B_1$ have the same meaning as those described above for formula (I), formula (IIa), and formula (IIb), and G represents single bond, a linking group selected from

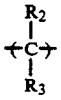

(wherein $R_2$ and $R_3$ each represents a hydrogen atom, a halogen atom (e.g., fluorine, chlorine, and bromine), a cyano group, a hydroxy group, or an alkyl group (e.g., methyl, ethyl, and propyl)),

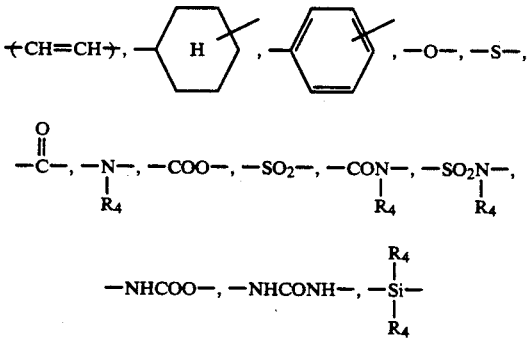

(wherein $R_4$ represents a hydrogen atom or the same hydrocarbon group as that of $B_1$ in formula (IIa)), or a linking group composed of an optional combination of the above-described atomic group.

If the weight average molecular weight of the macromonomer (MA) is higher than $2\times10^4$, the copolymerizability with the monomer A is undesirably reduced. On the other hand, if the weight average molecular weight thereof is too small, the effect of improving the electrophotographic characteristics of the photoconductive layer becomes less and, hence, the lower limit of the weight average molecular weight is preferably at least $1\times10^3$.

The macromonomer (MA) used in the present invention can be produced by conventionally known synthesis methods.

For example, there are a method by an ion polymerization method of forming a macromonomer by reacting various reagents with the terminal of a living polymer obtained by anionic polymerization or cationic polymerization and a method by a radical polymerization method of forming a macromonomer by reacting various reagents with an oligomer having a reactive group bonded to the terminal obtained by radical polymerization using a polymerization initiator and/or a chain transfer agent each having a reactive group such as a carboxy group, a carboxy acid chloride group, a hydroxy group, an amino group, an epoxy group, a halogen atom (e.g., bromine and iodine), etc.

Practically, the macromonomer (MA) can be synthesized by the methods described in P. Dreyfuss and R. P. Quirk, *Encycl. Polym. Sci. Eng.*, 7, 551 (1987), P. F. Rempp and E. Franta, Adu., *Polym. Sci.*, 58, 1 (1984), V. Percec, *Appl. Polym. Sci.*, 285, 95 (1984), R. Asami and M. Takari, *Makromol. Chem. Suppl.*, 12, 163 (1985), P. Rempp et al., *Makromol. Chem. Suppl.*, 8, 3 (1984), Yushi Kawakami, *Kogaku Kogyo*, 38, 56 (1987), Yuya Yamashita, *Kobunshi*, 31, 988 (1982), Shiro Kobayashi, *Kobunshi*, 30, 625 (1981), Toshinobu Higashimura, *Nippon Secchaku Kyokaishi*, 18, 536 (1982), Koichi Itoh, *Kobunshi Kako*, 35, 262 (1986), Kishiro Higashi and Takashi Tsuda, *Kino Zairyo*, 1987, No. 10, 5, and literature references cited therein.

Then, specific examples of the macromonomer (MA) used in the present invention are illustrated below, but the scope of the present invention is not limited thereto.

In the following formulae, $a_{11}$ represents H of $CH_3$, $b_{11}$ represents H or $CH_3$, $b_{12}$ represents H, $-CH_3$, or $-CH_2COOH_3$, $R_{11}$ represents $C_iH_{2i+1}$ (wherein i is an integer of from 1 to 18), $-CH_2C_6H_5$, $-C_6H_5$, or

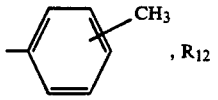

represents $-C_iH_{2i+1}$, $-(CH_2)_j-C_6H_5$ (j is integer of from 1 or to 3) or

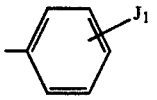

wherein $J_1$ represents $-CH_3$, $-Cl$, $-Br$, or $-OCH_3$), $R_{13}$ represents $-C_iH_{2i+1}$, $-CH_2C_6H_5$, or $-C_6H_5$, $R_{15}$ represents $-C_iH_{2i+1}$, $-CH_2C_6H_5$, or

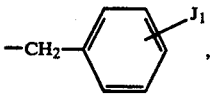

$R_{16}$ represents $-C_iH_{2i+1}$, $E_1$ represents $-COOCH_3$, $-C_6H_5$, or $-CN$, $E_2$ represents $-C_iH_{2i+1}$, $-OCOC_iH_{2i+1}$, $-COOCH_3$, $-C_6H_5$, or $-CN$, $E_3$ represents $-COOCH_3$,

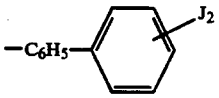

($J_2$ is $-CH_3$, $-Cl$, or $-Br$), or $-CN$, $E_4$ represents $-Cl$, $-Br$, $-F$, $-OH$, or $-CN$, $E_5$ represents $-OCOC_iH_{2i+1}$, $-CN$, $-CONH_2$, or $-C_6H_5$, $E_6$ represents $-CN$, $-CONH_2$, or $-C_6H_5$, $E_7$ represents $-COOCH_3$, $-C_6H_5$, or

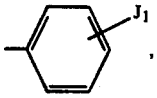

$J_3$ represents H, $-CH_3$, $-Cl$, $-Br$, $-OCH_3$, or $-COOCH_3$, and h represents an integer of from 2 to 4.

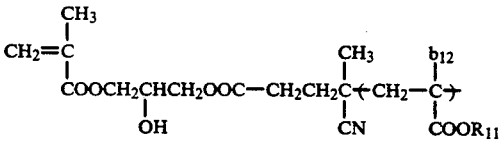

(MA-1)

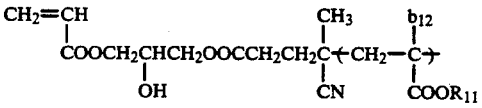

(MA-2)

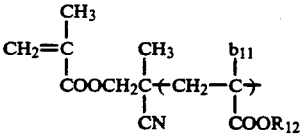

(MA-3)

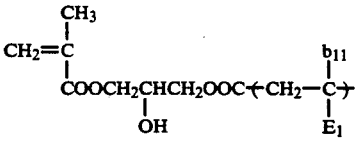

(MA-4)

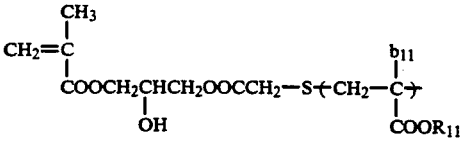

(MA-5)

-continued
(MA-6)
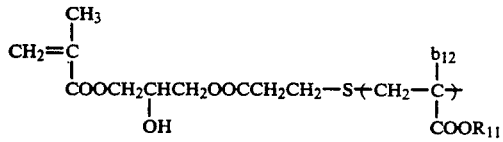
(MA-7)
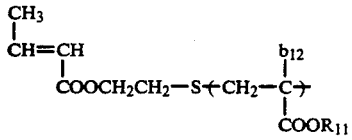
(MA-8)
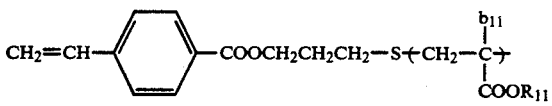
(MA-9)
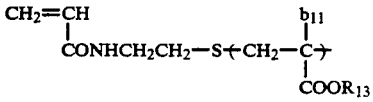
(MA-10)
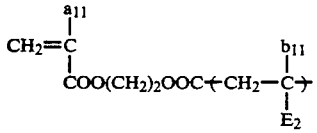
(MA-11)
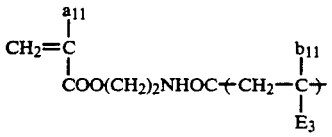
(MA-12)
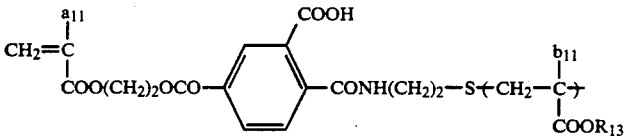
(MA-13)
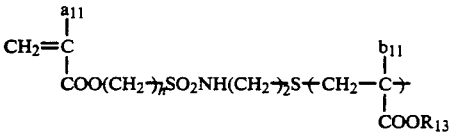
(MA-14)
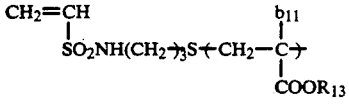
(MA-15)
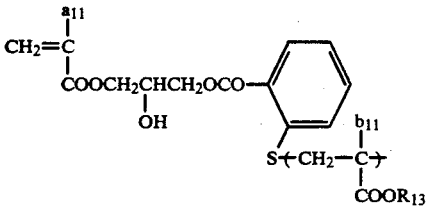
(MA-16)
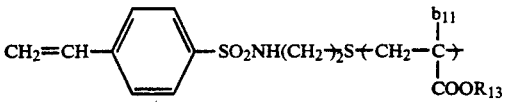

-continued (MA-17)

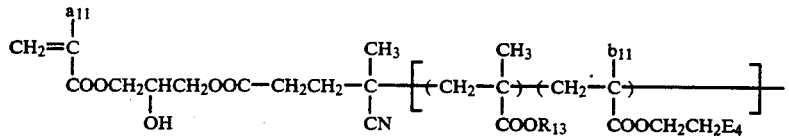

(MA-18)

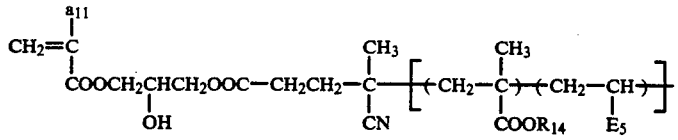

(MA-19)

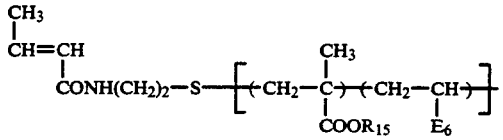

(MA-20)

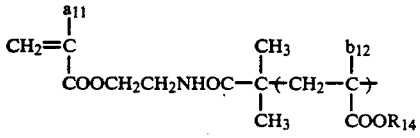

(MA-21)

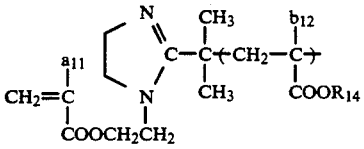

(MA-22)

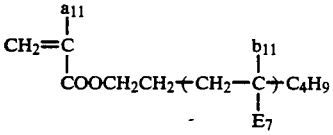

(MA-23)

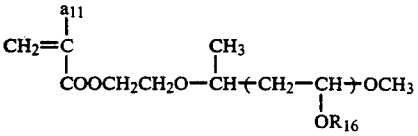

(MA-24)

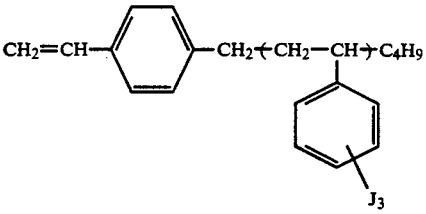

The monomer A which is copolymerized with the above-described macromonomer (MA) is represented by formula (III).

In formula (III), $c_1$ and $c_2$, which may be the same or different, have the same meaning as $a_1$ and $a_2$ in formula {I}and more preferably represent a hydrogen atom or a methyl group. $A_2$ in formula (III) has the same meaning as $A_1$ in (IIa) and $B_2$ has the same meaning as $B_1$ in formula (IIa).

In the binder resin (A) of the present invention, the composition ratio of the copolymer component composed of the macromonomer (MA) as the repeating unit to the composition unit composed of the repeating unit represented by formula (III) is preferably 1 to 90/99 to 10 (weight ratio), and more preferably 5 to 60/95 to 40.

More preferably, the binder resin (A) contains a methacrylate monomer shown by the following formula (V) (that is, the monomer represented by formula (III) wherein $c_1$ is a hydrogen atom, $c_2$ is a methyl group, and $A_2$ is —COO—, and hereinafter the monomer is referred to as monomer (A')) in an amount of at least from 30% by weight to 99% by weight of the total copolymer components of the resin (A);

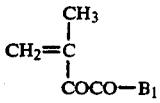

(V)

Also, most preferably in the binder resin (A), the copolymer component corresponding to the repeating unit shown by formula (III) is the methacrylate component having a specific aryl group represented by the following formula (Va) and/or formula (Vb) (the binder resin is referred to as resin ($A_1$) as described above);

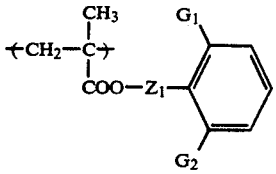

(Va)

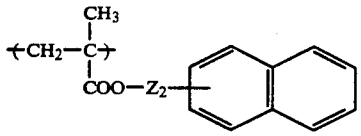

(Vb)

In the general formula (Va), $G_1$ and $G_2$ each preferably represents a hydrogen atom, a chlorine atom, a bromine atom, an alkyl group having from 1 to 4 carbon atoms (e.g., methyl, ethyl, propyl, and butyl), an aralkyl group having from 7 to 9 carbon atoms (e.g., benzyl, phenethyl, 3-phenylpropyl, chlorobenzyl, dichlorobenzyl, bromobenzyl, methylbenzyl, methoxybenzyl, and chloromethylbenzyl), an aryl group (e.g., phenyl, tolyl, xylyl, bromophenyl, methoxyphenyl, chlorophenyl, and dichlorophenyl), $—COL_1$ or $—COOL_2$, wherein $L_1$ and $L_2$ each preferably represents any of the above-recited hydrocarbon groups).

In the general formula (Va), $Z_1$ is a mere chemical bond or a linking group containing from 1 to 4 linking atoms, e.g., $-(CH_2)_{n1}$ ($n_1$ represents an integer of 1, 2 or 3), $—CH_2OCO—$, $—CH_2CH_2OCO—$, $-(CH_2O)_{n2}$ ($n_2$ represents an integer of 1 or 2), and $—CH_2CH_2O—$, which connects —COO— and the benzene ring.

In the general formula (Vb), $Z_2$ has the same meaning as $Z_1$ in the general formula (Va).

Specific examples of the copolymerizable component corresponding to the repeating unit represented by the general formula (Va) or (Vb) which can be used in the resin ($A_1$) according to the present invention are set forth below, but the present invention should not be construed as being limited thereto. In the following formulae, $T_1$ and $T_2$ each represents Cl, Br or I; $R_{11}$ represents

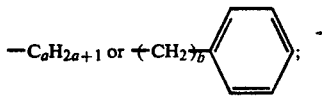

a represents an integer of from 1 to 4; b represents an integer of from 0 to 3; and c represents an integer of from 1 to 3.

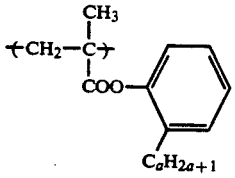

i-1)

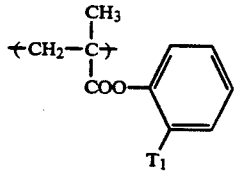

i-2)

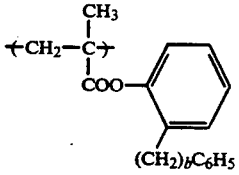

i-3)

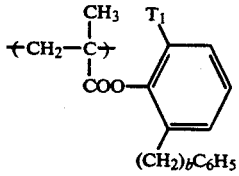

i-4)

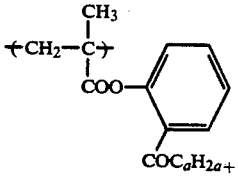

i-5)

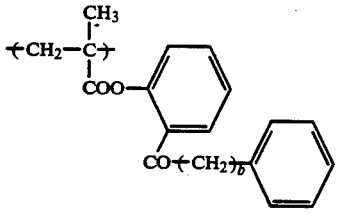

i-6)

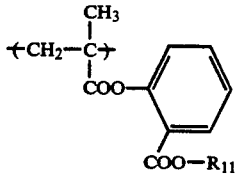

i-7)

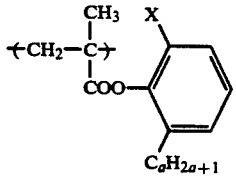

i-8)

-continued i-9)

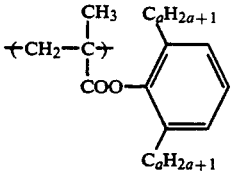

i-10)

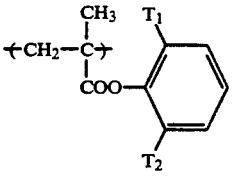

i-11)

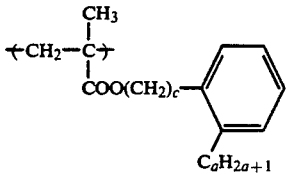

i-12)

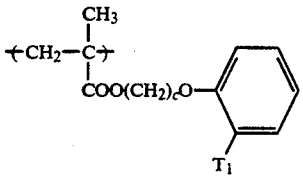

i-13)

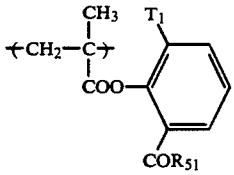

i-14)

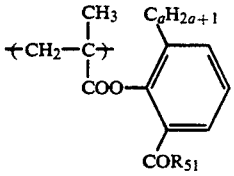

i-15)

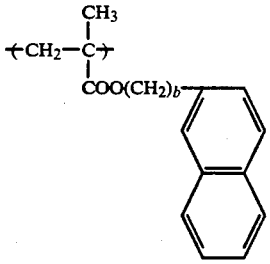

i-16)

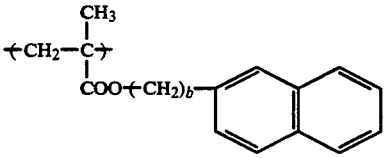

i-17)

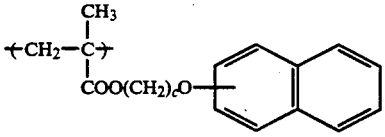

-continued i-18)

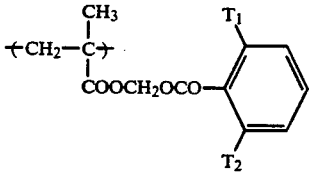

i-19)

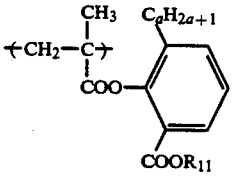

i-20)

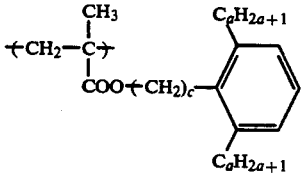

In the monomers represented by formula (III), the content of monomer (monomer (A″) other than the more preferred monomer represented by the above-described formula (V) is preferably not more than 60% by weight in the total copolymer components.

That is, the ratio of the copolymer components in the binder resin (A) is preferably in the following:

Macromonomer (MA):monomer (A′) of formula (V):monomer (A″) of formula (III) other than monomer (A′) =1 to 80:30 to 99:0 to 60 (by weight ratio).

Furthermore, the binder resin (A) may further contain monomer(s) other than the above-described monomers, which can be copolymerized with macromonomer (MA) and monomer (A) as a copolymer component.

Examples of such other monomers are α-olefins, N-substituted acrylamides, N-substituted methacrylamides (the N-substituent is hydrocarbon group and is practically the same hydrocarbon group as shown by $B_1$ in formula (III)), and heterocyclic vinyls (e.g., vinylpyrrolidone, vinylpyridine, vinylimidazole, vinylthiophene, vinylimidazoline, vinylpyrazole, vinyldioxane, vinylquinoline, vinylthiazole, and vinyloxazine).

It is preferred that the content of other monomer described above does not exceed 20% by weight in the copolymer.

Furthermore, the binder resin (A) used in the present invention is a polymer having at least one acidic group selected from $—PO_3H_2$, $—SO_3H$, —COOH, —OH, $—PO_3RH$, and cyclic acid anhydride-containing group bonded to only one terminal of the main chain of a polymer containing at least one kind of the repeating unit represented by formula (III) and at least one kind of the repeating unit shown by macromonomer (MA). In this case, the acidic group is bonded to one terminal of the polymer directly or through an optional linking group.

The above-described linkage group is composed of an optional combination of atomic groups such as a carbon-carbon bond (a single bond or a double bond), a carbon-hetero atom bond (examples of the hetero atom are oxygen, sulfur, nitrogen, and silicon), and a hetero atom-hetero atom bond. For example, there are the single linking group selected from the atomic groups or the linking group composed of an optional combination of the atomic groups as G in the above-described formulae (VIa) and (VIb).

In the acidic group

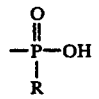

above, R represents a hydrocarbon group or —OR', wherein R' represents a hydrocarbon group. The hydrocarbon group represented by R or R' preferably includes an aliphatic group having from 1 to 22 carbon atoms (e.g., methyl, ethyl, propyl, butyl, hexyl, octyl, decyl, dodecyl, octadecyl, 2-chloroethyl, 2-methoxyethyl, 3-ethoxypropyl, allyl, crotonyl, butenyl, cyclohexyl, benzyl, phenethyl, 3-phenylpropyl, methylbenzyl, chlorobenzyl, fluorobenzyl, and methoxybenzyl) and a substituted or unsubstituted aryl group (e.g., phenyl, tolyl, ethylphenyl, propylphenyl, chlorophenyl, fluorophenyl, bromophenyl, chloromethylphenyl, dichlorophenyl, methoxyphenyl, cyanophenyl, acetamidophenyl, acetylphenyl, and butoxyphenyl).

The cyclic acid anhydride-containing group is a group containing at least one cyclic acid anhydride. The cyclic acid anhydride to be contained includes an aliphatic dicarboxylic acid anhydride and an aromatic dicarboxylic acid anhydride.

Specific examples of the aliphatic dicarboxylic acid anhydrides include succinic anhydride ring, glutaconic anhydride ring, maleic anhydride ring, cyclopentane-1,2-dicarboxylic acid anhydride ring, cyclohexane-1,2-dicarboxylic acid anhydride ring, cyclohexene-1,2-dicarboxylic acid anhydride ring, and 2,3-bicyclo[2,2,-2]octanedicarboxylic acid anhydride. These rings may be substituted with, for example, a halogen atom (e.g., chlorine and bromine) and an alkyl group (e.g., methyl, ethyl, butyl, and hexyl).

Specific examples of the aromatic dicarboxylic acid anhydrides include phthalic anhydride ring, naphtnalene-dicarboxylic acid anhydride ring, pyridinedicarboxylic acid anhydride ring and thiophenedicarboxylic acid anhydride ring. These rings may be substituted with, for example, a halogen atom (e.g., chlorine and bromine), an alkyl group (e.g., methyl, ethyl, propyl, and butyl), a hydroxyl group, a cyano group, a nitro group, and an alkoxycarbonyl group (e.g., methoxycarbonyl and ethoxycarbonyl).

In binder resin (A), as a method of bonding the acidic group to one terminal of the polymer main chain, there are a method of reacting various reagents to the terminal of a living polymer obtained by a conventionally known anionic polymerization or a cationic polymerization (method by ionic polymerization), a method of performing a radical polymerization using a polymerization initiator and/or a chain transfer agent each having the specific acidic group in the molecule (method by radical polymerization), and a method of forming a polymer having a reactive group (e.g., an amino group, a halogen atom, an epoxy group, and an acid halide group) at the terminal thereof by an ionic polymerization or a radical polymerization and converting the reactive group to the specific acidic group in the present invention by a high molecular reaction.

Practically, these methods are described in P. Dreyfuss & R. P. Quirk, *Encycl. Polym. Sci. Eng.*, 7, 551 (1987), Yoshiki Nakajo and Yuya Yamashita, *Senyo to Yakuhin* (*Dyes and Chemicals*), 30, 232(1985), Akira Ueda and Susumu Nagai, *Kagaku to Kogyo* (*Science and Industry*), 60, 57 (1986), etc., and the literatures cited therein.

Practical examples of the chain transfer agent are a mercapto compound having the acidic group or the above-described reactive group, which can be induced into the acidic group later, (e.g., thioglycolic acid, thiomalic acid, thiosalicyclic acid, 2-mercaptopropionic acid, 3-mercaptopropionic acid, 3-mercaptobutyric acid, N-(2-mercaptopropionic)glycine, 2-mercaptonicotinic acid, 3-[N-(2-mercaptoethyl)carbamoyl]propionic acid, 3-[N-(2-mercaptoethyl)amino]propionic acid, N-(3-mercaptopropionyl)alanine, 2-mercaptoethanesulfonic acid, 3-mercaptopropanesulfonic acid, 4-mercaptobutanesulfonic acid, 2-mercaptoethanol, 2-mercapto-1,2-propanediol, 1-mercapto-2-propanol, 3-mercapto-2-butanol, mercaptophenol-2-mercaptoethylamine, 2-mercaptoimidazole, 2-mercapto-3-pyridinol, 4-(2-mercaptoethyloxycarbonyl)-phthalic acid anhydride, 2-mercaptoethylphosphonic acid, and 2-mercaptoethylphosphonic acid monomethyl ester) and an iodized alkyl compound having the above-described acidic group or the reactive group (e.g., iodoacetic acid, iodopropionic acid, 2-iodoethanol, 2-iodoethanesulfonic acid, and 3-iodopropanesulfonic acid). In the above-described compounds, the mercapto compounds are preferred.

Also, practical examples of the polymerization initiator having the acidic group or the specific reactive group are 4,4'-azobis(4-cyanovaleric acid), 4,4'-azabis(4-cyanovaleric acid chloride), 2,2'-azobis-(2-cyanopropanol), 2,2'-azobis(2-cyanopentanol), 2,2'-azobis[2-methyl-N-(2-hydroxyethyl)-propioamido], 2,2'-azobis{2-methyl-N-[1,1-bis(hydroxymethyl)-2-hydroxyethyl]-propioamido}, 2,2'-azobis-2-[1-(2-hydroxyethyl)-2-imidazolin-2-yl]propane, 2,2'azobis[2-(2-imidazolin-2-yl)-propane], and 2,2'-azobis[2-(4,5,6,7-tetrahydro-1H-1,3-diazopin-2-yl)propane].

The amount of the chain transfer agent or the polymerization initiator is from 0.5 to 10 parts by weight, and preferably from 1 to 5 parts by weight to 100 parts by weight of the total monomers.

Then, a preferred embodiment of the binder resin (B) used in the present invention is described in detail.

First, monofunctional macromonomer (M) which is used for the binder resin (B) is more practically explained.

As the acidic group contained in the components constituting the A block of the macromonomer (M), there are $—PO_3H_2$, —COOH, $—SO_3H$, phenolic OH,

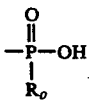

wherein $R_0$ has the same meaning as R described above), and a cyclic acid anhydride-containing group, and the preferred acidic groups are —COOH, $—SO_3H$, phenolic OH, and

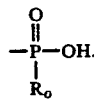

When the acidic group is

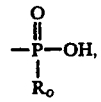

the acidic group has the same meaning as those described above in the binder resin (A).

Furthermore, practical examples of the polymer component containing the above-described specific acidic group are the same as those described above for the binder resin (A).

Examples of the phenolic hydroxy group described above include a hydroxy group of hydroxy-substituted aromatic compounds containing a polymerizable double bond and a hydroxy group of (meth)acrylic acid esters and amides each having a hydroxyphenyl group as a substituent.

Also, the cyclic acid anhydride-containing group is a group having at least one cyclic acid anhydride and as the cyclic acid anhydride, there are aliphatic dicarboxylic acid anhydride and aromatic dicarboxylic acid anhydride.

Examples of the aliphatic dicarboxylic acid anhydride are a succinic anhydride ring, a glutaconic anhydride ring, a maleic anhydride ring, a cyclopentane-1,2-dicarboxylic acid anhydride ring, a cyclohexane-1,2-dicarboxylic acid anhydride ring, and a cyclohexene-1,2-dicarboxylic acid anhydric ring, and a 2,3-bicyclo-[2,2,2]octandicarboxylic acid anhydride ring. These rings may be substituted with a halogen atom (e.g., chlorine and bromine) or an alkyl group (e.g., methyl, ethyl, butyl, and hexyl).

Also, examples of the aromatic dicarboxylic acid anhydride are a phthalic anhydride ring, a naphthalene-dicarboxylic acid anhydride ring, a pyridinedicarboxylic acid anhydride ring, and a thiophene-dicarboxylic acid anhydride ring. These rings may be substituted with a halogen atom (e.g., chlorine and bromine), an alkyl group (e.g., methyl, ethyl, propyl, and butyl), a hydroxy group, a cyano group, a nitro group, an alkoxycarbonyl group (examples of the alkoxy group are methoxy and ethoxy), etc.

Two or more kinds of the above-described polymer components each containing the specific acidic group can be included in the A block. In such a case, two or more kinds of these acidic group-containing polymer components may be present in the form of a random copolymer or a block copolymer.

Also, other components having no acidic group may be contained in the A block, and examples of such components include the components represented by the general formula (IV) described in detail below. The content of the component having no acidic group in the A block is preferably from 0 to 50% by weight, and more preferably from 0 to 20% by weight. It is most preferred that such a component is not contained in the A block.

Now, the polymer component constituting the B block in the mono-functional macromonomer (M) of the graft type copolymer used in the present invention will be explained in more detail below.

The components constituting the B block in the present invention include at least a repeating unit represented by the general formula (IV) described above.

In the general formula (IV), $X_3$ represents —COO—, —OCO—, $-(CH_2)_{l_3}-OCO-$, $-(CH_2)_{l_4}-COO-$ (wherein $l_3$ and $l_4$ each represents an integer of from 1 to 3),

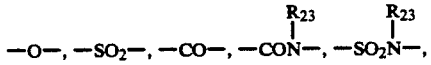

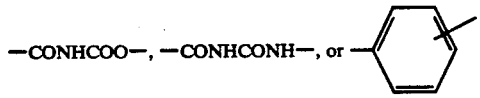

(wherein $R_{23}$ represents a hydrogen atom or a hydrocarbon group).

Preferred examples of the hydrocarbon group represented by $R_{23}$ include an alkyl group having from 1 to 18 carbon atoms which may be substituted (e.g., methyl, ethyl, propyl, butyl, pentyl, hexyl, heptyl octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, and 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, and dimethoxybenzyl), an alicyclic group having from 5 to 8 carbon atoms which may be substituted (e.g., cyclohexyl, 2-cyclohexylethyl, and 2-cyclopentylethyl), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, and dodecyloylamidophenyl).

In the general formula (IV), $R_{21}$ represents a hydrocarbon group, and preferred examples thereof include those described for $R_{23}$. When $X_3$ represents

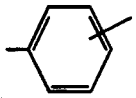

in the general formula (IV), $R_{21}$ represents a hydrogen atom or a hydrocarbon group.

When $X_3$ represents

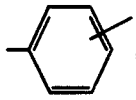

the benzene ring may further be substituted. Suitable examples of the substituents include a halogen atom (e.g., chlorine, and bromine), an alkyl group (e.g., methyl, ethyl, propyl, butyl, chloromethyl, and methoxymethyl), and an alkoxy group (e.g., methoxy, ethoxy, propoxy, and butoxy).

In the general formula (IV), $d_1$ and $d_2$, which may be the same or different, each preferably represents a hydrogen atom, a halogen atom (e.g., chlorine, and bromine), a cyano group, an alkyl group having from 1 to 4 carbon atoms (e.g., methyl, ethyl, propyl, and butyl), $—COOR_{24}$ or $—COOR_{24}$ bonded via a hydrocarbon group, wherein $R_{24}$ represents a hydrocarbon group (preferably an alkyl group having 1 to 18 carbon atoms, an alkenyl group having 4 to 18 carbon atoms, an aralkyl group having 7 to 12 carbon atoms, an alicyclic group having 5 to 8 carbon atoms or an aryl group having 6 to 12 carbon atoms, each of which may be substituted). More specifically, the examples of the hydrocarbon groups are those described for $R_{23}$ above. The hydrocarbon group via which $—COOR_{24}$ is bonded includes, for example, a methylene group, an ethylene group, and a propylene group.

More preferably, in the general formula (IV), $X_3$ represents —COO—, —OCO—, $—CH_2OCO—$, $—CH_2COO—$, —O—, —CONH—, $—SO_2NH—$ or

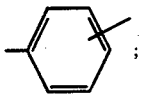

and $d_1$ and $d_2$, which may be the same or different, each represents a hydrogen atom, a methyl group, $—COOR_{24}$, or $—CH_2COOR_{24}$, wherein $R_{24}$ represents an alkyl group having from 1 to 6 carbon atoms (e.g., methyl, ethyl, propyl, butyl, and hexyl). Most preferably, either one of $d_1$ and $d_2$ represents a hydrogen atom.

The B block which is constituted separately from the block A which is composed of the polymer component containing the above-described specific acidic group may contain two or more kinds of the repeating units represented by the general formula (IV) described above and may further contain polymer components other than these repeating units. When the B block having no acidic group contains two or more kinds of the polymer components, the polymerizable components may be contained in the B block in the form of a random copolymer or a block copolymer, but are preferably contained at random therein.

As the polymer component other than the repeating units represented by the general formula (IV) which is contained in the B block together with the polymer component(s) selected from the repeating units of the general formula (II), any components copolymerizable with polymer component of the repeating units can be used.

Suitable examples of monomer corresponding to the repeating unit copolymerizable with the polymer component represented by the general formula (IV), as a polymerizable component in the B block include acrylonitrile, methacrylonitrile and heterocyclic vinyl compounds (e.g., vinylpyridine, vinylimidazole, vinylpyrrolidone, vinylthiophene, vinylpyrazole, vinyldioxane, and vinyloxazine). Such other monomers are employed in a range of not more than 20 parts by weight per 100 parts by weight of the total polymerizable components in the B block.

Further, it is preferred that the B block does not contain the polymerizable component containing the acidic group which is a component constituting the A block.

As described above, the macromonomer (M) to be used in the present invention has a structure of the AB block copolymer in which a polymerizable double bond group is bonded to one of the terminals of the B block composed of the polymerizable component represented by the general formula (IV) and the other terminal thereof is connected to the A block composed of the polymerizable component containing the acidic group. The polymerizable double bond group will be described in detail below.

Suitable examples of the polymerizable double bond group include those represented by the following general formula (VIII):

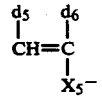

(VIII)

wherein $X_5$ has the same meaning as $X_3$ defined in the general formula (IV)/ and $d_5$ and $d_6$, which may be the same or different, each has the same meaning as $d_1$ and $d_2$ defined in the general formula (IV).

Specific examples of the polymerizable double bond group represented by the general formula (VIII)

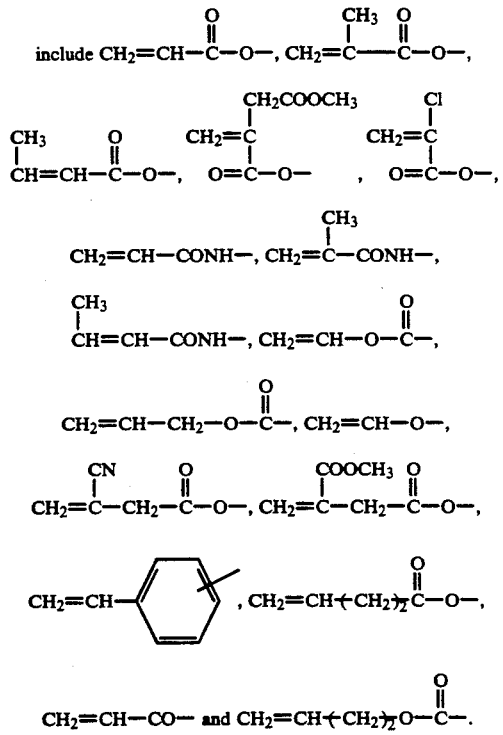

include $CH_2=CH—C(=O)—O—$, $CH_2=C(CH_3)—C(=O)—O—$, $CH=CH(CH_3)—C(=O)—O—$, $CH_2=C(CH_2COOCH_3)—C(=O)—O—$, $CH_2=C(Cl)—C(=O)—O—$, $CH_2=CH—CONH—$, $CH_2=C(CH_3)—CONH—$, $CH(CH_3)=CH—CONH—$, $CH_2=CH—O—C(=O)—$, $CH_2=CH—CH_2—O—C(=O)—$, $CH_2=CH—O—$, $CH_2=C(CN)—CH_2—C(=O)—O—$, $CH_2=C(COOCH_3)—CH_2—C(=O)—O—$, $CH_2=CH—$ (benzene ring), $CH_2=CH—(CH_2)_2—C(=O)—O—$, $CH_2=CH—CO—$ and $CH_2=CH—(CH_2)_2—O—C(=O)—$.

The macromonomer (M) used in the present invention has a structure in which a polymerizable double bond group preferably represented by the general formula (VIII) is bonded to one of the terminals of the B block either directly or through an appropriate linking group.

The linking group which can be used includes a carbon-carbon bond (either single bond or double bond), a carbon-hetero atom bond (the hetero atom includes, for example, an oxygen atom, a sulfur atom, a nitrogen atom, and a silicon atom), a hetero atom-hetero atom bond, and an appropriate combination thereof.

More specifically, the bond between the polymerizable double bond group and the terminal of the B block is a mere bond or a linking group selected from

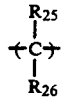

(wherein $R_{25}$ and $R_{26}$ each represents a hydrogen atom, a halogen atom (e.g., fluorine, chlorine, and bromine), a cyano group, a hydroxyl group, or an alkyl group (e.g., methyl, ethyl, and propyl), $-(CH=CH)-$,

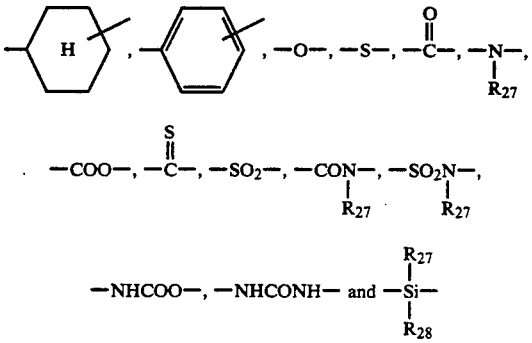

(wherein $R_{27}$ and $R_{28}$ each represents a hydrogen atom or a hydrocarbon group having the same meaning as defined for $R_{21}$ in the general formula (IV) described above), and an appropriate combination thereof.

If the weight average molecular weight of the macromonomer (M) exceeds $2\times10^4$, copolymerizability with other monomers is undesirably reduced. If, on the other hand, it is too low, the effect of improving electrophotographic characteristics of the light-sensitive layer would be small. Accordingly, the macromonomer (M) preferably has a weight average molecular weight of at least $1\times10^3$.

The macromonomer (M) used in the present invention can be produced by a conventionally known synthesis method. More specifically, it can be produced by the method comprising previously protecting the acidic group of a monomer corresponding to the polymer component having the specific acidic group to form a functional group, synthesizing an AB block copolymer by a so-called known living polymerization reaction, for example, an ion polymerization reaction with an organic metal compound (e.g., alkyl lithiums, lithium diisopropylamide, and alkylmagnesium halides) or a hydrogen iodide/iodine system, a photopolymerization reaction using a porphyrin metal complex as a catalyst, or a group transfer polymerization reaction, introducing a polymerizable double bond group into the terminal of the resulting living polymer by a reaction with a various kind of reagent, and then conducting a protection-removing reaction of the functional group which has been formed by protecting the acidic group by a hydrolysis reaction, a hydrogenolysis reaction, an oxidative decomposition reaction, or a photodecomposition reaction to generate the acidic group.

An example thereof is shown by the following reaction scheme (1):

Reaction Scheme (1)

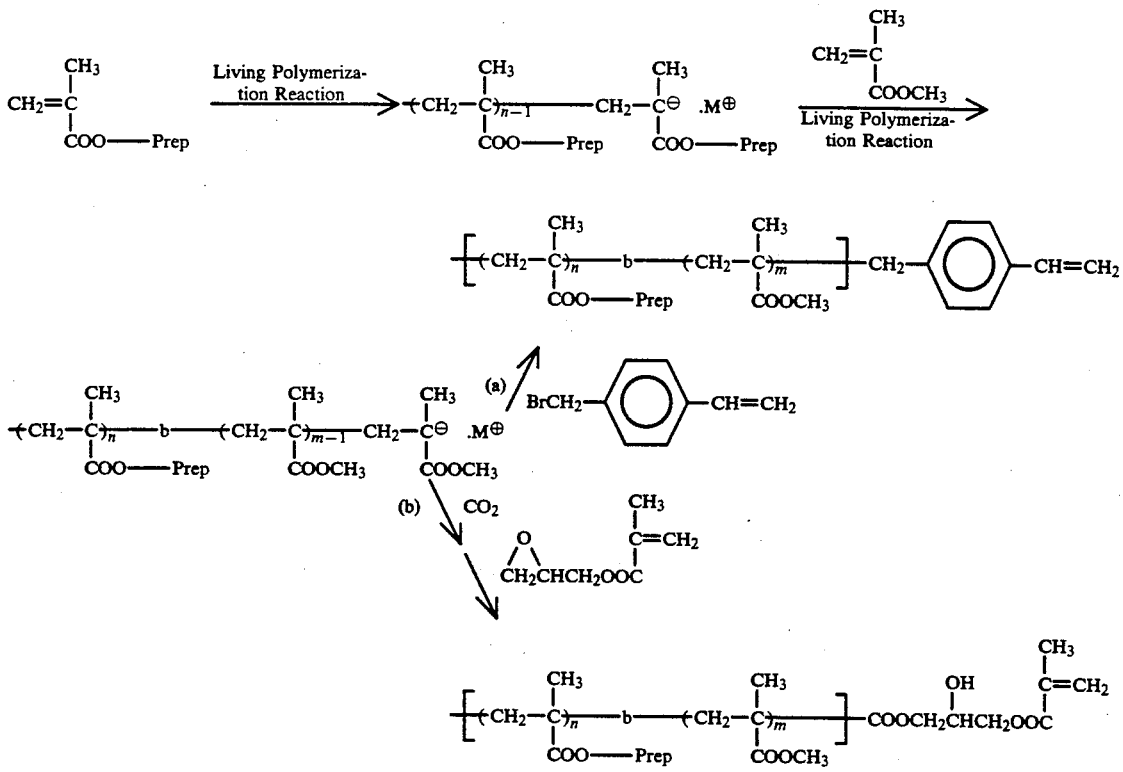

-continued

Reaction Scheme (1)

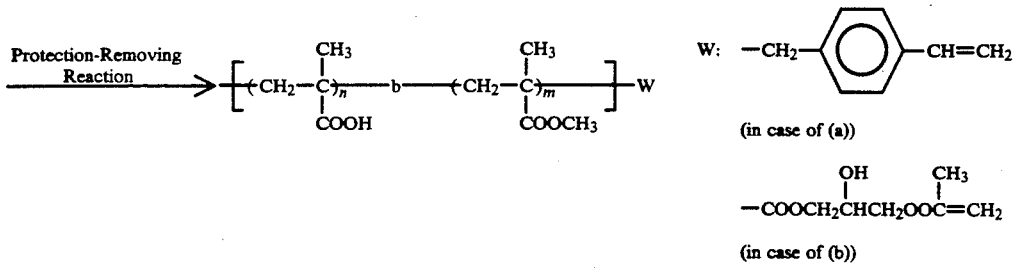

Prep . : Protective group for —COOH,

—b—: "—b—" represents that each of the repeating units bonded to —b— is present in the form of a block polymer component (hereinafter the same), n, m: repeating unit The living polymer can be easily synthesized according to synthesis methods as described, e.g., in P. Lutz, P. Masson et al, *Polym. Bull.*, 12, 79 (1984), B. C. Anderson, G. D. Andrews et al, *Macromolecules*, 14, 1601 (1981), K. Hatada, K. Ute et al, *Polym. J.*, 17, 977 (1985), ibid., 18, 1037 (1986), Koichi Migite and Koichi Hatada, *Kobunshi Kako* (*Polymer Processing*), 36, 366 (1987}, Toshinobu Higashimura and Mitsuo Sawamoto, *Kobunshi Ronbun Shu* (*Polymer Treatises*), 46, 189 (1989), M. Kuroki and T. Aida, *J. Am. Chem. Soc.*, 109, 4737 (1987), Teizo Aida and Shohei Inoue, *Yuki Gosei Kagaku* (*Organic Synthesis Chemistry*), 43, 300 (1985), and D. Y. Sogoh, W. R. Hertler et al, *Macromolecules*, 20, 1473 (1987).

In order to introduce a polymerizable double bond group into the terminal of the living polymer, a conventionally known synthesis method for macromonomer can be employed.

For details, reference can be made, for example, to P. Dreyfuss and R. P. Quirk, *Encycl. Polym. Sci. Eng.*, 7, 551 (1987), P. F. Rempp and E. Franta, Adu., *Polym. Sci.*, 58, 1 (1984), V. Percec, *Appl. Polym. Sci.*, 285, 95 (1984), R. Asami and M. Takari, *Makromol. Chem. Suppl.*, 12, 163 (1985), P. Rempp et al., *Makromol. Chem. Suppl.*, 8, 3 (1984), Yushi Kawakami, *Kogaku Kogyo*, 38, 56 (1987), Yuya Yamashita, *Kobunshi*, 31, 988 (1982), Shiro Kobayashi, *Kobunshi*, 30, 625 (1981), Toshinobu Higashimura, *Nippon Secchaku Kyokaishi*, 18, 536 (1982), Koichi Itoh, *Kobunshi Kako*, 35, 262 (1986), Kishiro Higashi and Takashi Tsuda, *Kino Zairyo*, 1987, No. 10, 5, and references cited in these literatures.

Also, the protection of the specific acidic group of the present invention and the release of the protective group (a reaction for removing a protective group) can be easily conducted by utilizing conventionally known techniques. More specifically, they can be performed by appropriately selecting methods as described, e.g., in Yoshio Iwakura and Keisuke Kurita, *Hannosei Kobunshi* (*Reactive Polymer*), published by Kodansha (1977), T. W. Greene, *Protective Groups in Organic Synthesis*, published by John Wiley & Sons (1981), and J. F. W. McOmie, *Protective Groups in Organic Chemistry*, Plenum Press, (1973), as well as methods as described in the above references.

Furthermore, the AB block copolymer can be also synthesized by a photoinfeter polymerization method using a dithiocarbamate compound as an initiator. For example, the block copolymer can be synthesized according to synthesis methods as described, e.g., in Takayuki Otsu, *Kobunshi* (*Polymer*), 37, 248 (1988), Shunichi Himori and Ryuichi Ohtsu, *Polym. Rep. Jap.* 37, 3508 (1988), JP-A-64-111, and JP-A-64-26619.

The macromonomer (M) according to the present invention can be obtained by applying the above described synthesis method for macromonomer to the AB block copolymer.

Specific examples of the macromonomer (M) which can be used in the present invention are set forth below, but the present invention should not be construed as being limited thereto. In the following formulae, $Q_1$, $Q_2$ and $Q_3$ each represents —H, —$CH_3$ or —$CH_2COOCH_3$; $Q_4$ represents —H or —$CH_3$; $R_{31}$ represents —$C_nH_{2n+1}$ (wherein n represents an integer of from 1 to 18),

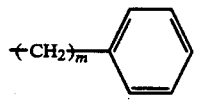

(wherein m represents an integer of from 1 to 3),

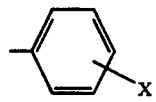

(wherein X represents —H, —Cl, —Br, —$CH_3$, —$OCH_3$ or —$COCH_3$) or

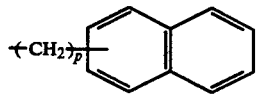

(wherein p represents an integer of from 0 to 3); $R_{32}$ represents —$C_qH_{2q+1}$ (wherein q represents an integer of from 1 to 8) or

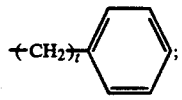

;

$Y_1$ represents —OH, —COOH,

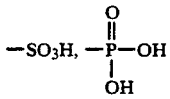
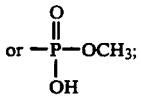
$Y_2$ represents —COOH,
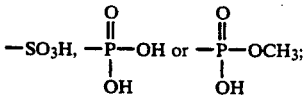
r represents an integer of from 2 to 12; s represents an integer of from 2 to 6; and —b— is as defined above.
(M-1)
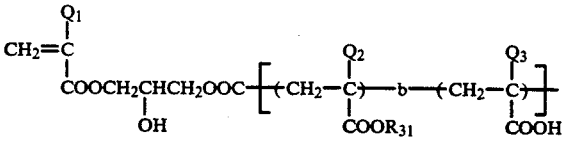
(M-2)
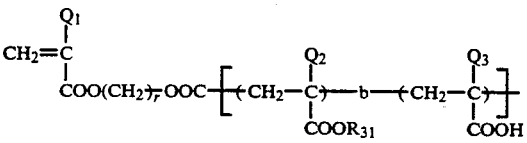
(M-3)
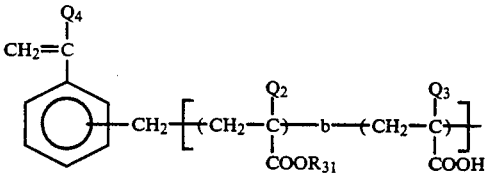
(M-4)
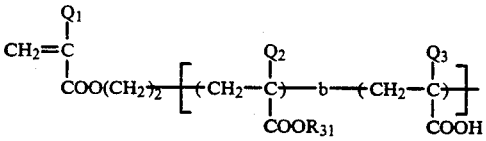
(M-5)
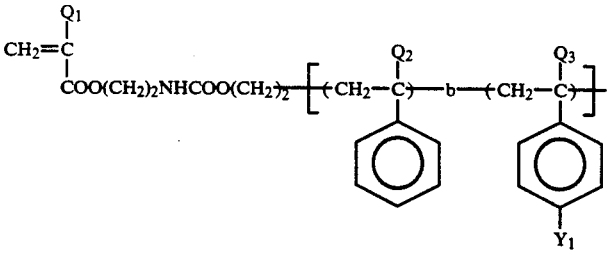
(M-6)
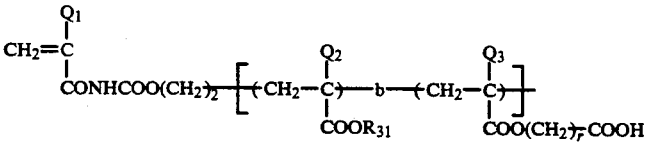
(M-7)
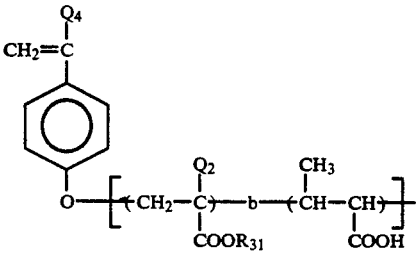

-continued
(M-8)
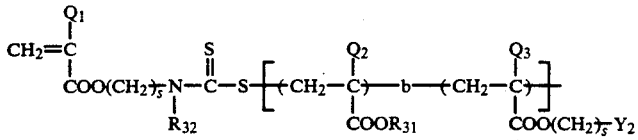
(M-9)
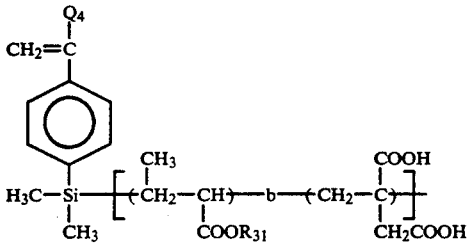
(M-10)
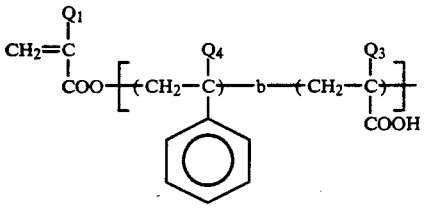
(M-11)
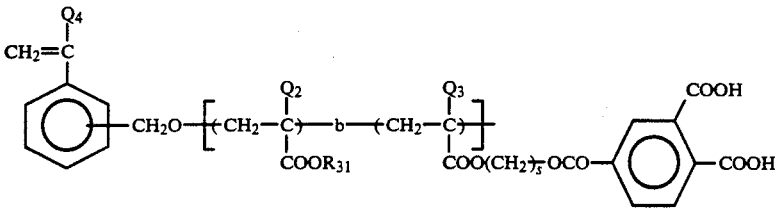
(M-12)
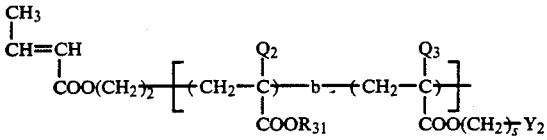
(M-13)
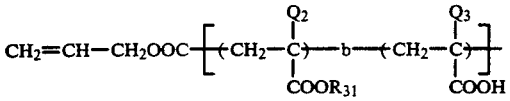
(M-14)
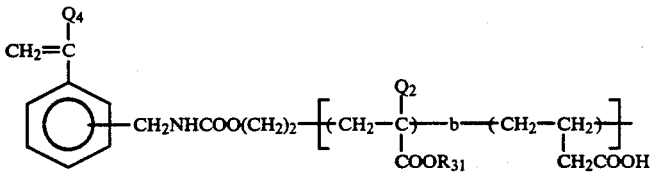
(M-15)
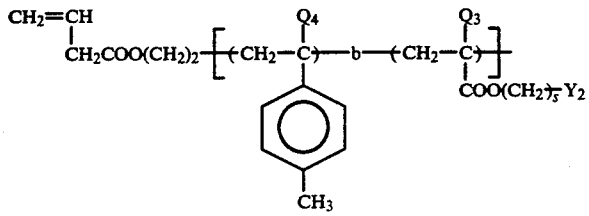

-continued (M-16)

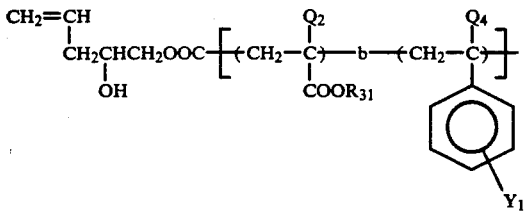

The monomer copolymerizable with the macromonomer (M) described above is preferably selected from those represented by the general formula (VI) described above. In the general formula (VI), $d_3$, $d_4$, $X_4$ and $R_{22}$ each has the same meaning as defined for $d_1$, $d_2$, $X_3$ and $R_{21}$ in the general formula (IV) as described above. More preferably, $d_3$ represents a hydrogen atom, $d_4$ represents a methyl group, and $X_2$ represents —COO—.

In the resin (B) used in the present invention, a ratio of the A block to the B block in the macromonomer (M) preferably ranges from 1 to 30/99 to 70 by weight. The content of the acidic group-containing component in the resin (B) is preferably from 0.1 to 20% by weight, more preferably from 0.5 to 10% by weight. A ratio of the copolymerizable component having the macromonomer (M) as a repeating unit to the copolymerizable component having the monomer represented by the general formula (VI) as a repeating unit ranges preferably from 1 to 60/99 to 40 by weight, more preferably 5 to 50/95 to 50 by weight.

The above description is for the embodiment wherein the binder resin for the photoconductive layer of the electrophotographic material of the present invention is composed of at least the binder resin (A) and the binder resin (B).

Now, another embodiment of the present invention wherein the binder resin is composed of at least the binder resin (A') and the binder resin (B) is described in detail. In this case, however, since the binder resin (B) is the same as that for the embodiment of the present invention described above, the detailed description of the binder resin (B) is omitted.

The binder resin in the embodiment of the present invention is composed of at least the binder resin (A'), that is, low molecular weight graft copolymer (A') having at least monofunctional macromonomer (MA') and a monomer represented by the above-described formula (III) and the high molecular weight binder resin (B).

The graft type copolymer used as the binder resin (A') may have at least one acidic group selected from $-PO_3H_2$, $-SO_3H$, —COOH, —OH, and

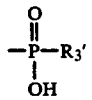

(wherein $R_3'$ has the same meaning as R described above) (hereinafter, the resin (A') is referred to as binder resin ($A_1'$)).

In this embodiment, it is also preferred that the high molecular weight binder resin (B) is a graft type copolymer containing at least one of the above-described macromonomers (M) and the polymer component represented by the formula (VI) described above.

The conventional acidic group-containing binder resins described above are mainly for offset master plates, the molecular weight of the resin is high (e.g., higher than $5\times10^4$) for improving the printing resistance by keeping a high film strength, and the copolymer of the binder resin is a random copolymer wherein acidic group-containing copolymer components randomly exist in the main chain of the polymer.

On the other hand, the binder resin (A') which is used for the binder resin in the present invention is a graft type copolymer and the acidic groups contained in the resin do not randomly exist in the polymer main chain but are contained in the graft portion of the polymer.

Accordingly, it is assumed that the portions of the acidic groups existing at the specific position apart from the main chain of the polymer adsorb to the stoichiometric defects of an inorganic photoconductive substance and the main chain portion of the polymer mildly and sufficiently cover or coat the surface of the photoconductive substance. It has been found that by the above phenomenon, the traps of the photoconductor are compensated and improve the humidity characteristics as well as the photoconductive particles can be sufficiently dispersed to prevent the occurrence of the aggregation of the particles, and also even when the environmental condition is greatly changed from high temperature and high humidity to low temperature and low humidity, stable electrophotographic characteristics of a high performance are maintained.

Also, the binder resin (B) improves sufficiently the mechanical strength of the photoconductive layer, the mechanical strength thereof being insufficient by the resin (A') only, without hindering the high performance of the electrophotographic characteristics by the use of the binder resin (A'). The binder resin used in the present invention is particularly effective in the case of a scanning exposure system using a semiconductor laser.

That is, by specifying the weight average molecular weight and the structure of the graft portion of each of the binder resin (A') and the binder resin (B) as the binder resin for the photoconductive layer in the present invention, and also the content of the acidic groups specifically contained in the resin, the strength of the interaction between the inorganic photoconductive substance and the resins and the facilitation of the interaction of the polymer molecular chains of the binder resin (A') and the binder resin (B) can be changed. Therefore, the low molecular weight resin (A') having a large content of the acidic groups and showing a higher interaction adequately and selectively adsorbs onto the inorganic photoconductive substance, the molecular chains of the macromonomer (MA') component (graft portion) of the binder resin (A') and the monomer component (main chain portion) of formula (III) cause a sufficient interaction with the molecular chain of the component of the main chain portion of the binder resin (B), and further the molecular chains of the macromonomer (M) component (graft portion) of the binder resin (B) cause a sufficient interaction with each other to show a so-called anchor effect.

It is assumed that, as the result thereof, the electrophotographic characteristics are greatly improved mainly by the action of the binder resin (A') and the mechanical strength of the photoconductive layer is improved by the action of the binder resin (B). Also, it is assumed that, in the binder resin (B), the acidic group bonded to the specific position of the polymer main chain causes a mild interaction with the inorganic photoconductive substance to an extent of not hindering the electrophotographic characteristics thereof.

Also, in the present invention, the surface of the photoconductive layer is smoothed. When an electrophotographic photosensitive material having a photoconductive layer of rough surface is used as a lithographic printing master plate by an electrophotographic system, the dispersion state of the particles of a photoconductive substance such as zinc oxide and a binder resin is not adequate, whereby, when the photosensitive layer is subjected to an oil-desensitizing treatment with an oil-desensitizing solution, the non-image areas are not uniformly rendered hydrophilic to cause attaching of a printing ink to the non-image areas at printing, which results in the occurrence of background stains in the non-image areas.

In the case of using the binder resin in the present invention, the interaction of the adsorption and coating of the inorganic photoconductive substance and the binder resin is adequately performed and also the high film strength of the photoconductive layer is maintained.

Furthermore, it has been found that the binder resin (A') used in the present invention has higher light sensitivity than a random copolymer resin having acidic groups at the side chains bonded to the polymer main chain.

Also, since spectral sensitizing dyes which are used for having a light sensitivity at the region of from visible light to infrared light sufficiently function the spectral sensitizing actions by adsorbing onto a photoconductive substance, it is assumed that the binder resin containing the copolymer of the present invention causes an adequate interaction with an inorganic photoconductive substance without hindering the adsorption of spectral sensitizing dyes to the photoconductor. This action is particularly remarkable for cyanine dyes or phthalocyanine series pigments which are particularly effective as spectral sensitizing dyes for the regions of near infrared to infrared.

When the low molecular weight resin (A') is used alone as a binder resin, the binder resin sufficiently adsorbs onto an inorganic photoconductive substance and covers the surfaces of the photoconductive particles, whereby the photoconductive layer shows good surface smoothness and electrostatic characteristics, images having no background staining are obtained. Further, a sufficient film strength as a CPC photosensitive material or as an offset printing master plate for printing several thousands prints is maintained. However, by using the resin (B) together with the resin (A') according to the present invention, the mechanical strength of the photoconductive layer, the mechanical strength thereof being yet insufficient by the resin (A') alone, can be more improved without adversely affecting the functions of the resin (A'). Accordingly, the electrophotographic photosensitive material of the present invention show excellent electrostatic characteristics even when the environmental condition is deviated, has a sufficiently high film strength, and can print at least 7000 prints having good image quality even under severe printing condition (e.g., when the printing pressure is increased by using a large printing machine).

Furthermore, in the present invention, the film strength is more improved whereby an improved printing resistance can be obtained.

In the binder resin (A') used in the present invention, the weight average molecular weight of the graft type copolymer is from $1\times10^3$ to $2\times10^4$, and preferably from $3\times10^3$ to $1\times10^4$, the content of the copolymer component of the macromonomer (M) is from 1 to 80% by weight, and preferably from 5 to 70% by weight. When the acidic group is bonded to the terminal of the main chain of the copolymer, the content of the acidic group in the copolymer is from 0.5 to 15% by weight, and preferably from 1 to 10% by weight. Also, the glass transition point of the binder resin (A') is preferably from −20° C. to 120° C., and more preferably from +10° C. to 90° C.

Further, if the molecular weight of the binder resin (A') is less than $1\times10^3$, the film-forming ability of the resin is reduced, whereby a sufficient film strength cannot be maintained, while, if the molecular weight is larger than $2\times10^4$, the electrophotographic characteristics (in particular, the initial potential and the dark decay retention) are undesirably deteriorated. In particular, in the case of such a high molecular weight resin, when the content of the acidic groups is over 3% by weight, the electrophotographic characteristics are greatly deteriorated and, when the photosensitive material is used as an offset master plate, the occurrence of background stains becomes severe.

If the content of optional acidic groups (optional acidic groups at the terminal of the main chain) in the binder resin (A') is less than 0.5% by weight, the initial potential is low and sufficient image density cannot be obtained. On the other hand, the content of the acidic group is higher than 15% by weight, the dispersibility is lowered, the smoothness of the surface of the photoconductive layer and the high humidity characteristics of the electrophotographic characteristics are lowered, and, further, when the photosensitive material is used as an offset printing master plate, the occurrence of background stains increases.

Then, the monofunctional macromonomer (MA') which is used as the copolymer component of the binder resin (A'), i.e., the graft type copolymer used in the present invention is explained practically.

The monofunctional macromonomer (MA') is a macromonomer having a weight average molecular weight of not more than $2\times10^4$ having the polymerizable double bond group represented by the formula (I) bonded to only one terminal of the main chain of the polymer containing at least one kind of the polymer components represented by the formulae (IIa) and (IIb) and at least one of polymer components each having the specific acidic group such as $$-COOH,\ -PO_3H_2,\ -SO_3H,\ -OH,\ \text{and/or}\ -\overset{\overset{\displaystyle O}{\|}}{\underset{\underset{\displaystyle OH}{|}}{P}}-R_1.$$

As a further component having the acidic group such as $$-COOH,\ -COOH,\ -PO_3H_2,\ -SO_3H,\ -OH,\ \text{or}\ -\overset{\overset{O}{\|}}{\underset{\underset{OH}{|}}{P}}-R_1,$$

which is contained in the macromonomer (MA') together with the copolymer component shown by formula (IIa) and/or formula (IIb), any vinylic compound having the above-described polar group can be used. These compounds are, for example, described in *Polymer Data Handbook* (*Foundation*), edited by Kobunshi Gakkai, published by Baifukan K.K., 1986.

Specific examples of the vinyl compounds are acrylic acid, α and/or β-substituted acrylic acid (e.g., α-acetoxyacrylic acid, α-acetoxymethylacrylic acid, α-(2-amino)ethylacrylic acid, α-chloroacrylic acid, α-bromoacrylic acid, α-fluoroacrylic acid, α-tributylsilylacrylic acid, α-cyanoacrylic acid, β-chloroacrylic acid, β-bromoacrylic acid, β-fluoroacrylic acid, β-methoxyacrylic acid, and α,β-dichloroacrylic acid), methacrylic acid, itaconic acid, itaconic acid half esters, itaconic acid half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, dicarboxylic acids, half ester derivatives of the vinyl group or allyl group of dicarboxylic acids, the ester derivatives of the carboxylic acids or sulfonic acids thereof, and compounds containing the acidic group in the substituents of amide derivatives.

As the hydrocarbon groups shown by $R_1$ and $R_2$ in $$-\overset{\overset{O}{\|}}{\underset{\underset{OH}{|}}{P}}-R_1,$$

the same hydrocarbon groups as those described above on $B_1$ in formula (IIa) can be used. The —OH group includes the phenolic hydroxy group such as a hydroxy group of hydroxy-substituted aromatic compounds containing a polymerizable double bond and a hydroxy group of (meth)acrylic acid esters and amides each having a hydroxyphenyl group as a substituent, and a hydroxy group of alcohols containing a vinyl group or allyl group (e.g., allyl alcohol), a hydroxy group of (meth)acrylates containing —OH group in an ester substituent thereof, and a hydroxy group of (meth)acrylamides containing —OH group in an N-substituent thereof).

Then, examples of the above-described vinyl monomer are shown below, but the scope of the present invention is not limited to these compounds.

In the following examples (formulae), a represents —H, $-CH_3$, —Cl, —Br, —CN, $-CH_2COOCH_3$, or $-CH_2COOH$; b represents —H or $-CH_3$; j represents an integer of from 2 to 18; k represents an integer of 2 to 5; h represents an integer of from 1 to 4; and i represents an integer of 1 to 12.

(A-1)

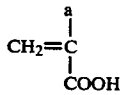

(A-2)

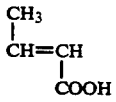

(A-3)

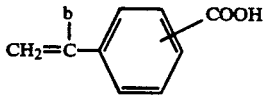

(A-4)

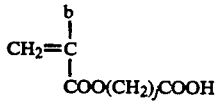

(A-5)

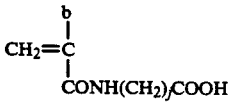

(A-6)

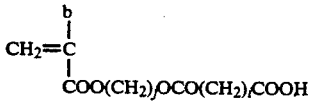

(A-7)

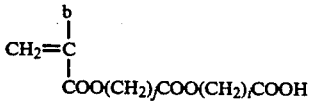

(A-8)

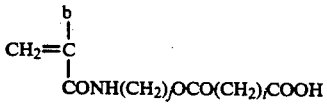

(A-9)

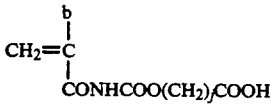

(A-10)

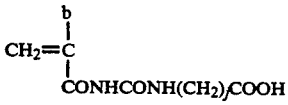

(A-11)

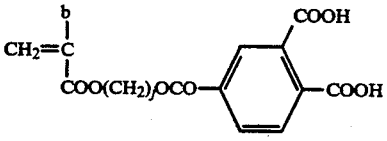

(A-12)

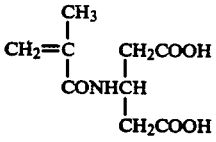

(A-13)

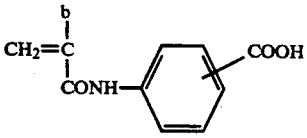

-continued
(A-14)
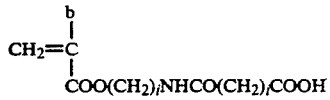
(A-15)
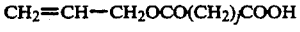
(A-16)
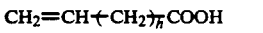
(A-17)
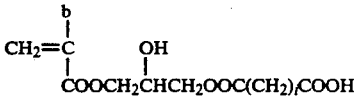
(A-18)
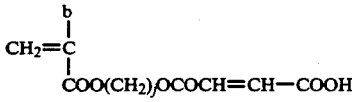
(A-19)
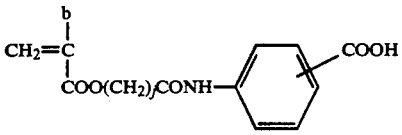
(A-20)
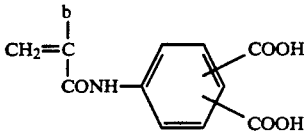
(A-21)
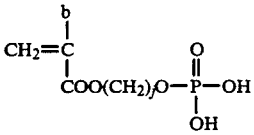
(A-22)
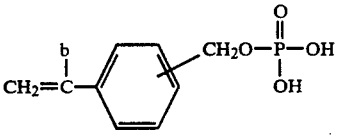
(A-23)
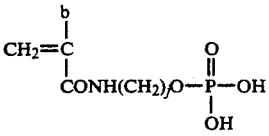
(A-24)
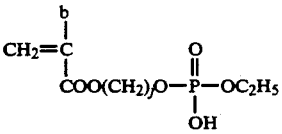
(A-25)
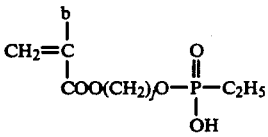
(A-26)
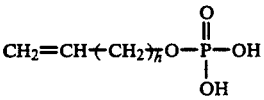
(A-27)
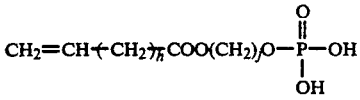
-continued
(A-28)
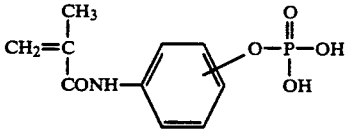
(A-29)
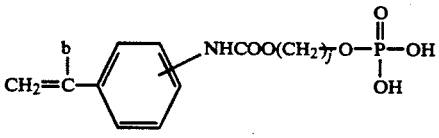
(A-30)
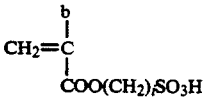
(A-31)
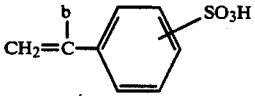
(A-32)
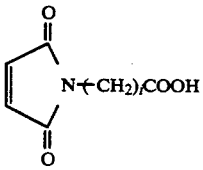
(A-33)
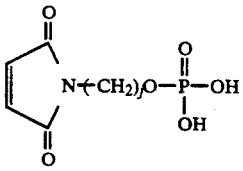
(A-34)
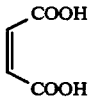
(A-35)
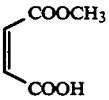
(A-36)
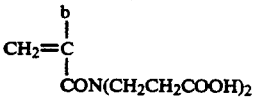
(A-37)
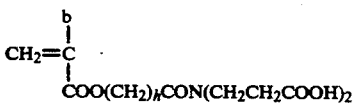
(A-38)
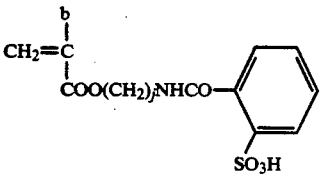

-continued

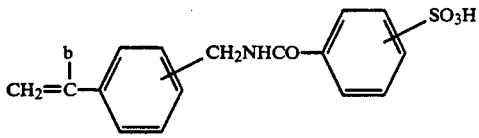
(A-39)

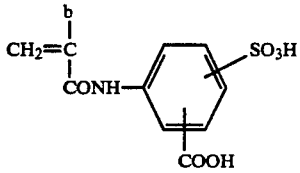
(A-40)

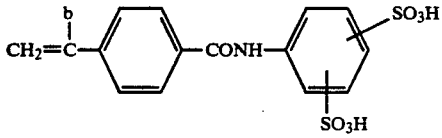
(A-41)

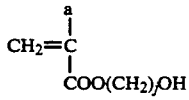
(A-42)

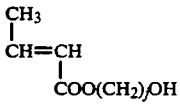
(A-43)

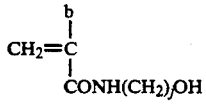
(A-44)

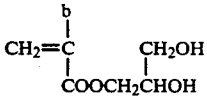
(A-45)

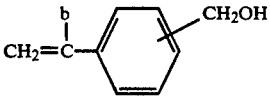
(A-46)

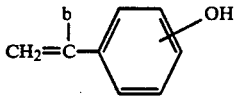
(A-47)

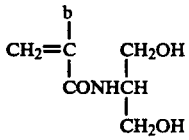
(A-48)

$CH_2{=}CH{+}CH_2{\rightarrow}_n OH$ (A-49)

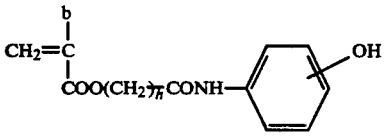
(A-50)

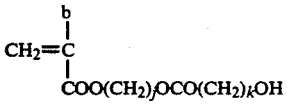
(A-51)

-continued $CH_2{=}CH{+}CH_2{\rightarrow}_n COO(CH_2){\rightarrow}_j OH$ (A-52)

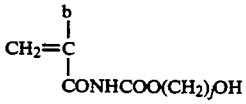
(A-53)

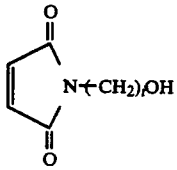
(A-54)

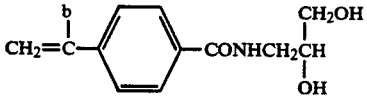
(A-55)

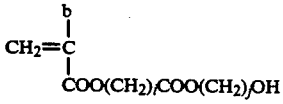
(A-56)

The content of the copolymer components having the above-described polar group contained in the macromonomer (MA') is preferably from 0.5 to 50 parts by weight, and more preferably from 1 to 40 parts by weight per 100 parts by weight of the total copolymer components in the macromonomer (MA').

When the mono-functional macromonomer (MA') composed of the random copolymer having the acidic group exists in the resin (A') as a copolymer component, the total content of the acidic group-containing component contained in the total grafted portions in the resin (A') is preferably from 0.1 to 10 parts by weight per 100 parts by weight of the total copolymer components in the resin (A'). When the resin (A') has the acidic group selected from —COOH, $—SO_3H$, and $—PO_3H_2$, the total content of the components having the acidic group in the grafted portions of the resin (A') is more preferably from 0.1 to 5 parts by weight.

The macromonomer (MA') may further contain other copolymer component(s) in addition to the above-described copolymer components.

As such a monomer corresponding to other polymerizable repeating unit, there are acrylonitrile, methacrylonitrile, acrylamides, methacrylamides, styrene, styrene derivatives (e.g., vinyltoluene, chlorostyrene, dichlorostyrene, bromostyrene, hydroxymethylstyrene, and N,N-dimethylaminomethylstyrene), and heterocyclic vinyls (e.g., vinylpyridine, vinylimidazole, vinylpyrrolidone, vinylthiophene, vinylpyrazole, vinyldioxane and vinyloxazine).

When the macromonomer (MA') contains other monomers described above, the content of such monomers is preferably from 1 to 20 parts by weight per 100 parts by weight of the total copolymer components in the macromonomer (MA').

The macromonomer (MA') used in the present invention has a chemical structure that the polymerizable double bond group represented by formula (I) is bonded directly or by an optional linking group to only one terminal of the main chain of the random polymer composed of at least the repeating unit shown by formula (IIa) and/or the repeating unit shown by formula (IIb)

and at least the repeating unit having the specific acidic group.

The linking group which connects the component represented by formula (I) and the component shown by (IIa) or (IIb) or the acidic group-containing component includes a carbon-carbon bond (single bond or double bond), carbon-hetero atom bond (examples of the hetero atom are oxygen, sulfur, nitrogen, and silicon), and a hetero atom-hetero atom bond, or an optional combination of these atomic groups.

Specific examples of the linking group are a single linking group selected

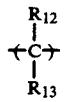

wherein $R_{12}$ and $R_{13}$ each represents a hydrogen atom, a halogen atom (e.g., fluorine, chlorine, and bromine), a cyano group, a hydroxy group, or an alkyl group (e.g., methyl, ethyl, and propyl)),

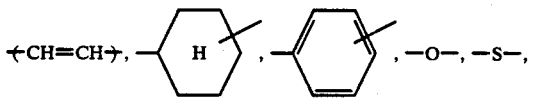

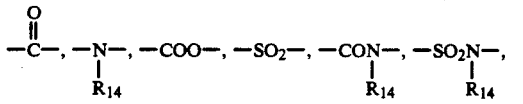

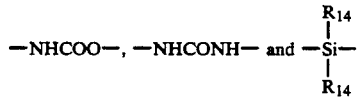

wherein $R_{14}$, which may be the same or different, each represents a hydrogen atom or the same hydrocarbon group as described above for $B_1$ in formula (IIa)) and a linking group composed of an optional combination of 2 or more these atomic groups.

If the weight average molecular weight of the macromonomer (MA') exceeds $2\times10^4$, the copolymerizing property with the monomer shown by formula is undesirably reduced. On the other hand, if the weight average molecular weight of the macromonomer (MA') is too low, the effect of improving the electrophotographic characteristics of the photoconductive layer is reduced. Thus, the weight average molecular weight is preferably from $1\times10^3$ to $2\times10^4$.

The macromonomer (MA') used in the present invention can be produced by conventional synthesis methods.

Practically, the macromonomer (MA') can be synthesized by a radical polymerization method of forming the macromonomer by reacting an oligomer having a reactive group bonded to the terminal and various reagent. The oligomer used above can be obtained by a radical polymerization using a polymerization initiator and/or a chain transfer agent each having a reactive group such as a carboxy group, a carboxyhalide group, a hydroxy group, an amino group, a halogen atom, an epoxy group, etc., in the molecule thereof.

Practical methods for producing the macromonomer (MA') are described in P. Dreyfuss & R. P. Quirk, *Encycl. Polym. Sci. Eng.*, 7, 551 (1987), P. F. Rempp & E. Franta, *Adu. Polym Sci.*, 58, 1 (1984), Yusuke Kawakami, *Kagaku Kogyo* (*Chemical Industry*), 38, 56 (1987), Yuuya Yamashita, *Koobunshi* (*Macromolecule*), 31, 988 (1982), Shiro Kobayashi, *Koobunshi* (*Macromolecule*), 35, 262 (1986), Kishiro Higashi & Takashi Tsuda, *Kino Zairyo* (*Functional Materials*), 1987, No. 10, 5, and the literature references and patents cited in these references.

However, since the macromonomer (MA') used in the present invention has the above-described polar group as the compounds of the repeating unit, the following matters should be considered in the synthesis thereof.

In one method, the radical polymerization and the introduction of a terminal reactive group are carried out by the above-described method using a monomer having the acidic group as the form of a protected functional group as shown, for example, in the following reaction formula (I).

Reaction Formula (I)

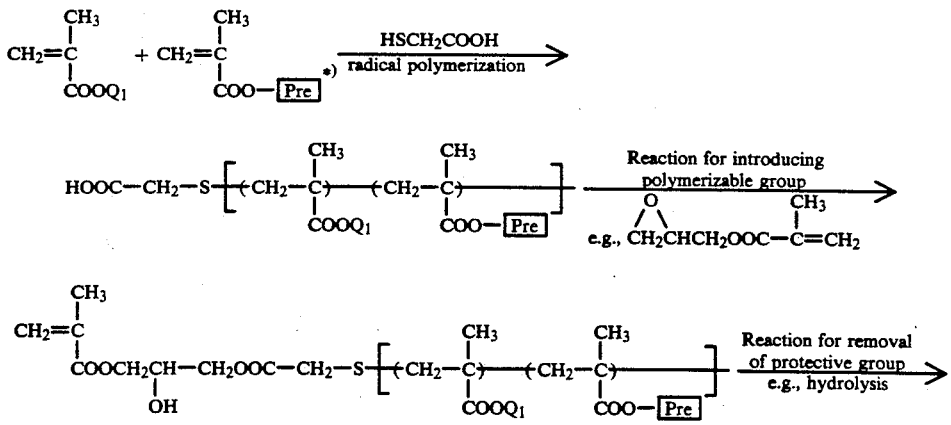

-continued

Reaction Formula (I)

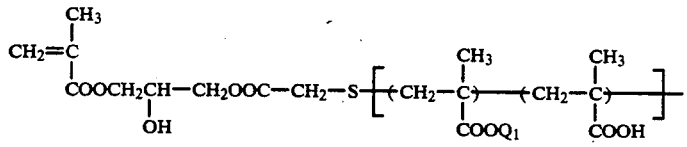

Pre : protective group for —COOH, e.g., $-C(C_6H_5)_3$,

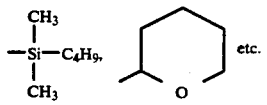

The reaction for introducing the protective group and the reaction for removal of the protective group (e.g., hydrolysis reaction, hydrogenolysis reaction, and oxidation-decomposition reaction) for the polar group $$(-SO_3H,\ -PO_3H_2,\ -COOH,\ -\overset{\overset{O}{\|}}{\underset{\underset{OH}{|}}{P}}-R^1,\ \text{and}\ -OH)$$

being randomly contained in the macromonomer (MA') used in the invention can be carried out by any of conventional known methods.

These methods are practically described in J. F. W. McOmie, *Protective Groups in Organic Chemistry*, Plenum Press (1973), T. W. Greene, *Protective Groups in Organic Synthesis*, John Wiley & Sons (1981), Ryoohei Oda, *Macromolecular Fine Chemical*, Kodansha K. K., (1976), Yoshio Iwakura and Keisuke Kurita, *Hannosei Kobunshi* (*Reactive Macromolecules*), Kodansha K. K. (1977), G. Gerner, et al, *J. Radiation Curing*, No. 10, 10 (1986), JP-A-62-212669, JP-A-62-286064, JP-A-62-210475, JP-A-62-195684, JP-A-62-258476, JP-A-63-260439, JP-A-1-63977, and JP-A-1-70767.

Another method for producing the macromonomer (MA') comprises synthesizing the oligomer by the same manner as described above and then reacting the oligomer with a reagent having a polymerizable double bond group which reacts with only "specific reactive group" bonded to one terminal by utilizing the difference between the reactivity and the "specific reactive group" and the reactivity of the polar group contained in the oligomer as shown in the following reaction formula (II).

Reaction Formula (II)

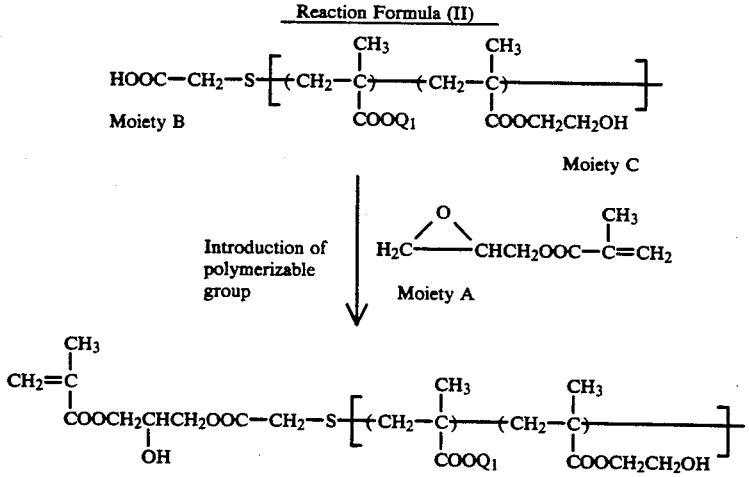

Specific examples of a combination of the specific functional groups (moieties A, B, and C) shown, in the reaction formula (II) are shown in Table A below although the invention is not limited to them. It is important to utilize the selectivity of reaction in an ordinary organic chemical reaction and the macromonomer may be formed without protecting the acidic group in the oligomer. In Table A, Moiety A is a functional group in the reagent for introducing a polymerizable group, Moiety B is a specific functional group at the terminal of oligomer, and Moiety C is a acidic group in the repeating unit in the oligomer.

TABLE A

| Moiety A | Moiety B | Moiety C |
|---|---|---|
| 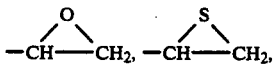 | —COOH, $-NH_2$ | —OH |

TABLE A-continued

| Moiety A | Moiety B | Moiety C |
|---|---|---|
| 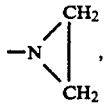 , —Halogen (Br, I, Cl) | | |
| —COCl, Acid Anhydride | —OH, —$NH_2$ | —COOH, —$SO_3H$, —$PO_3H_2$, |
| —$SO_2Cl$, | | 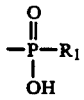 |
| —COOH, —$NHR_{15}$ | —Halogen | —COOH, —$SO_3H$, —$PO_3H_2$, |
| (wherein $R_{15}$ is a hydrogen atom or an alkyl group) | | 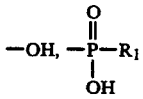 |
| —COOH, —$NHR_{15}$ | 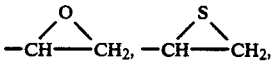 | —OH |
| | 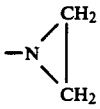 | |
| —OH, —$NHR_{15}$ | —COCl, —$SO_2Cl$ | —COOH, —$SO_3H$, —$PO_3H_2$ |

The chain transfer agent which can be used for producing the above-described macromonomer (MA') includes, for example, mercapto compounds having a substituent capable of being induced into the polar group later (e.g., thioglycolic acid, thiomalic acid, thisalicylic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)carbamoylpropionic acid, 3-[N-(2-mercaptoethyl)amino]propionic acid, N-(3-mercaptopropionyl)alanine, 2-mercaptoethanesulfonic acid, 3-mercaptopropanesulfonic acid, 4-mercaptobutanesulfonic acid, 2-mercaptoethanol, 3-mercapto-1,2-propanediol, 1-mercapto-2-propanol, 3-mercapto-2-butanol, mercaptophenol, 2-mercaptoethylamine, 2-mercaptoimidazole, and 2-mercapto-3-pyridinol), disulfide compounds which are the oxidation products of these mercapto compounds, and iodized alkyl compounds having the aforesaid polar group or substituent (e.g., iodoacetic acid, iodopropionic acid, 2-iodoethanol, 2-iodoethanolsulfonic acid, and 3-iodopropanesulfonic acid). In these compounds, the mercapto compounds are preferred.

Also, the polymerization initiator having a specific reactive group, which can be used for the production of the above-described macromonomer, include, for example, 2,2'-azobis(2-cyanopropanol), 2,2'-azobis(2-cyanopentanol), 4,4'-azobis(4-cyanovaleric acid), 4,4'-azobis(4-cyanovaleric acid chloride), 2,2'-azobis[2-(5-methyl-2-imidazolin-2-yl)propane], 2,2'-azobis[2-(2-imidazolin-2-yl)propanol], 2,2'-azobis[2-(2-imidazolin-2-yl)propanol], 2,2'-azobis[2-(3,4,5,6,-tetrahydropyrimidin-2-yl)propane], 2,2'-azobis[2-[1,2-hydroxyethyl)-2-imidazolin-2-yl]propane, 2,2'-azobis[2-methyl-N-(2-hydroxyethyl)-propionamide] and the derivatives thereof.

The chain transfer agent or the polymerization initiator is used in an amount of from 0.1 to 15 parts by weight, and preferably from 0.5 to 10 parts by weight per 100 parts by weight of the total monomers.

Specific examples of the macromonomer (MA') used in the present invention are illustrated below, but the present invention is not limited thereto.

In the following formulae, b represents —H or —$CH_3$, d represents —H, —$CH_3$, or —$CH_2COOCH_3$, R represents —$C_nH_{2n+1}$ (wherein n represents an integer of from 1 to 18),

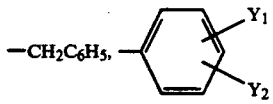

wherein $Y_1$ and $Y_2$ each represents

—H, —Cl, —Br, —$CH_3$, —$COCH_3$, or —$COOCH_3$)

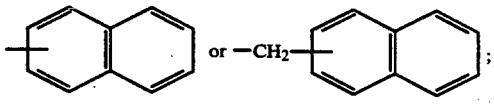

$W_1$ represents —CN, —$OCOCH_3$, —$CONH_2$, or —$C_6H_5$;

$W_2$ represents —Cl, —Br, —CN, or —$OCH_3$; e represents an integer of from 2 to 18; f represents an integer of from 2 to 12; and g represents an integer of 2 to 4.

(MA'-1)
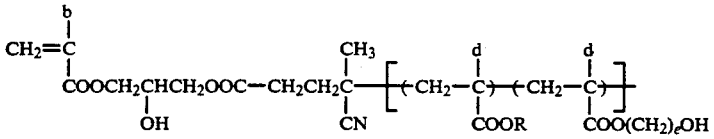
(MA'-2)
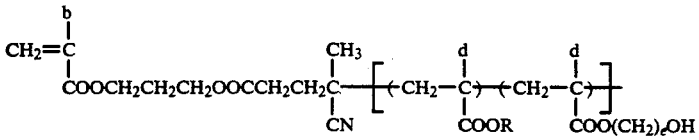
(MA'-3)
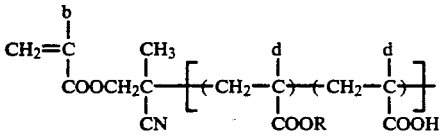
(MA'-4)
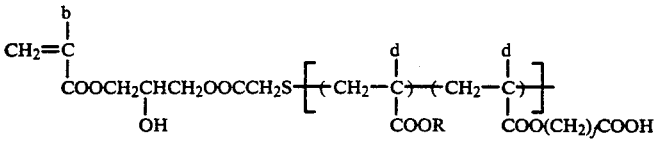
(MA'-5)
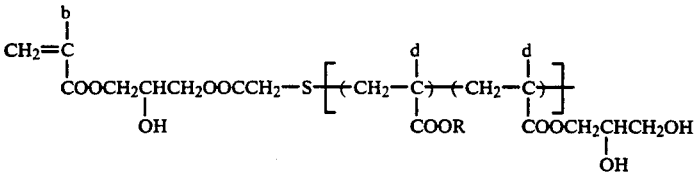
(MA'-6)
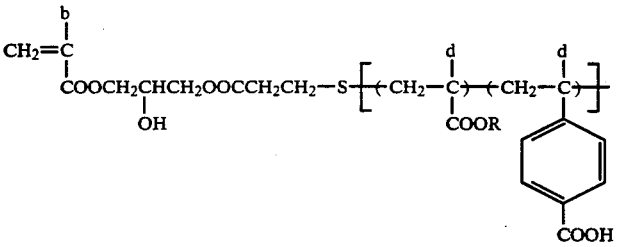
(MA'-7)
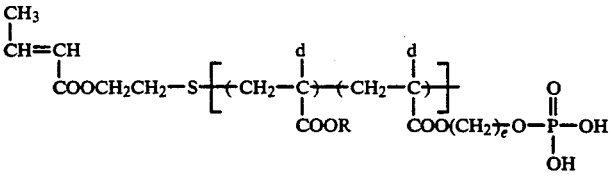
(MA'-8)
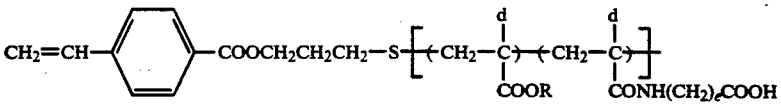
(MA'-9)
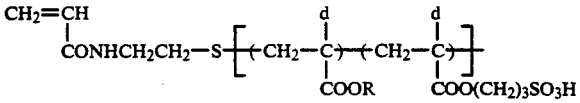

-continued
(MA'-10)
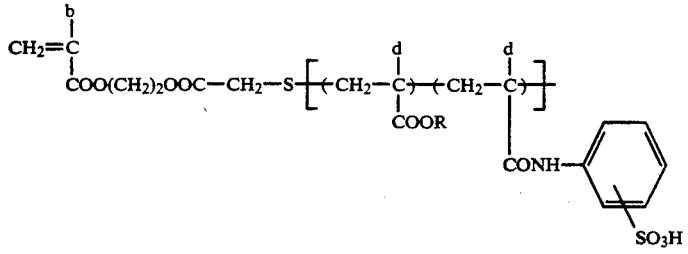
(MA'-11)
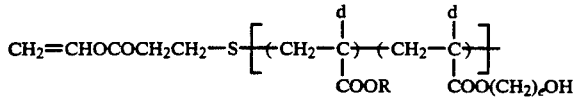
(MA'-12)
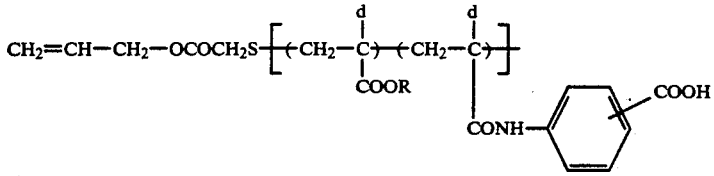
(MA'-13)
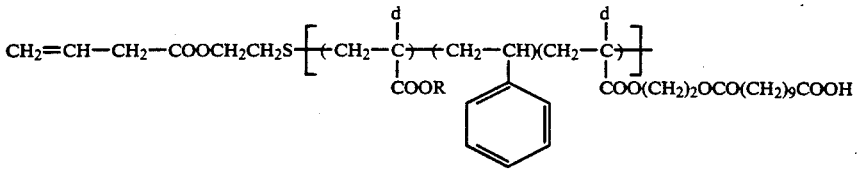
(MA'-14)
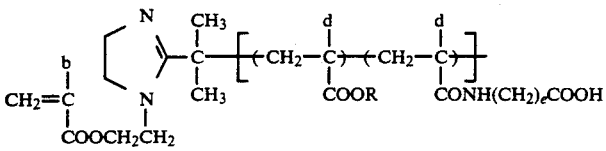
(MA'-15)
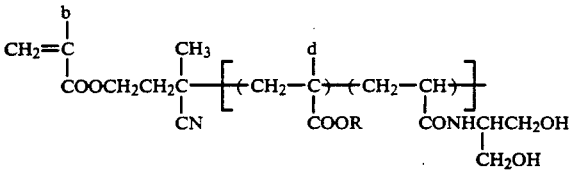
(MA'-16)
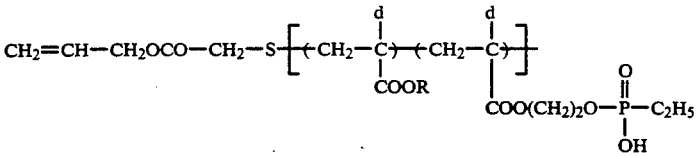
(MA'-17)
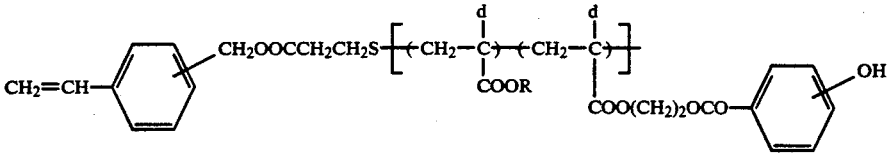
(MA'-18)
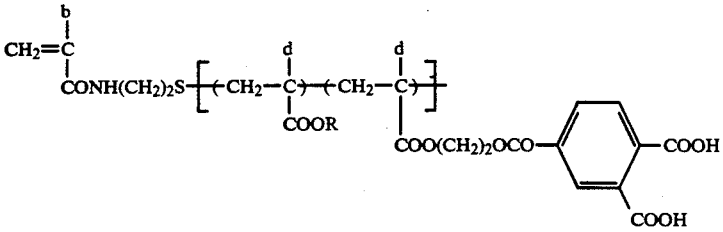

-continued (MA'-19)

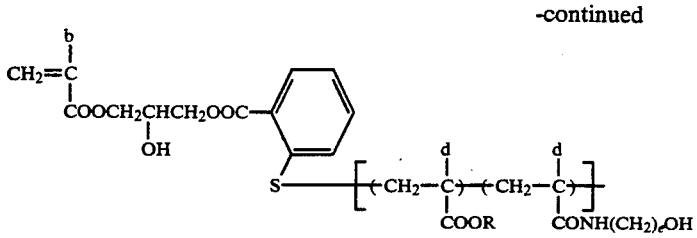

(MA'-20)

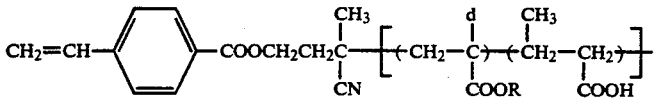

(MA'-21)

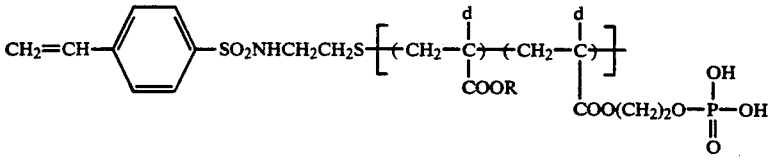

(MA'-22)

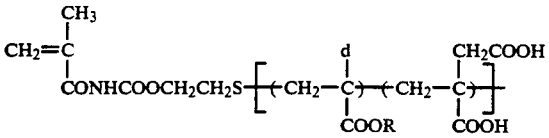

(MA'-23)

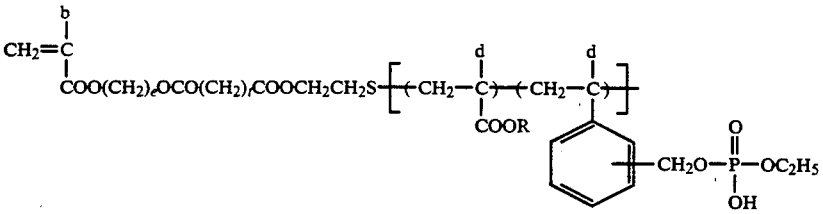

(MA'-24)

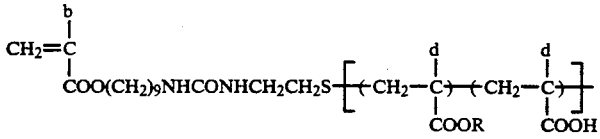

(MA'-25)

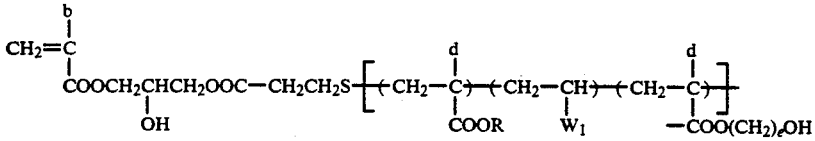

(MA'-26)

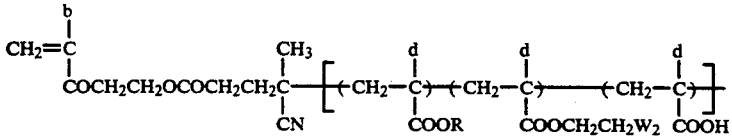

On the other hand, the monomer which is copolymerized with the above-described macromonomer (MA') is shown by formula (III) described above.

In formula (III), $c_1$ and $c_2$, which may be the same or different, have the same significance as $a_1$ and $a_2$ in formula (I) and $A_2$ and $B_2$ have the same meaning as $A_1$ and $B_1$ in formula (IIa), respectively.

In the resin (A') used in the present invention, the composition ratio of the copolymer component composed of the macromonomer (MA') as the repeating unit and the copolymer component composed of the monomer shown by formula (III) as the repeating unit is preferably from 5 to 70/95 to 30 by weight ratio, and more preferably from 10 to 60/90 to 40 by weight ratio.

Also, the binder resin (A') used in the present invention may further contain monomers other than the macromonomer (MA') and the monomer of formula (III) as a further copolymer component together with the macromonomer and the monomer.

Examples of such other monomer are α-olefins, alkanoic acid vinyl esters, alkanoic acid allyl esters, acrylonitrile, methacrylonitrile, vinyl ethers, acrylamides, methacrylamides, styrenes, and heterocyclic vinyls (e.g., vinylpyrrolidone, vinylpyridine, vinylimidazole, vinylthiophene, vinylimidazoline, vinylpyrazole, vinyldioxane, vinylquinoline, vinylthiazole, and vinyloxazine).

In addition, the content of monomers other than the macromonomer (MA') and the monomer of formula (III) is not more than 20% by weight of the copolymer.

In the graft copolymer used in the present invention, if the content of the copolymer component corresponding to the macromonomer (MA') is less than 1% by weight, the dispersion of the coating composition for the photoconductive layer becomes insufficient. Also, the content exceeds 80% by weight, the copolymerization with the monomer of formula (III) does not sufficiently proceeds, whereby polymers of the monomer of formula (III) only or other monomers only undesirably form in addition to the desired graft copolymer. Furthermore, if the photoconductive particles are dispersed using such a resin as the binder resin, aggregates of the resin and the photoconductive particles tend to form.

Furthermore, the binder resin (A') may be a copolymer (binder resin ($A_1$') having at least one of the polar group selected from $-PO_3H_2$, $-SO_3H$, —COOH, —OH, and

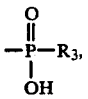

at only one terminal of the main chain of the polymer containing at least one of the repeating unit represented by formula (III) and at least one of the macromonomer (MA') as a repeating unit.

Also, in the present invention, the binder resin (A') may be used together with the binder resin ($A_1$').
In the above case, —OH and

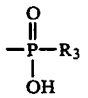

have the same meaning as —OH and

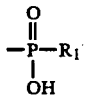

described above for the acidic group-containing polymer component of the resin (A').

Also, the acidic group is bonded to one terminal of the polymer main chain directly or through an appropriate linking group.

The linking group is composed of an appropriate combination of atomic groups such as a carbon-carbon bond (a single bond or a double bond), a carbon-hetero atom bond (examples of the hetero atom are oxygen, sulfur, nitrogen, and silicon). For example, the linking group is an atomic group selected from

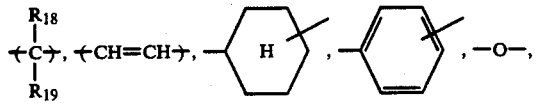

-continued

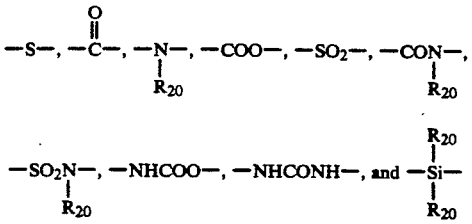

wherein $R_{18}$ to $R_{20}$ have the same meaning as $R_{12}$ to $R_{14}$ described above) or is composed of a combination of two or more the atomic groups.

In the binder resin (A') used in the present invention, the binder resin ($A_1$') having the acidic group at the terminal of the polymer main chain can be synthesized by using a polymerization initiator or a chain transfer agent each having the acidic group or a specific reactive group which can be induced to the acidic group later at the polymerization reaction of at least the above-described macromonomer (MA') and the monomer represented by formula (III).

Practically, in the synthesis of the macromonomer, the resin ($A_1$') can be obtained in the same manner as the above-described method for obtaining the oligomer having the reactive group at the terminal.

The binder resin used in the present invention may contain two or more kinds of the above-described binder resin (A') (including the binder resin (A')).

On the other hand, the weight average molecular weight of the binder resin (B) is from $3\times10^4$ to $1\times10^6$, and preferably from $5\times10^4$ to $5\times10^5$.

The content of the monofunctional macromonomer composed of the AB type block copolymer component in the copolymer of the resin (B) is from 1 to 60% by weight, and more preferably from 5 to 50% by weight. Furthermore, the content of the polymer component represented by formula (V) is preferably from 40 to 99% by weight, and more preferably from 50 to 95% by weight.

The glass transition point of the binder resin (B) is preferably from 0° C. to 110° C., and more preferably from 20° C. to 90° C.

In the molecular weight of the binder resin (B) is less than $3\times10^4$, a sufficient film strength cannot be maintained, while, if the molecular weight is larger than $1\times10^6$, the dispersibility is reduced and the smoothness of the surface of the photoconductive layer is reduced, whereby the image quality of duplicated images is deteriorated (in particular, the reproducibility of fine lines and letters is lowered) and, further, when the light-sensitive material is used as an offset printing master plate, the occurrence of background stains becomes severe.

Also, if the content of the macromonomer in the binder resin (B) is less than 1% by weight, the electrophotographic characteristics (in particular, dark decay ratio and light sensitivity) are reduced and also the deviation of the electrophotographic characteristics under environmental condition becomes larger in the combination with spectral sensitizing dyes for the region of from near infrared to infrared. The reason therefor is considered that the content of the macromonomer which forms the graft portion becomes low, thereby resulting in the formation of almost the same composition as a conventional homopolymer or random copolymer.

On the other hand, if the content of the macromonomer exceeds 60% by weight, the copolymerability of monomers corresponding to the other copolymer components and the macromonomer of the present invention is insufficient and, when the resin is used as a binder resin for photoconductive layer, sufficient electrophotographic characteristics cannot be obtained.

The binder resins (A) or (A') and (B) according to the present invention can be produced by copolymerization of the corresponding mono-functional polymerizable compounds at the desired ratio. The copolymerization can be performed using a known polymerization method, for example, solution polymerization, suspension polymerization, precipitation polymerization, and emulsion polymerization. More specifically, according to the solution polymerization, monomers are added to a solvent such as benzene or toluene at the desired ratio and polymerized with an azobis compound, a peroxide compound or a radical polymerization initiator to prepare a copolymer solution. The solution is dried or added to a poor solvent whereby the desired copolymer can be obtained. In case of suspension polymerization, monomers are suspended in the presence of a dispersing agent such as polyvinyl alcohol or polyvinyl pyrrolidone and copolymerized with a radical polymerization initiator to obtain the desired copolymer.

Furthermore, in the binder resin used in the present invention, the synthesis of the low molecular weight binder resin (A) or (A') and the high molecular weight binder resin (B) can be easily controlled by the kind of the initiator, the amount of the initiator, the polymerization initiation temperature, and/or the use of a chain transfer agent.

As the binder resin of the photoconductive layer according to the present invention, a resin which is conventionally used as a binder resin for electrophotographic light-sensitive materials can be employed in combination with the above described binder resin according to the present invention. Examples of such resins are described, for example, in Harumi Miyamoto and Hidehiko Takei, *Imaging, Nos.* 8 and 9 to 12, 1978 and Ryuji Kurita and Jiro Ishiwata, *Kobunshi (Polymer)*, 17, 278–284 (1968).

Specific examples thereof include an olefin polymer, an olefin copolymer, a vinyl chloride copolymer, a vinylidene chloride copolymer, a vinyl alkanoate polymer, a vinyl alkanoate copolymer, an allyl alkanoate polymer, an allyl alkanoate copolymer, a styrene and styrene derivative polymer, a styrene and styrene derivative copolymer, a butadiene-styrene copolymer, an isoprene-styrene copolymer, a butadiene-unsaturated carboxylic acid ester copolymer, an acrylonitrile copolymer, a methacrylonitrile copolymer, an alkyl vinyl ether copolymer, acrylic acid ester polymer and copolymer, a methacrylic acid ester polymer and copolymer, a styrene-acrylic acid ester copolymer, a styrene-methacrylic acid ester copolymer, itaconic acid diester polymer and copolymer, a maleic anhydride copolymer, an acrylamide copolymer, a methacrylamide copolymer, a hydroxy group-modified silicone resin, a polycarbonate resin, a ketone resin, an amide resin, a hydroxy group and carboxy group-modified polyester resin, a butyral resin, a polyvinyl acetal resin, a cyclized rubber-methacrylic acid ester copolymer, a cyclized rubber-acrylic acid ester copolymer, a copolymer having a heterocyclic group containing no nitrogen atom (examples of the heterocyclic ring are a furan ring, a tetrahydrofuran ring, a thiophene ring, a dioxane ring, a dioxolan ring, a lactone ring, a benzofuran ring, a benzothiophene ring, and a 1,3-dioxetane ring), and an epoxy resin.

However, it is preferred that such resins are employed in a range of not more than 30% by weight based on the total weight of the binder resin.

The ratio of the resin (A) or (A') to the resin (B) is not particularly restricted, but ranges preferably from 5 to 50/95 to 50 by weight, more preferably from 10 to 40/90 to 60 by weight.

The inorganic photoconductive substance which can be used in the present invention includes zinc oxide, titanium oxide, zinc sulfide, cadmium sulfide, cadmium carbonate, zinc selenide, cadmium selenide, tellurium selenide, and lead sulfide, preferably zinc oxide.

The resin binder is used in a total amount of from 10 to 100 parts by weight, preferably from 15 to 50 parts by weight, per 100 parts by weight of the inorganic photoconductive substance.

If desired, various dyes can be used as spectral sensitizer in the present invention. Examples of the spectral sensitizers are carbonium dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, and styryl dyes), and phthalocyanine dyes (including metallized dyes). Reference can be made to, for example, in Harumi Miyamoto and Hidehiko Takei, *Imaging*, 1973, No. 8, 12, C. J. Young et al., *RCA Review*, 15, 469 (1954), Ko-hei Kiyota et al., *Denkitsushin Gakkai Ronhunshi, J* 63-*C*, No. 2, 97 (1980), Yuji Harasaki et al., *Kogyo Kagaku Zasshi*, 66, 78 and 188 (1963), and Tadaaki Tani, *Nihon Shashin Gakkaishi*, 35, 208 (1972).

Specific examples of the carbonium dyes, triphenylmethane dyes, xanthene dyes, and phthalein dyes are described, for example, in JP-B-51-452, JP-A-50-90334, JP-A 50-114227, JP-A-53-39130, JP-A-53-82353, U.S. Pat. Nos. 3,052,540 and 4,054,450, and JP-A-57-16456.

The polymethine dyes, such as oxonol dyes, merocyanine dyes, cyanine dyes, and rhodacyanine dyes, include those described, for example, in F. M. Hammer, *The Cyanine Dyes and Related Compounds*. Specific examples include those described, for example, in U.S. Pat. Nos. 3,047,384, 3,110,591, 3,121,008, 3,125,447, 3,128,179, 3,132,942, and 3,622,317, British Patents 1,226,892, 1,309,274 and 1,405,898, JP-B-48-7814 and JP-B-55-18892.

In addition, polymethine dyes capable of spectrally sensitizing in the longer wavelength region of 700 nm or more, i.e., from the near infrared region to the infrared region, include those described, for example, in JP-A-47-840, JP-A-47-44180, JP-B-51-41061, JP-A-49-5034, JP-A-49-45122, JP-A-57-46245, JP-A-56-35141, JP-A-57-157254, JP-A-61-26044, JP-A-61-27551, U.S. Pat. Nos. 3,619,154 and 4,175,956, and *Research disclosure*, 216, 117 to 118 (1982).

The light-sensitive material of the present invention is particularly excellent in that the performance properties are not liable to variation even when combined with various kinds of sensitizing dyes.

If desired, the photoconductive layer may further contain various additives commonly employed in conventional electrophotographic light-sensitive layer, such as chemical sensitizers. Examples of such additives include electron-accepting compounds (e.g., halogen, benzoquinone, chloranil, acid anhydrides, and organic carboxylic acids) as described in the above-mentioned *Imaging*, 1973, No. 8, 12; and polyarylalkane compounds, hindered phenol compounds, and p-phenylenediamine compounds as described in Hiroshi Kokado et al., *Saikin-no Kododen Zairyo to Kankotai no Kaihatsu Jitsuyoka,* Chaps. 4 to 6, Nippon Kagaku Joho K. K. (1986).

The amount of these additives is not particularly restricted and usually ranges from 0.0001 to 2.0 parts by weight per 100 parts by weight of the photoconductive substance.

The photoconductive layer suitably has a thickness of from 1 to 100 μm, preferably from 10 to 50 μm.

In cases where the photoconductive layer functions as a charge generating layer in a laminated light-sensitive material composed of a charge generating layer and a charge transporting layer, the thickness of the charge generating layer suitably ranges from 0.01 to 1 μm, particularly from 0.05 to 0.5 μm.

If desired, an insulating layer can be provided on the light-sensitive layer of the present invention. When the insulating layer is made to serve for the main purposes for protection and improvement of durability and dark decay characteristics of the light-sensitive material, its thickness is relatively small. When the insulating layer is formed to provide the light-sensitive material suitable for application to special electrophotographic processes, its thickness is relatively large, usually ranging from 5 to 70 μm, particularly from 10 to 50 μm.

Charge transporting material in the above-described laminated light-sensitive material include polyvinylcarbazole, oxazole dyes, pyrazoline dyes, and triphenylmethane dyes. The thickness of the charge transporting layer ranges from 5 to 40 μm, preferably from 10 to 30 μm.

Resins to be used in the insulating layer or charge transporting layer typically include thermoplastic and thermosetting resins, e.g., polystyrene resins, polyester resins, cellulose resins, polyether resins, vinyl chloride resins, vinyl acetate resins, vinyl chloride-vinyl acetate copolymer resins, polyacrylate resins, polyolefin resins, urethane resins, epoxy resins, melamine resins, and silicone resins.

The photoconductive layer according to the present invention can be provided on any known support. In general, a support for an electrophotographic light-sensitive layer is preferably electrically conductive. Any of conventionally employed conductive supports may be utilized in the present invention. Examples of usable conductive supports include a substrate (e.g., a metal sheet, paper, and a plastic sheet) having been rendered electrically conductive by, for example, impregnating with a low resistant substance; the above-described substrate with the back side thereof (opposite to the light-sensitive layer side) being rendered conductive and having further coated thereon at least one layer for the purpose of prevention of curling; the above-described substrate having provided thereon a water-resistant adhesive layer; the above-described substrate having provided thereon at least one precoat layer; and paper laminated with a conductive plastic film on which aluminum is vapor deposited.

Specific examples of conductive supports and materials for imparting conductivity are described, for example, in Yukio Sakamoto, *Denshishashin,* 14, No. 1, pp. 2 to 11 (1975), Hiroyuki Moriga, *Nyumon Tokushushi no Kagaku,* Kobunshi Kankokai (1975), and M. F. Hoover, *J, Macromol. Sci. Chem.,* A-4(6), pp. 1327 to 1417 (1970).

The present invention will now be illustrated in greater detail with reference to the following examples, but it should be understood that the present invention is not to be construed as being limited thereto.

Production Example 1 of Macromonomer MA: MM-1

A mixed solution of 95 g of methyl methacrylate, 5 g of thioglycolic acid, and 200 g of toluene was heated to 70° C. with stirring under a nitrogen gas stream and, after adding thereto 1.5 g of 4,4'-azobis(4-cyanovaleric acid) (hereinafter referred to as A.C.V.), the reaction was carried out for 8 hours. Then, to the reaction mixture were added 8 g of glycidyl methacrylate, 1.0 g of N,N-dimethyldodecylamine, and 0.5 g of t-butylhydroquinone, and the resulting mixture was stirred for 12 hours at 100° C. After cooling, the reaction mixture was reprecipitated from 2 liters of methanol to obtain 82 g of the polymer as a white powder. The weight average molecular weight (Mw) of the polymer was 5,800.

Production Example 2 of Macromonomer MA: MM-2

A mixed solution of 95 g of 2-chlorophenyl methacrylate, 5 g of thioglycolic acid, and 200 g of toluene was heated to 70° C. with stirring under a nitrogen gas stream and, after adding thereto 1.5 g of 2,2'-azobis-(isobutyronitrile) (hereinafter, A.I.B.N.), the reaction mixture were added 7.5 g of glycidyl methacrylate, 1.0 g of N,N-dimethyldodecylamine, and 0.8 g of t-butylhydroquinone, and the resulting mixture was stirred for 12 hours at 100° C. After cooling, the reaction mixture was reprecipitated from 2 liters of methanol to obtain 85 g of the polymer as a colorless transparent viscous product. Mw of the polymer was 3,500.

Production Example 3 of Macromonomer MA: MM-3

A mixed solution of 94 g of butyl methacrylate, 6 g of 2-mercaptoethanol, and 200 g of toluene was heated to 70° C. with stirring under a nitrogen gas stream and, after adding thereto 1.2 g of A.I.B.N., the reaction was carried out for 8 hours.

Then, the reaction mixture was cooled to 20° C. in a water bath and, after adding thereto 10.2 g of triethylamine, 14.5 g of methacrylic acid chloride was added dropwise to the reaction mixture with stirring for one hour. The resulting mixture was further stirred for one hour at that temperature. Thereafter, 0.5 g of t-butylhydroquinone was added thereto, and the mixture was stirred for 4 hours at 60° C. After cooling, the reaction product was reprecipitated to obtain 79 g of the polymer as a colorless transparent viscous product. $\overline{M}w$ of the product was 6,000.

Production Example 4 of Macromonomer MA: MM-4

A mixed solution of 95 g of ethyl methacrylate and 200 g of toluene was heated to 70° C. with stirring under a nitrogen gas stream and, after adding thereto 5 g of 2,2'-azobis(cyanoheptanol), the reaction was carried out for 8 hours.

After cooling, the reaction mixture was cooled to 20° C. in a water bath and, after adding thereto 1.0 g of triethylamine and 21 g of methacrylic acid anhydride followed by stirring for one hour, the resulting mixture was stirred for 6 hours at 60° C.

After cooling, the reaction product obtained was reprecipitated from 2 liters of methanol to obtain 75 g of the polymer as a colorless transparent viscous product. $\overline{M}w$ of the product was 8,500.

Production Example 5 of Macromonomer MA: MM-5

A mixed solution of 96 g of 2-chloro-6-methylphenyl methacrylate, 4 g of thioglycolic acid and 200 g of toluene was heated to 75° C. with stirring under a nitrogen gas stream and, after adding thereto 1.5 g of A.I.B.N., the reaction was carried out for 8 hours. Then, the reaction mixture was cooled to 25° C. and, after adding thereto 10 g of 2-hydroxyethyl methacrylate and 1.5 g of t-butylhydroquinone, the resulting mixture was stirred. To the mixture was added dropwise a mixture of 25 g of dicyclohexylcarbodimide (D.C.C.), 1 g of 4-(N,N-dimethylamino)pyridine, and 100 ml of methylene chloride with stirring over a period of one hour. After completion of the addition, the mixture was further stirred for 4 hours as it was, 10 g of acetic acid was added thereto followed by stirring for one hour.

The crystals thus precipitated were removed by suction filtration, and the residue was reprecipitated from 2 liters of methanol. The precipitate thus formed was collected by decantation and dissolved in 200 ml of methylene chloride, and the solution was reprecipitated again from one liter of methanol.

The precipitate thus formed was collected by decantation and dried under reduced pressure. The amount of the liquid product obtained was 58 g. $\overline{M}w$ was $7.3\times10^3$.

Production Example 1 of Resin (A): (A-1)

A mixed solution of 75 g of benzyl methacrylate, 25 g of macromonomer (MM-1), 4 g of thiosalicylic acid, and 150 g of toluene was heated to 75° C. with stirring under a nitrogen gas stream and, after adding thereto 1.0 g of A.I.B.N., the reaction was carried out for 4 hours. Then, 0.5 g of A.I.B.N. was added thereto, and the reaction was carried out for 3 hours. After further adding thereto 0.3 g of A.I.B.N., the reaction was carried out for 3 hours.

$\overline{M}w$ of the copolymer obtained was $8.8\times10^3$.

The polymer (A-1) obtained is shown below.

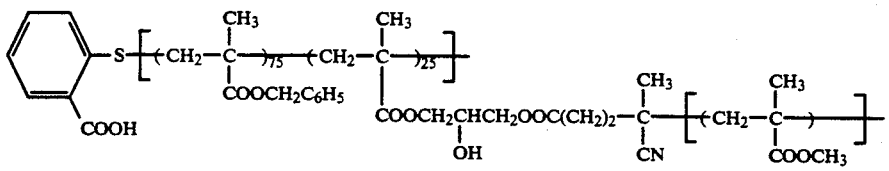

(A-1)

Production Example 2 of Resin (A): (A-2)

A mixed solution of 70 g of 2-bromophenyl methacrylate, 30 g of macromonomer (MM-2), 100 g of toluene, and 50 g of isopropanol was heated to 80° C. with stirring under a nitrogen gas stream and, after adding thereto 5.0 g of A.C.V., the reaction was carried out for 6 hours. Then; 1.0 g of A.C.V. was added thereto, and the reaction was carried out for 4 hours.

$\overline{M}w$ of the copolymer obtained was $8.8\times10^4$.

The polymer (A-2) obtained is shown below.

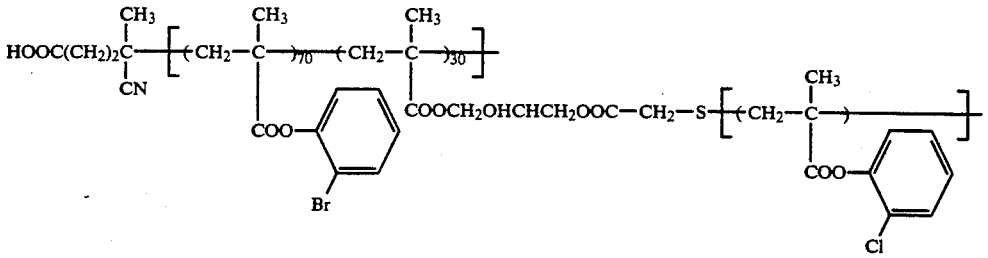

(A-2):

Production Example 3 to 15 of Resin (A): (A-3) to (A-15)

By following the same procedure as Production Example 1 of Resin (A) by properly selecting the combination of a methacrylate, macromonomer (MA), and a mercapto compound shown in Table 1 below, each of resins (A) shown in Table 1 were synthesized. The range of $\overline{M}w$ of the copolymers obtained was from $5\times103$ to $9\times10^3$.

TABLE 1
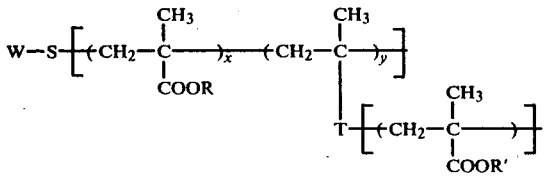
(x/y: weight composition ratio)
| Production Example of Resin (A) | Resin (A) | —W— | R | T | R | x/y |
|---|---|---|---|---|---|---|
| 3 | A-3 | $HOOC—CH_2—$ | $—C_2H_5$ | $COO(CH_2)_3C(CH_3)(CN)—$ | 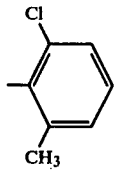 | 60/40 |
| 4 | A-4 | $HOOC—(CH_2)_2—$ | 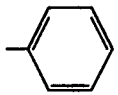 | $COOCH_2C(CH_3)(CN)—$ | $—C_3H_7$ | 80/20 |
| 5 | A-5 | $HOOC—CH(HOOC)CH_2—$ | $—CH_2C_6H_5$ | $COOH_2CH_2S—$ | $—CH_2C_6H_5$ | 70/30 |
| 6 | A-6 | $HO—P(=O)(OH)—OCH_2CH_2—$ | 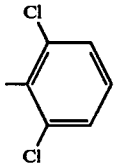 | $COO(CH_2)_2OCOCH_2S—$ | $—C_2H_5$ | 80/20 |
| 7 | A-7 | $H_5C_2O—P(=O)(OH)—OCH_2CH_2—$ | 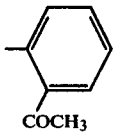 | " | $—C_4H_9$ | 70/30 |

TABLE 1-continued
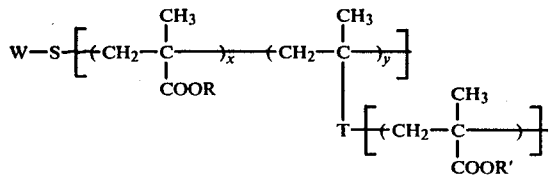
(x/y: weight composition ratio)
| Production Example of Resin (A) | Resin (A) | —W— | R | T | R | x/y |
|---|---|---|---|---|---|---|
| 8 | A-8 | 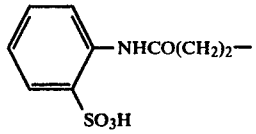 | $-CH_3$ | $COO(CH_2)_2OCO(CH_2)_2S-$ | $-CH_2C_6H_5$ | 70/30 |
| 9 | A-9 | 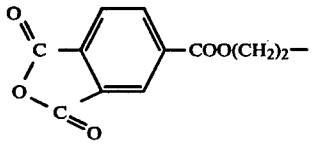 | 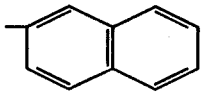 | $CONH(CH_2)_2S-$ | $-CH_3$ | 80/20 |
| 10 | A-10 | 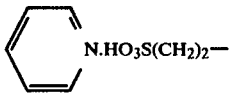 | 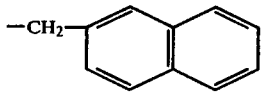 | $COOCH_2CH(OH)CH_2OOC-CH_2S-$ | 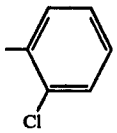 | 80/20 |
| 11 | A-11 | $HOOC(CH_2)_2COO(CH_2)_2-$ | 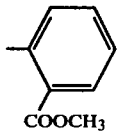 | " | $-CH_2C_6H_5$ | 75/25 |
| 12 | A-12 | 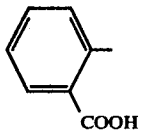 | $-CH_2CH_2OC_6H_5$ | " | 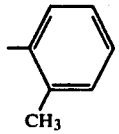 | 50/50 |

TABLE 1-continued
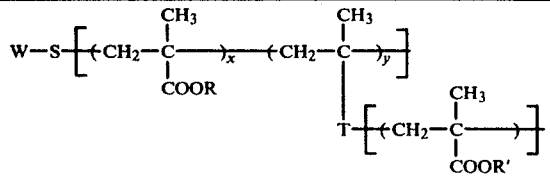
(x/y: weight composition ratio)
| Production Example of Resin (A) | Resin (A) | —W— | R | T | R | x/y |
|---|---|---|---|---|---|---|
| 13 | A-13 | 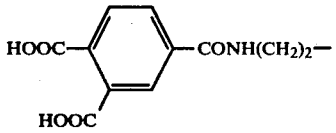 | 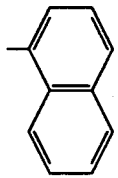 | $COO(CH_2)_3NHCOO(CH_2)_2S-$ | $-C_2H_5$ | 80/20 |
| 14 | A-14 | $HOOCCH_2-$ | 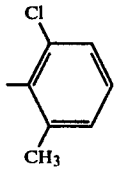 | $COO(CH_2)_2NHCOO(CH_2)_2S-$ | " | 80/20 |
| 15 | A-15 | 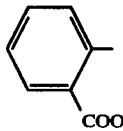 | $-CH_2CH_2-$ 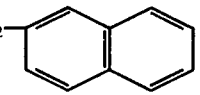 | $COOCH_2CHCH_2OOC(CH_2)_2-C(CH_3)(CN)$ (OH) | $-C_6H_5$ | 75/25 |

Production Example 16 of Resin (A): (A-16)

A mixed solution of 85 g of phenyl methacrylate, 15 g of macromonomer (MM-6) having the structure shown below, and 200 g of tetrahydrofuran was heated to 75° C. with stirring under a nitrogen gas stream and, after adding thereto 5 g of A.C.C., the reaction was carried out for 4 hours. Then, 1.0 g of A.C.C. was further added thereto, and the reaction was carried out for 3 hours.

of the product was obtained as a white powder. $\overline{M}w$ was $8.5\times10^3$.

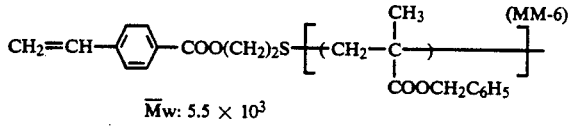

(MM-6)

$\overline{M}w$: $5.5\times10^3$

The resin (A-16) is shown below:

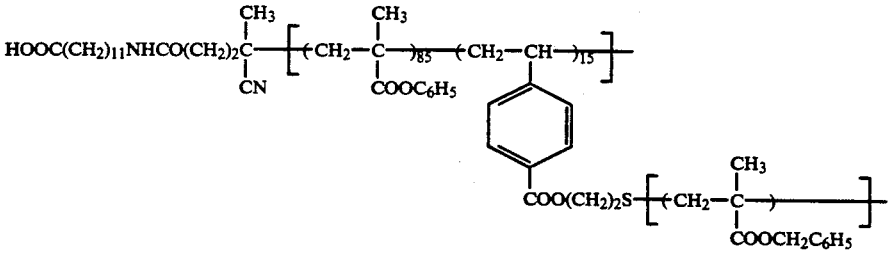

(A-16):

The reaction mixture was cooled to 25° C. and, after adding thereto 12 g of pyridine, 100 g of a dimethylformamide solution of 15 g of 11-aminododecanoic acid was added dropwise to the mixture with stirring over a period of one hour. The mixture was stirred for 2 hours as it was and further stirred for one hour at 40° C. After cooling, the reaction product was reprecipitated from 2 liters of methanol, the white powder thus formed was collected by filtration, and dissolved in 100 g of tetrahydrofuran. The solution was reprecipitated from one liter of methanol, and a white powder formed was collected by filtration. After drying under reduced pressure, 48 g Production Example 17 to 21 of Resin (A): (A-17) to (A-24)

By following the same procedure as Production Example 2 of Resin (A) except that the compounds corresponding to copolymer components shown in Table 2 below were used in place of the methacrylate and the macromonomer (MA), each of resins (A) shown in the table were synthesized.

The range of $\overline{M}w$ of the copolymers obtained was from $8\times10^3$ to $9.5\times10^3$.

TABLE 2

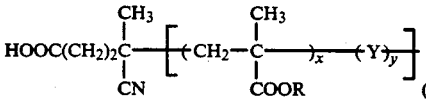

(x/y: weight composition ratio)

| Production Example of Resin (A) | Resin (A) | R | —Y— | x/y |
|---|---|---|---|---|
| 17 | A-17 | 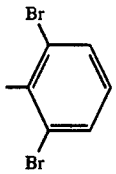 | 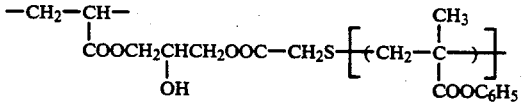 | 85/15 |
| 18 | A-18 | 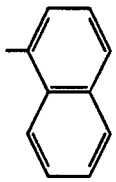 | 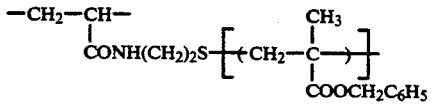 | 90/10 |
| 19 | A-19 | 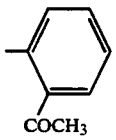 | 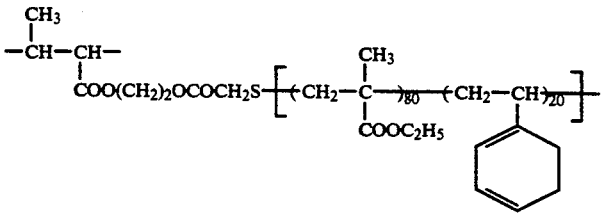 | 85/15 |

TABLE 2-continued

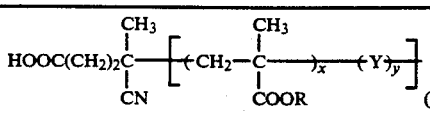

(x/y: weight composition ratio)

| Production Example of Resin (A) | Resin (A) | R | —Y— | x/y |
|---|---|---|---|---|
| 20 | A-20 | $-C_2H_5$ | 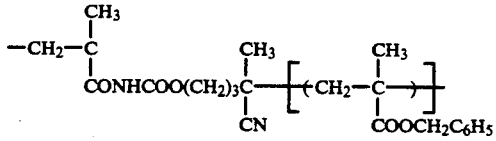 | 70/30 |
| 21 | A-21 | $-CH_2C_6H_5$ | 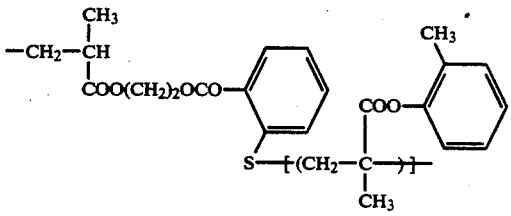 | 60/40 |
| 22 | A-22 | $-C_2H_5$ | 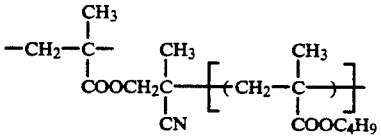 | 75/25 |
| 23 | A-23 | $-C_6H_5$ | 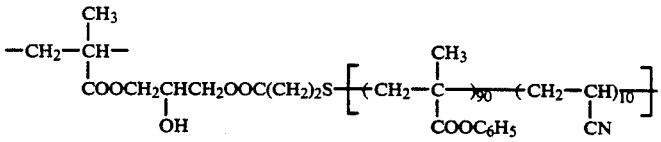 | 80/20 |
| 24 | A-24 | 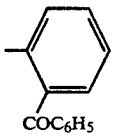 | 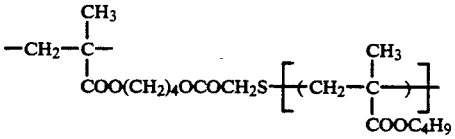 | 75/25 |

Production Example 1 of Macromonomer (MA'): MM'-1

A mixed solution of 90 g of ethyl methacrylate, 10 g of 2-hydroxyethyl methacrylate, 5 g of thioglycolic acid, and 200 g of toluene was heated to 75° C. with stirring under a nitrogen gas stream and, after adding thereto 1.0 g of 2,2-azobisisobutyronitrile (A.I.B.N.), the reaction was carried out for 8 hours. Then, to the reaction mixture were added 8 g of glycidyl, methacrylate, 1.0 g of N,N-dimethyldodecylamine, and 0.5 g of t-butylhydroquinone, and the resulting mixture was stirred for 12 hours at 100° C. After cooling, the reaction mixture was reprecipitated from 2 liters of n-hexane to obtain 82 g of a white powder. $\overline{M}w$ of the polymer (MM'-1) was $3.8\times10^3$.

Production Example 2 of Macromonomer (MA'): MM'-2

A mixed solution of 90 g of butyl methacrylate, 10 g of methacrylic acid, 4 g of 2-mercaptoethanol, and 200 g of tetrahydrofuran was heated to 70° C. with stirring under a nitrogen gas stream and, after adding thereto 1.2 g of A.I.B.N., the reaction was carried out for 8 hours.

Then, the reaction mixture was cooled to 20° C. in a water bath and, after adding thereto 10.2 g of triethylamine, 14.5 g of methacrylic acid chloride was added dropwise to the mixture with stirring at a temperature of lower than 25° C. Thereafter, the mixture was further stirred for one hour. Then, 0.5 g of t-butylhydroquinone was added to the mixture, and the resulting mixture was stirred for 4 hours at 60° C.

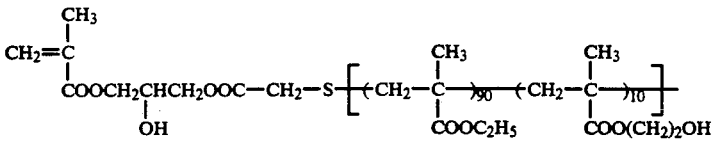

(MM'-1)

After cooling, the reaction mixture was added dropwise to one liter of water with stirring (over a period of about 10 minutes) followed by stirring for one hour. After allowing to stand the mixture, water was removed by decantation. After washing twice with water, the reaction mixture was dissolved in 100 ml of tetrahydrofuran and the solution was reprecipitated from petroleum ether. The precipitates thus formed were collected by decantation and dried under reduced pressure to obtain 65 g of the Product (MM'-2) as a viscous product $\overline{M}w$ of the polymer was $5.6\times10^3$.

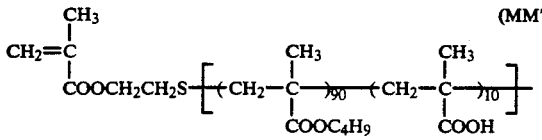

(MM'-2)

Production Example 3 of Macromonomer (MA'): MM,-3

A mixed solution of 95 g of benzyl methacrylate, 5 g of 2-phosphonoethyl methacrylate, 4 g of 2-aminoethylmercaptan, and 200 g of tetrahydrofuran was heated to 70° C. with stirring under a nitrogen gas stream. Then, after adding thereto 1.5 g of A.I.B.N., the reaction was carried out for 4 hours and, after further adding thereto 0.5 g of A.I.B.N., the reaction was carried out for 4 hour.

Then, the reaction mixture was cooled to 20° C. and after adding thereto 10 g of acrylic anhydride, the resulting mixture was stirred for one hour at a temperature of from 20° to 25° C. Then, 1.0 g of t-butylhydroquinone was added to the mixture, followed by stirring for 4 hours at a temperature of from 50° to 60° C. After cooling, the reaction mixture was added dropwise to one liter of water with stirring followed by stirring for one hour and, after allowing the reaction mixture to stand, water was removed by decantation. After repeatedly washing the mixture twice with water, the reaction mixture was reprecipitated from 2 liters of petroleum ether.

The precipitates formed were collected by decantation and dried under reduced pressure to obtain 70 g of the polymer (MM'-3) as a viscous product. Mw of the polymer was $7.4\times10^3$.

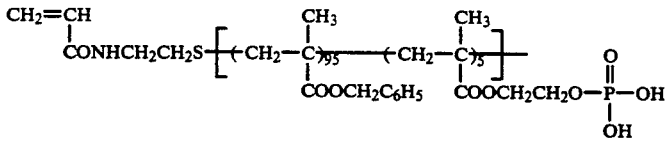

(MM'-3)

Production Example 4 of Macromonomer (MA'): MM'-4

A mixed solution of 90 g of 2-chlorophenyl methacrylate, 10 g of the monomer having the formula (I') shown below, 4 g of thioglycolic acid, and 200 g of toluene was heated to 70° C. with stirring under a nitrogen gas stream. After adding thereto 1.5 g of A.I.B.N., the reaction was carried out for 5 hours and, after further adding thereto 0.5 g of A.I.B.N., the reaction was carried out for 4 hour. Then, after further adding thereto 12.4 g of glycidyl methacrylate, 1.0 g of N,N-dimethyldodecylamine, 1.5 g of t-butylhydroquinone, the reaction was carried out for 8, hours at 110° C. After cooling, the reaction mixture was added to a mixture of 3 g of p-toluenesulfonic acid and 100 ml of an aqueous solution of 90% by volume tetrahydrofuran followed by stirring for one hour at a temperature of from 30° to 35° C. The reaction mixture was reprecipitated from 2 liters of a water/methanol (⅓ by volume) mixed solution, and the precipitates formed were collected by decantation. The precipitates were dissolved in 200 ml of tetrahydrofuran, and the solution was reprecipitated from 2 liters of n-hexane to obtain 58 g of a powder of the polymer (MM'-4). Mw of the polymer was $7.6\times10^3$.

Monomer (I'):

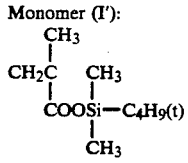

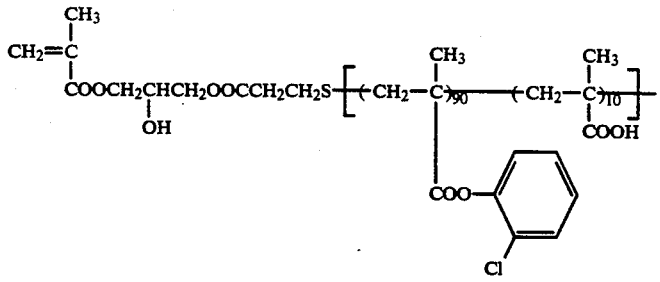

(MM'-4)

Production Example 5 of Macromonomer (MA'): MM'-5

A mixed solution of 95 g of 2,6-dichlorophenyl methacrylate, 5 g of 3-(2'-nitrobenzyloxysulfonyl)propyl methacrylate, 150 g of toluene, and 50 g of isopropyl alcohol was heated to 80° C. with stirring under a nitrogen gas stream. Then, after adding thereto 5.0 g of 2,2'-azobis(2-cyanovaleric acid) (A.C.V.), the reaction was carried out for 5 hours and, after further adding thereto 1.0 g of A.C.V., the reaction was carried out for 4 hours.

After cooling, the reaction mixture was reprecipitated from 2 liters of methanol, and the powder formed was collected by filtration and dried under reduced pressure.

A mixture of 50 g of the powder prepared above, 14 g of glycidyl methacrylate, 0.6 g of N,N-dimethyldocylamine, 1.0 g of t-butylhydroquinone, and 100 g of toluene was stirred for 10 hours at 110° C.

After cooling the mixture to room temperature, the mixture was irradiated by a high-pressure mercury lamp of 80 W for one hour. Thereafter, the reaction mixture was reprecipitated from one liter of methanol, and the powder formed was collected by filtration and dried under reduced pressure to obtain 34 g of the polymer (MM'-5).

$\overline{M}w$ of the polymer was $7.3\times10^3$.

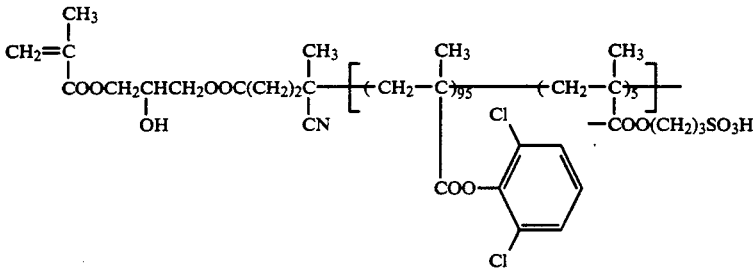

(MM'-5)

Production Example 1 of Resin (A'): A'-1

A mixed solution of 75 g of phenyl methacrylate, 25 g of the compound (MM'-2) obtained in Synthesis Example 2 of Macromonomer (MA'), and 100 g of toluene was heated to 100° C. with stirring under a nitrogen gas stream.

After adding thereto 6 g of A.I.B.N., the reaction was carried out for 4 hours and, after further adding thereto 3 g of A.I.B.N., the reaction was carried out for 3 hours to obtain the copolymer (A'-1).

$\overline{M}w$ of the copolymer obtained was $8.6\times10^3$.

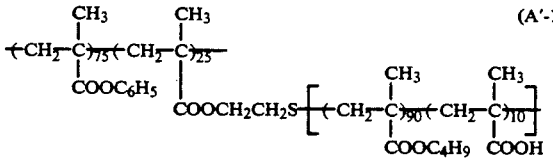

(A'-1)

Production Example 2 of Resin (A'): A'-2

A mixed solution of 70 g of 2-chlorophenyl methacrylate, 30 g of the compound (MM'-1) obtained in Synthesis Example 1 of Macromonomer (MA'), 3.0 g of β-mercaptopropionic acid, and 150 g of toluene was heated to 80° C. with stirring under a nitrogen gas stream. After adding thereto 1.0 g of A.I.B.N., the reaction was carried out for 4 hours. After further adding thereto 0.5 g of A.I.B.N., the reaction was carried out for 2 hours, and after further adding thereto 0.3 g of A.I.B.N., the reaction was carried out for 3 hours to obtain a copolymer (A'-2). $\overline{M}w$ of the copolymer was $8.5\times10^3$.

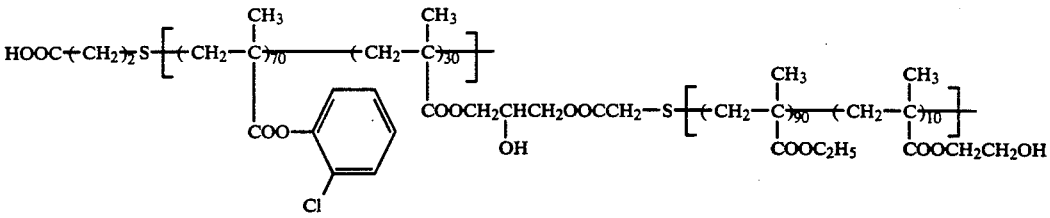

(A'-2)

Production Example 3 of Resin (A'): A'-3

A mixed solution of 60 g of 2-chloro-6-methylphenyl methacrylate, 25 g of the compound (MM'-4) obtained in Synthesis Example 4 of Macromonomer (MA'), 15 g of methyl acrylate, 100 g of toluene, and 50 g of isopropyl alcohol was heated to 80° C. with stirring under a nitrogen gas stream. After adding thereto 5 g of A.C.V., the reaction was carried out for 5 hours and, after further adding thereto 1 g of A.C.V., the reaction was carried out for 4 hours, to obtain a copolymer (A'-3).

$\overline{M}w$ of the copolymer obtained was $8.5\times10^3$.

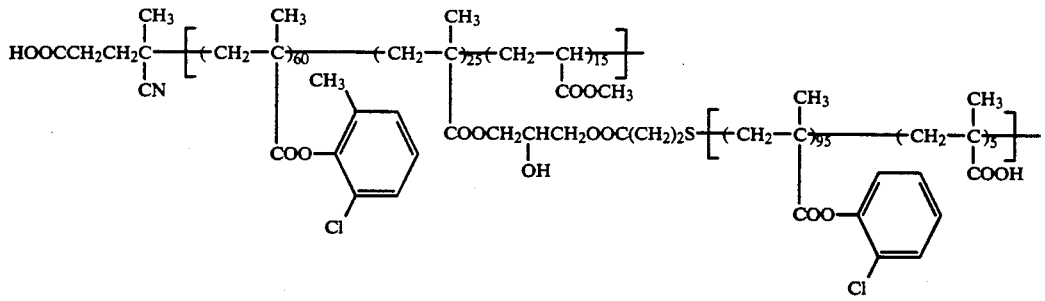

(A'-3)

Production Example 4 to 13 of Resin (A'): A'-4 to A'-13

By following the same procedure as Production Example 1 of Resin (A') using each components shown in Table 3, each of resins (A') shown in Table 3 was prepared. The range of $\overline{M}w$ of the copolymers obtained was from $6.0\times10^3$ to $9\times10^3$.

TABLE 3

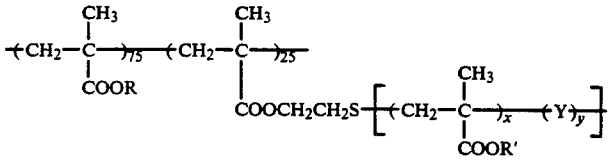

| Production Example | Resin (A) | R | R' | x/y (weight ratio) | —Y— |
|---|---|---|---|---|---|
| 4 | A-4 | $-C_2H_5$ | 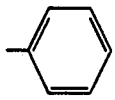 | 90/10 | $-CH_2-CH(COOH)-$ |
| 5 | A-5 | $-C_3H_7$ | 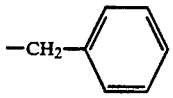 | 85/15 | $-CH_2-C(CH_3)(COO(CH_2)_2OCO(CH_2)_3COOH)-$ |
| 6 | A-6 | $-C_4H_9$ | 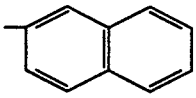 | 90/10 | $-CH_2-C(CH_3)(COO(CH_2)_2O-P(=O)(OH)-OH)-$ |
| 7 | A-7 | 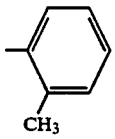 | $-CH_3$ | 90/10 | $-CH_2-CH(COOCH_2CH_2COOH)-$ |
| 8 | A-8 | 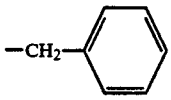 | $-C_2H_5$ | 90/10 | 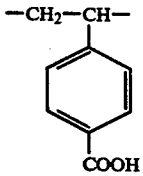 |
| 9 | A-9 | 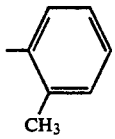 | $-C_4H_9$ | 92/8 | $-CH_2-C(CH_3)(COO(CH_2)_3SO_3H)-$ |

TABLE 3-continued

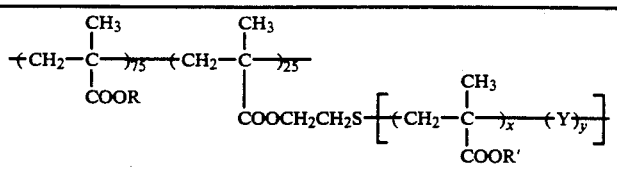

| Production Example | Resin (A) | R | R' | x/y (weight ratio) | —Y— |
|---|---|---|---|---|---|
| 10 | A-10 | $-CH_3$ | 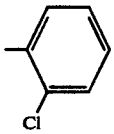 | 93/7 | 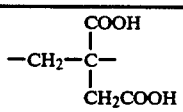 |
| 11 | A-11 | $-CH_3$ | $-C_2H_5$ | 90/10 | 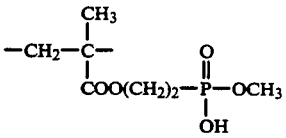 |
| 12 | A-12 | 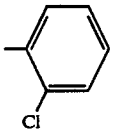 | $-C_2H_5$ | 95/5 | 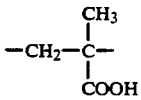 |
| 13 | A-13 | 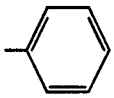 | 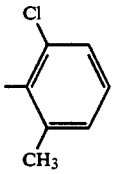 | 90/10 | 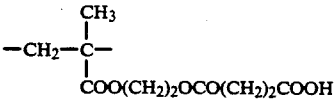 |

Production Example 14 to 27 of Resin (A'): A'-14 to A'-27

By following the same procedure as Production Example 2 of Resin (A') using each components shown in Table 4 below, each of the copolymers (A'-14) to (A'-27) shown in Table 4 was prepared.

$\overline{M}w$ of the copolymers obtained was in the range of from $5\times10^3$ to $9\times10^3$.

TABLE 4
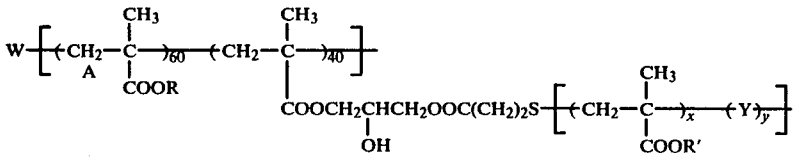
| Resin (A) | W— | R | R' | x/y (weight ratio) | —Y— |
|---|---|---|---|---|---|
| A-14 | HOOC—$H_2C$—S— | 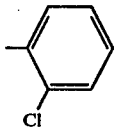 | —$C_2H_5$ | 90/10 | 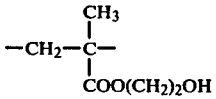 |
| A-15 | HOOC—$CH_2$<br>HOOC—CHS— | 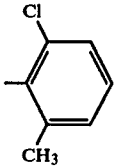 | 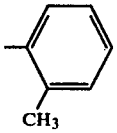 | 85/15 | 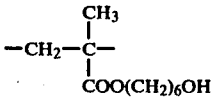 |
| A-16 | 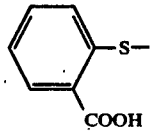 | 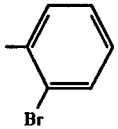 | 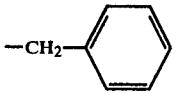 | 90/10 | 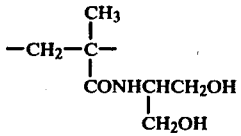 |
| A-17 | HO—P(=O)(OH)—$OCH_2CH_2S$— | —$C_2H_5$ | 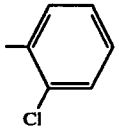 | 92/8 | 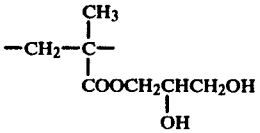 |
| A-18 | $HO_3SCH_2CH_2S$— | 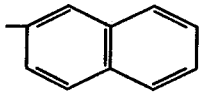 | —$C_4H_9$ | 93/7 | 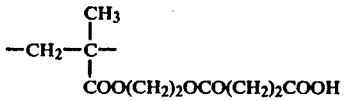 |

TABLE 4-continued
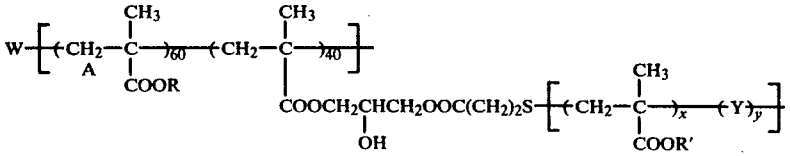
| Resin (A) | W— | R | R′ | x/y (weight ratio) | —Y— |
|---|---|---|---|---|---|
| A-19 | $HOCH_2CH_2—S—$ | 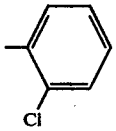 | $—C_2H_5$ | 92/8 | 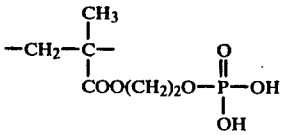 |
| A-20 | $HOOC—(CH_2)_2S—$ | 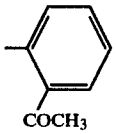 | $—C_3H_7$ | 95/5 | 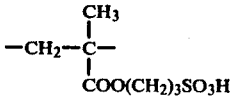 |
| A-21 | 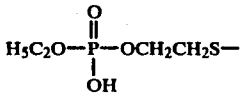 | 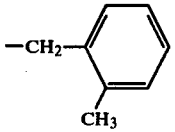 | 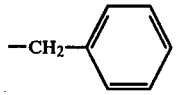 | 80/20 | 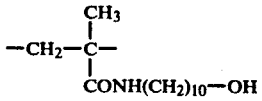 |
| A-22 | $HOOC(CH_2)_2S—$ | 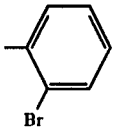 | $—C_2H_5$ | 90/10 | 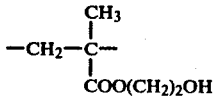 |
| A-23 | 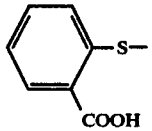 | 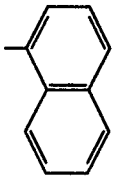 | $—C_3H_7$ | 90/10 | 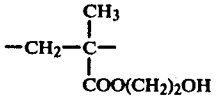 |

TABLE 4-continued
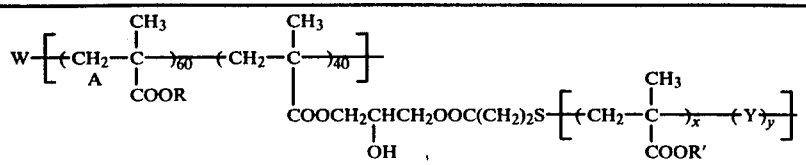
| Resin (A) | W— | R | R' | x/y (weight ratio) | —Y— |
|---|---|---|---|---|---|
| A-24 | " | 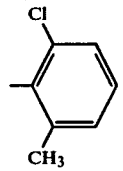 | 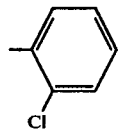 | 90/10 | 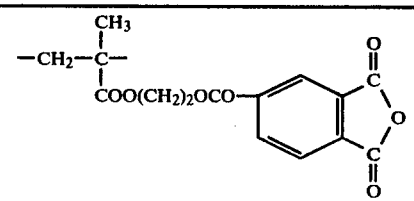 |
| A-25 | " | 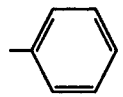 | $-CH_2C_6H_5$ | 85/15 | 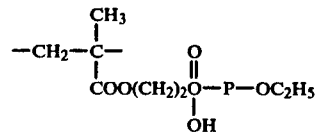 |
| A-26 | $HOOC(CH_2)_2S-$ | 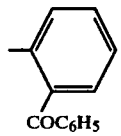 | $-C_4H_9$ | 95/5 | 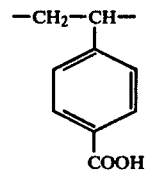 |
| A-27 | " | 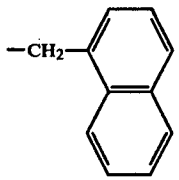 | 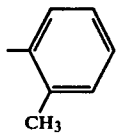 | 95/5 | 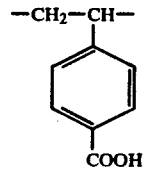 |

Synthesis Example 1 of Macromonomer (M): (M-1)

A mixed solution of 10 g of triphenylmethyl methacrylate, and 100 g of toluene was sufficiently degassed in a nitrogen stream and cooled to −20° C. Then, 0.02 g of 1,1-diphenylbutyl lithium was added to the mixture, and the reaction was conducted for 10 hours. Separately, a mixed solution of 90 g of ethyl methacrylate and 100 g of toluene was sufficiently degassed in a nitrogen stream and the resulting mixed solution was added to the above described mixture, and then reaction was further conducted for 10 hours. The reaction mixture was adjusted to 0° C., and carbon dioxide gas was passed through the mixture in a flow rate of 60 ml/min for 30 minutes, then the polymerization reaction was terminated.

The temperature of the reaction solution obtained was raised to 25° C. under stirring, 6 g of 2-hydroxyethyl methacrylate was added thereto, then a mixed solution of 10 g of dicyclohexylcarbodiimide, 0.2 g of 4-N,N-dimethylaminopyridine and 30 g of methylene chloride was added dropwise thereto over a period of 30 minutes, and the mixture was stirred for 3 hours.

After removing the insoluble substances from the reaction mixture by filtration, 10 ml of an ethanol solution of 30% by weight hydrogen chloride was added to the filtrate and the mixture was stirred for one hour. Then, the solvent of the reaction mixture was distilled off under reduced pressure until the whole volume was reduced to a half, and the mixture was reprecipitated from one liter of petroleum ether.

The precipitates thus formed were collected and dried under reduced pressure to obtain 56 g of Macromonomer (M-1) shown below having an Mw of $6.5\times10^3$.

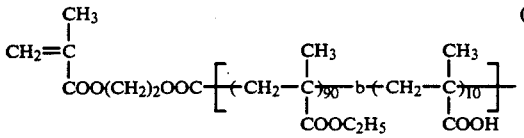

Synthesis Example 2 of Macromonomer (M): M-2

A mixed solution of 5 g of benzyl methacrylate, 0.01 g of (tetraphenyl porphynate) aluminum methyl, and 60 g of methylene chloride was raised to a temperature of 30° C. in a nitrogen stream. The mixture was irradiated with light from a xenon lamp of 300 W at a distance of 25 cm through a glass filter, and the reaction was conducted for 12 hours. To the mixture was further added 45 g of butyl methacrylate, after similarly light-irradiating for 8 hours, 5 g of 4-bromomethylstyrene was added to the reaction mixture followed by stirring for 30 minutes, then the reaction was terminated. Then, Pd-C was added to the reaction mixture, and a catalytic reduction reaction was conducted for one hour at 25° C.

After removing insoluble substances from the reaction mixture by filtration, the reaction mixture was reprecipitated from 500 ml of petroleum ether and the precipitates thus formed were collected and dried to obtain 33 g of Macromonomer (M-2) shown below having an Mw of $7\times10^3$.

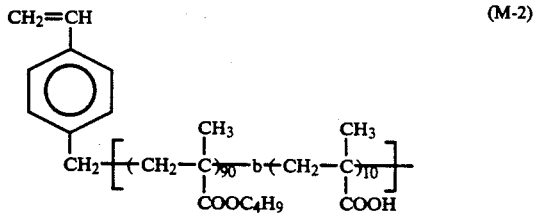

Synthesis Example 3 of Macromonomer (M): (M-3)

A mixed solution of 20 g of 4-vinylphenyloxytrimethylsilane and 100 g of toluene was sufficiently degassed in a nitrogen stream and cooled to 0° C. Then, 0.1 g of 1,1-diphenyl-3-methylpentyl lithium was added to the mixture followed by stirring for 6 hours. Separately, a mixed solution of 80 g of 2-chloro-6-methylphenyl methacrylate and 100 g of toluene was sufficiently degassed in a nitrogen stream and the resulting mixed solution was added to the above described mixture, and then reaction was further conducted for 8 hours. After introducing ethylene oxide at a flow rate of 30 ml/min into the reaction mixture for 30 minutes with vigorously stirring, the mixture was cooled to a temperature of 15° C., and 8 g of methacrylic acid chloride was added dropwise thereto over a period of 30 minutes, followed by stirring for 3 hours.

Then, to the reaction mixture was added 10 ml of an ethanol solution of 30% by weight hydrogen chloride and, after stirring the mixture for one hour at 25° C., the mixture was reprecipitated from one liter of petroleum ether. The precipitates thus formed were collected, washed twice with 300 ml of diethyl ether and dried to obtain 55 g of Macromonomer (M 3) shown below having an Mw of $7.8\times10^3$.

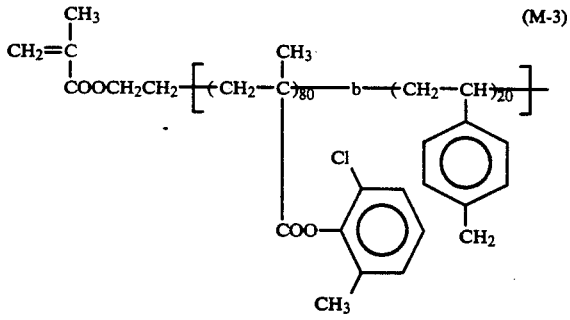

Synthesis Example 4 of Macromonomer (M): (M-4)

A mixed solution of 15 g of triphenylmethyl acrylate and 100 g of toluene was sufficiently degassed in a nitrogen stream and cooled to −20° C. Then, 0.1 g of sec-butyl lithium was added to the mixture, and the reaction was conducted for 10 hours. Separately, a mixed solution of 85 g of styrene and 100 g of toluene was sufficiently degassed in a nitrogen stream and the resulting mixed solution was added to the above described mixture, and then reaction was further conducted for 12 hours. The reaction mixture was adjusted to 0° C., 8 g of benzyl bromide was added thereto, and the reaction was conducted for one hour, followed by reacting at 25° C. for 2 hours.

Then, to the reaction mixture was added 10 ml of an ethanol solution of 30% by weight hydrogen chloride, followed by stirring for 2 hours. After removing the insoluble substances from the reaction mixture by filtration, the mixture was reprecipatated from one liter of n-hexane. The precipitates thus formed were collected and dried under reduced pressure to obtain 58 g of Macromonomer (M-4) shown below having an Mw of $4.5\times10^3$.

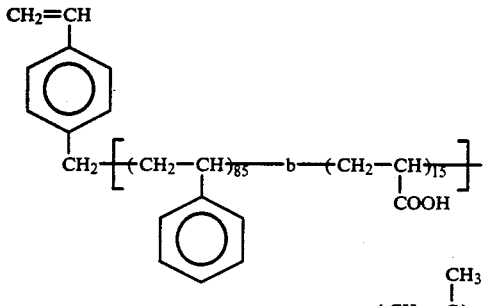

(M-4)

Synthesis Example 5 of Macromonomer (M): (M-5)

A mixed solution of 80 g of phenyl methacrylate and 4.8 g of benzyl N-hydroxyethyl-N-ethyldithiocarbamate was placed in a vessel in a nitrogen stream followed by closing the vessel and heated to 60° C. The mixture was irradiated with light from a high-pressure mercury lamp for 400 W at a distance of 10 cm through a glass filter for 10 hours to conduct a photopolymerization.

Then, 20 g of acrylic acid and 180 g of methyl ethyl ketone were added to the mixture and, after replacing the gas in the vessel with nitrogen, the mixture was light-irradiated again for 10 hours.

To the reaction mixture was added dropwise 6 g of 2-isocyanatoethyl methacrylate at 30° C. over a period of one hour and the mixture was stirred for 2 hours. The reaction mixture was reprecipitated from 1.5 liters of hexane and the precipitates thus formed were collected and dried to obtain 68 g of Macromonomer (M-5) shown below having an Mw of $6.0\times10^3$.

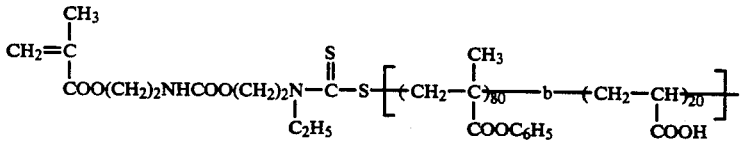

(M-5)

Synthesis Example 1 of Resin (B): (B-1)

A mixed solution of 80 g of ethyl methacrylate, 20 g of Macromonomer (M-1) and 150 g of toluene was heated at 65° C. in a nitrogen stream, and 0.8 g of 1,1-azobis(cyclohexane-1-carbonitrile (hereinafter, A.B.C.C.) was added thereto to effect reaction for 5 hours. Then, 0.5 g of A.B.C.C. was further added thereto, followed by reacting for 5 hours. The resulting copolymer shown below had an Mw of $1.0\times10^5$.

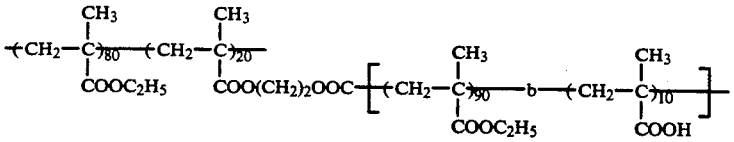

(B-1)

Synthesis Example 2 of Resin (B): (B-2)

A mixed solution of 70 g of benzyl methacrylate, 30 g of Macromonomer (M-1), and 150 g of toluene was heated at 70° C. in a nitrogen stream, and 1.0 g of A.I.B.N. was added thereto to effect reaction for 6 hours. Then, 0.5 g of A.I.B.N. was further added, and the reaction was carried out for 8 hours. The resulting copolymer shown below had an Mw of $8.5\times10^5$.

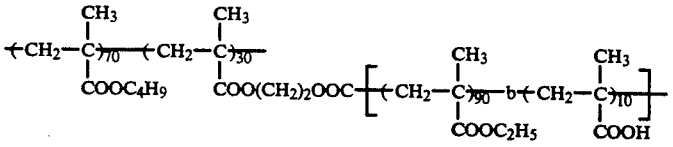

(B-2)

Synthesis Examples 3 to 9 of Resins (B): (B-3) to (B-9)

Resins (B) shown in Table 3 below were synthesized under the same polymerization conditions as described in Synthesis Example 2 of resin (B). Each of these resins had an Mw of from $7\times10^4$ to $9\times10^4$.

TABLE 5
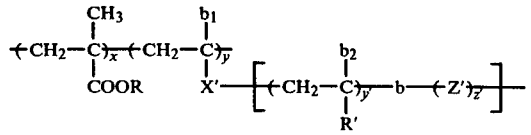
| Synthesis Example | Resin [B] | —R | —X'— | x/y | $b_1/b_2$ | —R' | —Z'— | y'/z' |
|---|---|---|---|---|---|---|---|---|
| 3 | B-3 | $-CH_3$ | $-COO(CH_2)_2OOC-$ | 90/10 | $-CH_3/-CH_3$ | $-COOC_4H_9$ | $-CH_2-C(CH_3)(COOH)-$ | 90/10 |
| 4 | B-4 | $-C_3H_7(n)$ | 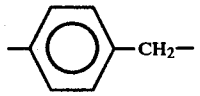 | 80/20 | $-H/-CH_3$ | $-COOC_2H_5$ | 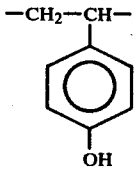 | 80/20 |
| 5 | B-5 | $-CH_2H_6H_5$ | $-COO(CH_2)_2-$ | 90/10 | $-H/-CH_3$ | $-OC_2H_5$ | $-CH_2-C(CH_3)(COO(CH_2)_4SO_3H)-$ | 95/5 |
| 6 | B-6 | $-C_2H_5$ | $-COO-$ | 90/10 | $-CH_3/-CH_3$ | $-COOC_2H_5$ | $-CH_2-CH(COOH)-$ | 90/10 |
| 7 | B-7 | " | $-COO(CH_2)_2NHCOO-$ $(CH_2)_2$ | 90/10 | $-CH_3/-H$ | $-COOC_3H_7$ | 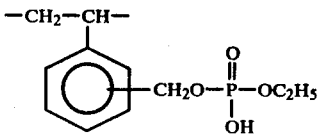 | 85/15 |
| 8 | B-8 | $-CH_2C_6H_5$ | 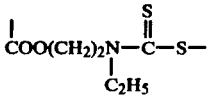 | 90/10 | $-H/-CH_3$ | $-COOC_2H_5$ | 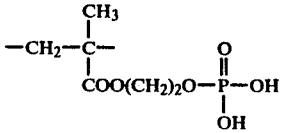 | 92/8 |

TABLE 5-continued
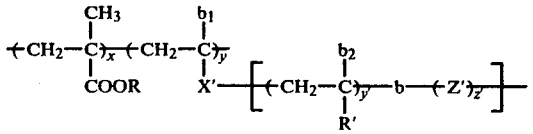
| Synthesis Example | Resin [B] | —R | —X'— | x/y | $b_1/b_2$ | —R' | —Z'— | y'/z' |
|---|---|---|---|---|---|---|---|---|
| 9 | B-9 | $-C_2H_5$ | —COO— | 85/15 | —H/—H | 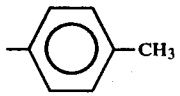 | 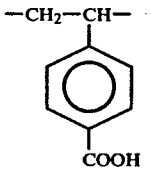 | 90/10 |

Synthesis Examples 10 to 20 of Resins (B): (B-10) to (B-20)

Resins (B) shown in Table 4 below were synthesized under the same polymerization conditions as described in Synthesis Example 1 of Resin (B). Each of these resins had an Mw of from $9\times10^4$ to $2\times10^5$.

TABLE 6

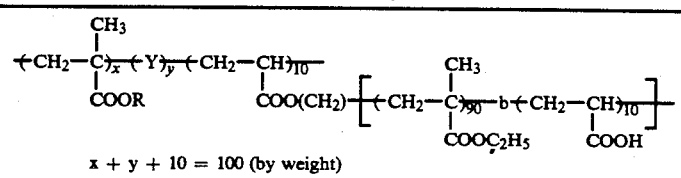

x + y + 10 = 100 (by weight)

| Synthesis Example No. | Resin [B] | —R | —Y— | x/y |
|---|---|---|---|---|
| 10 | B-10 | $-C_2H_5$ | $-CH_2-CH(COOCH_3)-$ | 70/20 |
| 11 | B-11 | $-CH_3$ | $-CH_2-CH(COOC_2H_5)-$ | 75/15 |
| 12 | B-12 | $-C_4H_9$ | $-CH_2-CH(C_6H_5)-$ | 70/20 |
| 13 | B-13 | " | $-CH_2-CH(CN)-$ | 80/10 |
| 14 | B-14 | $-C_4H_9$ | $-CH_2-CH(COO(CH_2)_2CN)-$ | 75/15 |
| 15 | B-15 | $-CH_2C_6H_5$ | $-CH_2-C(CH_3)(COO(CH_2)_2OH)-$ | 80/10 |
| 16 | B-16 | $-C_2H_5$ | $-CH_2-CH(CONH_2)-$ | 85/5 |
| 17 | B-17 | $-C_2H_5$ | $-CH_2-C(CH_3)(COO(CH_2)_2N\langle O\rangle)-$ | 85/5 |
| 18 | B-18 | $-C_2H_5$ | $-CH_2-CH(C_6H_4-CH_3)-$ | 75/15 |
| 19 | B-19 | $-C_6H_4-CH_3$ | $-CH_2-C(CH_3)(COOC_2H_5)-$ | 70/20 |

TABLE 6-continued

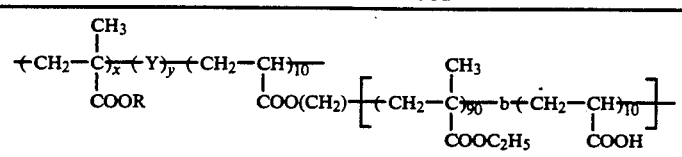

x + y + 10 = 100 (by weight)

| Synthesis Example No. | Resin [B] | —R | —Y— | x/y |
|---|---|---|---|---|
| 20 | B-20 | 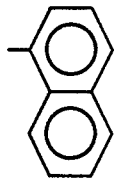 | $-CH_2-CH(COOC_2H_5)-$ | 70/20 |

EXAMPLE 1

A mixture of 6 g (solid basis, hereinafter the same) of Resin (A-1) obtained in Synthesis Example 1 of Resin (A), 34 g (solid basis, hereinafter the same) of Resin (B-1) obtained in Synthesis Example 1 of Resin (B), 200 g of zinc oxide, 0.018 g of Cyanine Dye (I) shown below, 0.10 g of tetrahydrophthalic anhydride, and 300 g of toluene was dispersed in a ball mill for 4 hours to prepare a coating composition for a light-sensitive layer. The coating composition was coated on paper, which had been subjected to electrically conductive treatment, by a wire bar to a dry coverage of 18 g/m$^2$, followed by drying at 110° C. for 30 seconds. The coated material was allowed to stand in a dark place at 20° C. and 65% RH (relative humidity) for 24 hours to prepare an electrophotographic light-sensitive material.

Cyanine Dye (I):

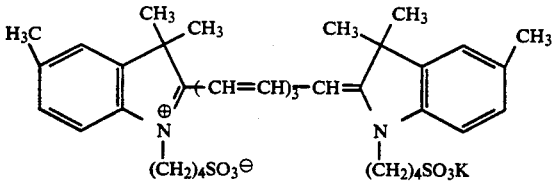

COMPARATIVE EXAMPLE A

An electrophotographic light-sensitive material was prepared by following the same procedure as Example 1 except that 6 g of resin (R-1) shown below was used in place of resin (A-1) and 34 g of poly(ethyl acrylate) (R-2) ($\overline{M}$w: 2.4×10$^5$) was used in place of 34 g of resin (B-1).

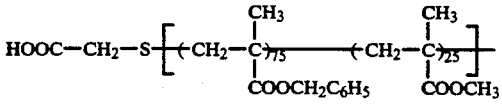

(R-1)

$\overline{M}$w: 8 × 10$^3$ (weight ratio)

COMPARATIVE EXAMPLE B

An electrophotographic light-sensitive material was prepared by following the same procedure as Example 1 except that 40 g of resin (R-3) shown below was used in place of 5 g of resin (A-1) and 34 g of resin (B-3).

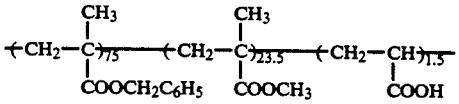

(R-3)

$\overline{M}$w: 4.5 × 10$^4$ (weight ratio)

Each of the light-sensitive materials thus obtained in Example 1 and Comparative Examples A and B was evaluated for film properties in terms of surface smoothness and mechanical strength; electrostatic characteristics; image forming performance; oil-desensitivity when used as an offset master plate precursor (expressed in terms of contact angle of the layer with water after the oil-desensitization treatment); and printing suitability (expressed in terms of background stains and printing durability). The results obtained are shown in Table 7 below.

TABLE 7

| | Example 1 | Comparative Example A | Comparative Example B |
|---|---|---|---|
| Surface Smoothness*1) (sec/cc) | 220 | 210 | 220 |
| Mechanical Strength*2) (%) | 98 | 90 | 96 |
| Electrostatic Characteristics*3): | | | |
| V10 (−V): | | | |
| Condition I | 555 | 550 | 560 |
| Condition II: | 550 | 540 | 500 |
| DRR (%) | | | |
| Condition I | 78 | 68 | 56 |
| Condition II | 75 | 60 | 30 |
| $E_{1/10}$ (erg/cm$^2$): | | | |
| Condition I | 28 | 40 | 100 |
| Condition II | 25 | 45 | 200 or more |
| $E_{1/100}$ (erg/cm$^2$): | | | |
| Condition I | 47 | 48 | 200 or more |
| Condition II | 49 | 110 | 200 or more |
| Image-Forming Performance*4): | | | |
| Condition I | Good | Background fog slightly formed. | Dm not reproduced, fine lines and letters cut out. |
| Condition II | Good | Fine lines and letters cut out. | Image cannot be distinguished from background fog. |

TABLE 7-continued

| | Example 1 | Comparative Example A | Comparative Example B |
|---|---|---|---|
| Contact Angle*5) with Water (°): | 10 or less | 10 or less | Greatly varied between 15 and 30°. |
| Printing Durability*6): | 10,000 prints or more | 8,000 prints | Background stains from the start of printing. |

The evaluations described in Table 5 above were conducted as follows.

*1)Smoothness of Photoconductive Layer: The smoothness (sec/cc) of light-sensitive material was measured using a Beck's smoothness test machine (manufactured by Kumagaya Riko K.K.) under an air volume condition of 1 cc.

*2)Mechanical Strength of Photoconductive Layer: The surface of light-sensitive material was repeatedly rubbed 1,000 times with emery paper (#1000) under a load of 50 g/cm$^2$ using a Heidon 14 Model surface testing machine (manufactured by Shinto Kagaku K.K.). After removing abrasion dusts from the layer, the film retention (%) was determined from the weight loss of the photoconductive layer, which was referred to as the mechanical strength.

*3)Electrostatic Characteristics: The light-sensitive material was charged by applying thereto corona discharge of −6 kV for 20 seconds using a paper analyzer (Paper Analyzer Type SP-428, manufactured by Kawaguchi Denki K.K.) in a dark place under conditions of 20° C. and 65% RH. Then seconds after the corona discharge, the surface potential $V_{10}$ was measured. Then, the sample was allowed to stand for 180 seconds in a dark place and the potential $V_{190}$ was measured. The dark decay retention rate (DRR (%)), i.e., the percent retention of potential after decaying for 180 seconds in a dark place, was calculated from the following equation: DRR (%) = $(V_{190}/V_{10}) \times 100$ (%).

Also, the surface of the photoconductive layer was charged to −500 V by corona discharge, then irradiated by monochromatic light of a wavelength of 785 nm, the time required for decaying the surface potential ($V_{10}$) to 1/10 thereof was measured, and the exposure amount $E_{1/10}$ (erg/cm$^2$) was calculated therefrom.

Further, the surface of the photoconductive layer was charged to −500 V by corona discharge in the same manner as described for the measurement of $E_{1/10}$, then irradiated by monochromatic light of a wavelength of 785 nm, the time required for decaying the surface potential ($V_{10}$) to 1/100 thereof was measured, and the exposure amount $E_{1/100}$ (erg/cm$^2$) was calculated therefrom.

The measurements were conducted under conditions of 20° C. and 65% RH (hereinafter referred to as Condition I) or 30° C. and 80% RH (hereinafter referred to as Condition II).

*4)Image Forming Performance: The light-sensitive material was allowed to stand for one day under Condition I or II. Then, under each of Conditions I and II the sample was charged to −5 kV, irradiated by scanning with a gallium-aluminum-arsenic semiconductor laser (oscillation wavelength: 780 nm) of 2.8 mW output as a light source in an exposure amount on the surface of 50 erg/cm$^2$, at a pitch of 25 μm and a scanning speed of 300 m/sec., and then developed using ELP- T (made by Fuji Photo Film Co., Ltd.) as a liquid developer followed by fixing. The duplicated image thus obtained was visually evaluated for fog and image quality. The original used for the duplication was composed of letters by a word processor and a cutting of letters on straw paper pasted upon thereon.

*5)Contact Angle with Water: The light-sensitive material was passed once through an etching processor using an oil-desensitizing solution (ELP-EX, made by Fuji Photo Film Co., Ltd.) to desensitize the surface of the photoconductive layer. Then, a drop of 2 μl of distilled water was placed on the surface and the contact angle formed between the surface and the water drop thereon was measured using a goniometer.

*6)Printing Durability: The light-sensitive material was subjected to the plate making under the same conditions as described in *4) above to form a toner image, and the sample of the photoconductive layer was oil-desensitized under the same conditions as described in *5) above. The printing plate thus prepared was mounted on an offset printing machine (Oliver Model 52, manufactured by Sakurai Seisakusho K.K.) as an offset master plate following by printing. The number of prints obtained without causing background stains in the non-image portions of prints and problems on the quality of the image portions thereof was referred to as the printing durability. The larger the number of prints, the better the printing durability.

The evaluations described in Table 5 above were conducted as follows.

*1) Smoothness of Photoconductive Layer:

The smoothness (sec/cc) of light-sensitive material was measured using a Beck's smoothness test machine (manufactured by Kumagaya Riko K. K.) under an air volume condition of 1 cc.

*2) Mechanical Strength of Photoconductive Layer:

The surface of light-sensitive material was repeatedly rubbed 1,000 times with emery paper (#1000) under a load of 50 g/cm$^2$ using a Heidon 14 Model surface testing machine (manufactured by Shinto Kagaku K. K.). After removing abrasion dusts from the layer, the film retention (%) was determined from the weight loss of the photoconductive layer, which was referred to as the mechanical strength.

*3) Electrostatic Characteristics:

The light-sensitive material was charged by applying thereto corona discharge of −6 kV for 20 seconds using a paper analyzer (Paper Analyzer Type SP-428, manufactured by Kawaguchi Denki K. K.) in a dark place under conditions of 20° C. and 65% RH. Then seconds after the corona discharge, the surface potential $V_{10}$ was measured. Then, the sample was allowed to stand for 180 seconds in a dark place and the potential $V_{190}$ was measured. The dark decay retention rate (DRR (%)), i.e., the percent retention of potential after decaying for 180 seconds in a dark place, was calculated from the following equation: DRR (%)=$(V_{190}/V_{10}) \times 100$ (%).

Also, the surface of the photoconductive layer was charged to −500 V by corona discharge, then irradiated by monochromatic light of a wavelength of 785 nm, the time required for decaying the surface potential ($V_{10}$) to 1/10 thereof was measured, and the exposure amount $E_{1/10}$ (erg/cm$^2$) was calculated therefrom.

Further, the surface of the photoconductive layer was charged to −500 V by corona discharge in the same manner as described for the measurement of $E_{1/10}$, then irradiated by monochromatic light of a wavelength of 785 nm, the time required for decaying the surface potential ($V_{10}$) to 1/100 thereof was measured, and the exposure amount $E_{1/100}$ (erg/cm$^2$) was calculated therefrom.

The measurements were conducted under conditions of 20° C. and 65% RH (hereinafter referred to as Condition I) or 30° C. and 80% RH (hereinafter referred to as Condition II).

*4) Image Forming Performance:

The light-sensitive material was allowed to stand for one day under Condition I or II. Then, under each of Conditions I and II the sample was charged to −5 kV, irradiated by scanning with a gallium-aluminum-arsenic semiconductor laser (oscillation wavelength: 780 nm) of 2.8 mW output as a light source in an exposure amount on the surface of 50 erg/cm$^2$, at a pitch of 25 μm and a scanning speed of 300 m/sec., and then developed using ELP-T (made by Fuji Photo Film Co., Ltd.) as a liquid developer followed by fixing. The duplicated image thus obtained was visually evaluated for fog and image quality. The original used for the duplication was composed of letters by a word processor and a cutting of letters on straw paper pasted upon thereon.

*5) Contact Angle with Water:

The light-sensitive material was passed once through an etching processor using an oil-desensitizing solution (ELP-EX, made by Fuji Photo Film Co., Ltd.) to desensitize the surface of the photoconductive layer. Then, a drop of 2 μl of distilled water was placed on the surface, and the contact angle formed between the surface and the water drop thereon was measured using a goniometer.

*6) Printing Durability:

The light-sensitive material was subjected to the plate making under the same conditions as described in *4) above to form a toner image, and the sample of the photoconductive layer was oil-desensitized under the same conditions as described in *5) above. The printing plate thus prepared was mounted on an offset printing machine (Oliver Model 52, manufactured by Sakurai Seisakusho K. K.) as an offset master plate following by printing. The number of prints obtained without causing background stains in the non-image portions of prints and problems on the quality of the image portions thereof was referred to as the printing durability. The larger the number of prints, the better the printing durability.

As can be seen from the results shown in Table 5, the light-sensitive material according to the present invention had good surface smoothness and mechanical strength of the photoconductive layer, and good electrostatic characteristics. The duplicated image formed was clear and free from background fog in the non-image area. Those results appear to be due to sufficient adsorption of the binder resin onto the photoconductive substance and sufficient covering of the surface of the particles with the binder resin. For the same reason, when it was used as an offset master plate precursor, oil-desensitization with an oil-desensitizing solution was sufficient to render the non-image areas satisfactorily hydrophilic, as shown by a small contact angle of 10° or less with water. On practical printing using the resulting printing plate, no background stains were observed in the prints.

Also, in the sample of Comparative Example B, D.R.R. was low, $E_{1/10}$ was high, and also under the high-temperature and high-humidity condition, a sufficient photoconductivity was not obtained.

In the sample of Comparative Example A, the electrostatic characteristics $V_{10}$, D.R.R., and $E_{1/100}$ were almost satisfactory under the condition of normal temperature and normal humidity but $E_{1/100}$ was nearly twice the values of the light-sensitive materials of the present invention. Further, under the high-temperature and high-humidity condition, D.R.R. and $E_{1/10}$ were decreased. Also, in this case, $E_{1/100}$ was further decreased.

The value of $E_{1/100}$ shows the potential remaining on the non-image portion (already exposed portion) after exposure at practical imaging or photographing and that the value is less shows that background staining does not occur at the non-image portions after development.

Practically, it is necessary that the residual potential is lower than −10 V. That is, actually, it means a necessary exposure amount for lowering $V_R$ to lower than −10 V. In a scanning exposure system by a semiconductor laser light, it is very important for designing the optical system of a copying machine (the cost of the apparatus, accuracy of the optical path of the optical system, etc.) to lower $V_R$ to lower than −10 V with a small exposure amount.

Thus, when practically photographed using a coarse original such as letters from a word processor or an original formed on a strew paper by an apparatus of little reducing the exposure amount, in the sample of Comparative Example A, background fogs formed on the non-image portions.

Also, when the sample of Comparative Example A was used as an offset master plate, the number of prints was 7,500 only under the printing condition wherein more than 10,000 good prints were obtained using the samples of this invention.

From the aforesaid results, it can be seen that in the case of using the binder resin for use in this invention, electrophotographic light-sensitive materials having satisfactory electrostatic characteristics and printing aptitude are obtained.

EXAMPLES 2 to 17

By following the same procedure as Example 1 except that each of resins (A) and each of resins (B) shown in Table 8 were used in place of resin (A-2) and resin (B-1), each of electrophotographic light-sensitive materials was prepared. The electrostatic characteristics shown in Table 8 were determined under the condition of 30° C. and 80% RH.

TABLE 8

| Example No. | Resin (A) | Resin (B) | $V_{10}$ (−V) | D.R.R. (%) | $E_{1/10}$ (erg/cm$^2$) | $E_{1/100}$ (erg/cm$^2$) |
|---|---|---|---|---|---|---|
| 2 | A-3 | B-3 | 540 | 70 | 35 | 57 |
| 3 | A-5 | B-5 | 550 | 76 | 28 | 50 |
| 4 | A-8 | B-10 | 540 | 73 | 35 | 56 |
| 5 | A-18 | B-8 | 550 | 80 | 20 | 40 |
| 6 | A-22 | B-12 | 540 | 70 | 36 | 55 |
| 7 | A-23 | B-10 | 550 | 79 | 25 | 43 |
| 8 | A-6 | B-8 | 610 | 85 | 18 | 35 |
| 9 | A-7 | B-13 | 550 | 80 | 23 | 38 |
| 10 | A-9 | B-14 | 560 | 82 | 20 | 37 |
| 11 | A-11 | B-9 | 550 | 84 | 18 | 33 |
| 12 | A-14 | B-16 | 600 | 85 | 17 | 32 |
| 13 | A-16 | B-11 | 550 | 77 | 27 | 49 |
| 14 | A-17 | B-15 | 605 | 83 | 18 | 34 |
| 15 | A-19 | B-4 | 540 | 78 | 28 | 42 |
| 16 | A-21 | B-20 | 545 | 75 | 30 | 48 |
| 17 | A-24 | B-19 | 540 | 75 | 32 | 48 |

Also, when each of the electrophotographic light-sensitive material was used as an offset master plate and printing was carried out as in Example 1, more than 10,000 good prints could be obtained in each case.

From the results shown above, each of the electrophotographic light-sensitive materials of the present invention was good in all the points of the smoothness of the photoconductive layer, the film strength, the electrostatic characteristics, and the printing property.

Furthermore, it was confirmed that by using resin ($A_1$), the electrostatic characteristics were further improved and by using resin (B'), the electrostatic characteristics and the printing property were more improved.

EXAMPLES 18 TO 27

By following the same procedure as Example 1 except that 6.5 g of each of resins (A) and 33.5 g of each of resins (B) were used in place of the binder resins in Example 1 and 0.018 g of dye (II) having the following structure was used in place of 0.02 g of cyanine dye (I), each of electrophotographic light-sensitive materials was prepared.

TABLE 9

Dye (II)

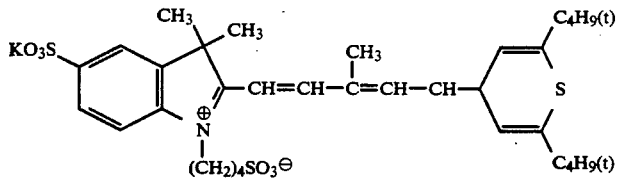

| Example | Resin (A) | Resin (B) |
|---|---|---|
| 18 | A-1 | B-2 |
| 19 | A-2 | B-5 |
| 20 | A-7 | B-6 |
| 21 | A-8 | B-7 |
| 22 | A-9 | B-9 |
| 23 | A-11 | B-10 |
| 24 | A-12 | B-12 |
| 25 | A-13 | B-16 |
| 26 | A-20 | B-18 |
| 27 | A-22 | B-19 |

Each of the electrophotographic light-sensitive materials according to the present invention thus obtained was excellent in the charging property, the dark charge retentivity, and the light sensitivity and gave clear images having no background fog even under high-temperature and high-humidity severe conditions (30° C., 80% RH).

Furthermore, when each sample was used as an offset master plate and printing was carried out, more than 10,000 prints having clear images without background fog were obtained in each case.

EXAMPLE 28

A mixture of 6 g (solid component weight) of resin (A'-8) produced in Synthesis Example 8 of Resin (A'), 34 g (as solid content) of resin (B-1) produced Production Example 1 of Resin (B), 200 g of zinc oxide, 0.018 g of cyanine dye (A) having the structure shown below, 0.20 g of salicylic acid, and 300 g of toluene was dispersed in a ball mill for 4 hours to prepare a coating composition for forming a photoconductive layer. The coating composition was coated on a paper which had been subjected an electrically conductive treatment, by a wire bar at a dry coverage of 25 g/m$^2$ and dried for 30 seconds at 110° C., and then allowed to stand in the dark for 24 hours under the condition of 20° C., 65% RH to obtain an electrophotographic light-sensitive material.

Cyanine Dye (A):

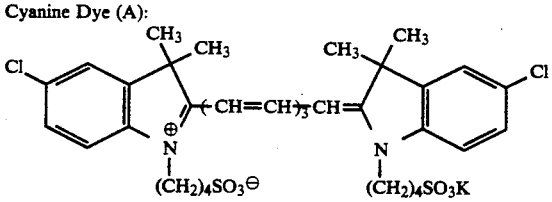

EXAMPLE 29

By following the same procedure as Example 28 except that 6 g of resin (A'-3) was used in place of 6 g of resin (A'-8), an electrophotographic photosensitive material was prepared.

COMPARATIVE EXAMPLE C

By following the same procedure as Example 28 except that 6 g of resin (R-4) shown below and 34 g of poly(ethyl methacrylate) (Mw: $2.6\times10^5$): resin (R-5) were used as the binder resins in Example 1, electrophotographic light-sensitive material C was prepared.

Resin (R-4)

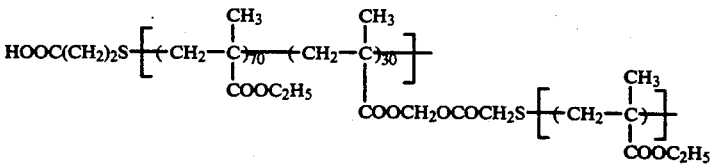

$\overline{M}w$: $8\times10^3$ (weight composition ratio)

COMPARATIVE EXAMPLE D

By following the same procedure as Example 28 except that 6 g of resin (R-5) shown below and 34 g of resin (R-6) shown below were used as the binder resins in Example 28, electrophotographic light-sensitive material D was prepared.

Resin (R-5)

-continued

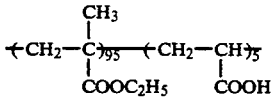

$\overline{M}w$: $6.5 \times 10^3$

Resin (R-6)

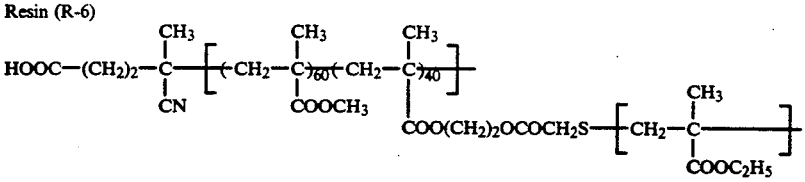

$\overline{M}w$: $7 \times 10^4$

On each of the electrophotographic light-sensitive materials obtained, the film-forming property (surface smoothness), the film strength, the electrostatic characteristics and image-forming performance under the environmental conditions of 20° C., 65% RH and 30° C., 80% RH were determined.

Furthermore, each of the light-sensitive materials was used as an offset master plate and the oil-desensitizing property (the contact angle of the photo-conductive layer after being desensitized with water) of the light-sensitive layer and the printing property (background stains, printing durability, etc.) were also determined.

The results are shown in Table 10. The evaluation items shown in Table 10 were conducted in the same manners as described hereinbefore in Table 7.

TABLE 10

| | Example 28 | Example 29 | Comparative Example C | Comparative Example D |
|---|---|---|---|---|
| Surface Smoothness (sec/cc) | 530 | 500 | 500 | 510 |
| Mechanical Strength (%) | 96 | 95 | 82 | 85 |
| Electrostatic Characteristics: | | | | |
| V10 (−V): | | | | |
| Condition I | 560 | 640 | 490 | 505 |
| Condition II | 550 | 630 | 450 | 490 |
| DRR (%) | | | | |
| Condition I | 83 | 88 | 75 | 77 |
| Condition II | 80 | 85 | 63 | 70 |
| $E_{1/10}$ (erg/cm$^2$): | | | | |
| Condition I | 30 | 16 | 57 | 50 |
| Condition II | 27 | 18 | 48 | 47 |
| $E_{1/100}$ (erg/cm$^2$): | | | | |
| Condition I | 48 | 30 | 86 | 90 |
| Condition II | 50 | 32 | 88 | 93 |
| Image-Forming Performance: | | | | |
| Condition I | Good | Good | Dm slightly lowered. | Dm lowered. |
| Condition II | Good | Good | Dm lowered. Fine lines and letters blurred. | Dm lowered. Fine lines blurred. |
| Contact Angle with Water (°): | 10 or less | 10 or less | 10 or less | 10 or less |
| Printing Durability: | 8,000 prints | 8,000 prints | 3,000 prints | Fine lines cut out. |

As shown in Table 10, the samples of Comparative Examples C and D using conventional binder resins showed insufficient the mechanical strength of the photoconductive layer. Also, in the electrostatic characteristics of the comparative samples, D.R.R. was still unsatisfactory and, under the high-temperature and high-humidity condition, the deviation of D.R.R. became larger. Also, the deviation of $E^{1/100}$ from $E_{1/10}$ was too large.

Thus, when these comparative samples were used for photographing by a scanning exposure system by a semiconductor laser beam of a low output, the image quality of reproduced images under a high-temperature and high-humidity condition was lowered.

That is, during the exposure time by a scanning exposure system with a light source of a low output having a restriction in the light irradiating amount, the potential decay at the unexposed portions (image portions) causes the reduction of image quality (e.g., the reduction of Dm, the occurrence of blurring of fine lines, letters, etc.) of actually reproduced images. Also, when the semiconductor laser beam becomes low output and the amount of light irradiation is restricted, the residual potential after exposure is a serious problem and the residual potential appears as a background fog at non-image portions at actual image formation. This corresponds to $E_{1/100}$ of electrostatic characteristics and shows that the value is preferably smaller.

The samples of Comparative Examples C and D were yet insufficient and in the image formation under the above-described condition, the occurrence of background fog was observed.

On the other hand, in the electrophotographic light-sensitive materials of the present invention, both the electrostatic characteristics and the image-forming performance were good. Furthermore, in the samples of the present invention, the film strength of the photoconductive layer was improved as compared to the samples in Comparative Examples C and D.

Then, when each light-sensitive material after image forming was used as an offset master plate, by the oil-desensitizing treatment with an oil-desensitizing solution, the contact angle between the non-image portions and a water drop was as less than 10 degree, which showed the photoconductive layer was sufficiently rendered hydrophilic in each case. However, when printing was carried out under the printing condition corresponding to a large printing machine, when the offset master plates prepared from the samples of comparative Examples C and D were used under the high-temperature and high-humidity condition, the reduction of the quality of the reproduced images caused the defects of prints obtained, whereby the printing property became insufficient.

On the other hand, the samples of the present invention provided more than 8,000 prints having clear image quality and having no background stains regardless of the environmental conditions in the case of making printing plate.

Also, the electrophotographic light-sensitive material of the present invention was excellent in the electrostatic characteristics and image-forming performance in Example 29 using the binder resin (A) having the polar group at the terminal of the main chain as compared with Example 28, and further the printing property as the offset master plate was excellent in Example 29.

As described above, the electrophotographic light-sensitive materials .of the present invention are good in all the prints of the smoothness, the film strength, the electrostatic characteristics, and the printing property of the photoconductive layers.

EXAMPLES 30 TO 49

By following the same procedure as Example 28 except that 6 g of each of the resins (A') shown in Table 11 and 34 g of each of the resins (B) shown in Table 11 were used in place of 6 g of the resin (A'-8) and 34 g of the resin (B-1) and also 0.018 g of cyanine dye (B) shown below was used in place of 0.018 g of the cyanine dye (A), each of electrophotographic light-sensitive materials was prepared.

TABLE 11

Cyanine Dye (B):

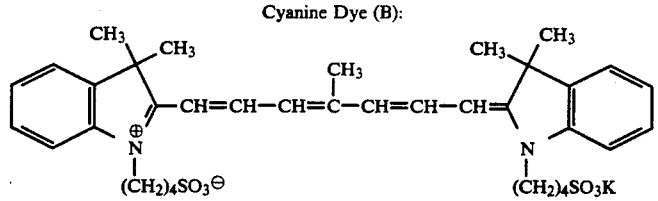

| Example No. | Resin (A') | Resin (B) | Film Strength (%) | Electrostatic Characteristics (30° C. 80% RH) $V_{10}$ (−V) | D.R.R. (%) | $E_{1/10}$ (erg/cm$^2$) |
|---|---|---|---|---|---|---|
| 30 | A'-2 | B-1 | 95 | 575 | 88 | 21 |
| 31 | A'-4 | B-2 | 90 | 540 | 80 | 32 |
| 32 | A'-7 | B-3 | 96 | 555 | 84 | 26 |
| 33 | A'-8 | B-4 | 93 | 550 | 82 | 27 |
| 34 | A'-9 | B-5 | 93 | 555 | 83 | 30 |
| 35 | A'-11 | B-6 | 93 | 545 | 79 | 30 |
| 36 | A'-12 | B-7 | 92 | 560 | 36 | 20 |
| 37 | A'-13 | B-8 | 91 | 555 | 86 | 19 |
| 38 | A'-14 | B-9 | 93 | 560 | 86 | 20 |
| 39 | A'-16 | B-10 | 92 | 570 | 87 | 20 |
| 40 | A'-17 | B-11 | 95 | 540 | 80 | 28 |
| 41 | A'-18 | B-12 | 96 | 550 | 83 | 26 |
| 42 | A'-19 | B-13 | 97 | 550 | 82 | 25 |
| 43 | A'-20 | B-14 | 95 | 550 | 83 | 21 |
| 44 | A'-21 | B-15 | 92 | 545 | 80 | 28 |
| 45 | A'-22 | B-16 | 94 | 560 | 85 | 23 |
| 46 | A'-24 | B-17 | 90 | 565 | 87 | 18 |
| 47 | A'-25 | B-18 | 92 | 560 | 81 | 24 |
| 48 | A'-26 | B-19 | 90 | 540 | 80 | 29 |
| 49 | A'-27 | B-20 | 90 | 550 | 81 | 24 |

As shown in Table 11, the samples of according to the present invention showed excellent results, and, when the resin (A') has the polar group at the terminal thereof, the electrostatic characteristics were further improved. Also, when the samples were used as offset master plate for printing, more than 8,000 prints having good image quality were obtained.

EXAMPLES 50 TO 61

By following the same procedure as Example 28 except that 6 g of each of the resins (A') shown in Table 12 and 34 g of each of the resins (B) shown in Table were used in place of 6 g of the resin (A'-8) and 34 g of the resin (B-1) in Example 28 and also 0.016 g of methine dye (C) shown below was used in place of 0.018 g of the cyanine dye (A), each of the electrophotographic light-sensitive materials was prepared.

TABLE 12

Methine Dye (C):

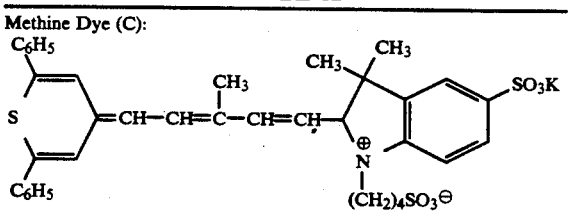

| Example | Resin (A') | Resin (B) |
|---|---|---|
| 50 | A'-4 | B-3 |
| 51 | A'-5 | B-4 |
| 52 | A'-6 | B-5 |
| 53 | A'-8 | B-7 |
| 54 | A'-11 | B-8 |
| 55 | A'-13 | B-8 |
| 56 | A'-15 | B-11 |
| 57 | A'-17 | B-11 |
| 58 | A'-18 | B-14 |
| 59 | A'-19 | B-16 |
| 60 | A'-20 | B-2 |
| 61 | A'-21 | B-6 |

Electrostatic characteristics of each of the samples were measured in the same manner as in Example 28.

Each of the electrographic light-sensitive materials of the present invention was excellent in the charging property, dark charge retentivity, and light sensitivity and also at actual image formation under a high-temperature and high-humidity severe condition (30° C., 80% RH), clear images having no background fog were obtained.

EXAMPLES 62 TO 65

A mixture of 6.5 g of each of the resins (A') shown in Table 13 below, 33.5 g each of the resins (B) shown in the same table, 200 g of zinc oxide, 0.05 g of Rose Bengale, 0.03 g of bromophenol blue, 0.02 g of uranine, 0.3 g of maleic anhydride, and 240 g of toluene was dispersed in a ball mill for 4 hours to prepare a coating composition for photoconductive layer. The coating composition was coated on a paper, which had been subjected to an electrically conductive treatment, by a wire bar at a dry coverage of 20 g/m$^2$, dried for 30 minutes at 110° C., and allowed to stand in the dark for 24 hours under the condition of 20° C., 65% RH to obtain each of the electrophotographic light-sensitive materials.

Electrostatic characteristics of the resulting samples were determined in the same manner as in Example 28 under the condition of 30° C., 80% RH.

The results obtained are shown in Table 13 below.

TABLE 13

| Example No. | Resin (A') | Resin (B) | $V_{10}$ (−V) | D.R.R. (%) | $E_{1/10}$ (lux · sec) | Printing Durability (sheets) |
|---|---|---|---|---|---|---|
| 62 | A'-1 | B-1 | 580 | 90 | 10.3 | 8000 |
| 63 | A'-2 | B-6 | 640 | 95 | 8.9 | 8000 |
| 64 | A'-11 | B-9 | 550 | 88 | 11.6 | 8000 |
| 65 | A'-24 | B-15 | 610 | 94 | 9.2 | 8000 |

As shown in the results shown in Table 13, each of the electrophotographic light-sensitive materials of the present invention was excellent in the charging property, dark charge retentivity, and light sensitivity, and, at actual image formation, under the high-temperature and high-humidity severe condition (30° C., 80% RH), clear images having no background fog were obtained.

Furthermore, when each sample was used as an offset master plate for printing, 8,000 prints having clear image quality were obtained.

In this case, $E_{1/10}$ in the electrophotographic characteristics shown in Table 13 was obtained as follows. That is, after charging the surface of each photoconductive layer to −400 V by corona discharging, the surface was irradiated by visible light at an illuminance of 2.0 lux, the time required to decay the surface potential ($V_{10}$) to 1/10, and from the time, the exposure amount $E_{1/10}$ (lux.sec.) was calculated.

Also, the printing plate as prepared from the electrophotographic light-sensitive material by an Automatic Plate Making Machine ELP 404 V (made by Fuji Photo Film Co., Ltd.) using ELP-T as a toner to form toner images.

EXAMPLES 66 TO 73

By following the same procedure as Example 62 except that 6 g of each of the resins (A') shown in Table 14 below and 34 g of each of the resins (B) shown in Table 14 were used in place of 6.5 g of the resin (A'-1) and 33.5 g of the resin (B-1) in Example 62, each of electrophotographic light-sensitive materials was prepared.

TABLE 14

| Example | Resin (A') | Resin (B) |
|---|---|---|
| 66 | A'-1 | B-2 |
| 67 | A'-8 | B-4 |
| 68 | A'-12 | B-5 |
| 69 | A'-14 | B-7 |
| 70 | A'-16 | B-10 |
| 71 | A'-17 | B-13 |
| 72 | A'-21 | B-15 |
| 73 | A'-23 | B-20 |

The characteristics were measured in the same manner as in Example 62.

Each of the electrophotographic light-sensitive materials was excellent in the charging property, dark charge retentivity, and light sensitivity, and also at actual image formation under a high-temperature and high-humidity condition (30° C., 80% RH), clear images having no background fog were obtained.

Furthermore, each sample was used as an offset master plate for printing, more than 8,000 prints having clear images and no background fog could be obtained.

While the invention has been described in detail and with reference to specific embodiments thereof, it will be apparent to one skilled in the art that various changes and modifications can be made therein without departing from the spirit and scope thereof.

What is claimed is:

1. An electrophotographic light-sensitive material comprising a support having provided thereon at least one photoconductive layer containing an inorganic photoconductive substance and a binder resin, wherein the binder resin comprises at least one resin (A) or (A') and at least one resin (B):

Binder Resin (A): a graft copolymer having a weight average molecular weight of from $1\times10^3$ to $2\times10^4$ formed from at least a monofunctional macromonomer (MA) and a monomer represented by formula (III), wherein the macrofunctional macromonomer (MA) has a weight average molecular weight of not more than $2\times10^4$ and has a polymerizable double bond group represented by the following formula (I) at only one terminal of the main chain of a polymer containing at least one kind of the polymer components represented by the following formula (IIa) and (IIb), wherein the copolymer has at least one acidic group selected from $-PO_3H_2$, $-SO_3H$, $-COOH$,

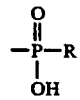

(wherein

R represents a hydrocarbon group or —OR' (wherein R' represents a hydrocarbon group)), and a cyclic acid anhydride-containing group bonded to only one terminal of the main chain of the copolymer;

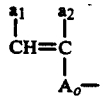

(I)

wherein $A_o$ represents —COO—, —OCO—, $-(CH_2)_{l_1}OCO-$, $-(CH_2)_{l_2}OCO-$ (wherein $l_1$ and $l_2$ each represents an integer of from 1 to 3), $$-O-,\ -SO_2-,\ -CO-,\ -\overset{R_1}{\overset{|}{C}}ON-,\ -SO_2\overset{R_1}{\overset{|}{N}}-$$

(wherein $R_1$ represents a hydrogen atom or a hydrocarbon group), —CONHCOO—, —CONHCONH—, —CONHSO$_2$—, or

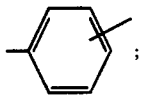

;

and $a_1$ and $a_2$, which may be the same or different, each represents a hydrogen atom, a halogen atom, a cyano group, a hydrocarbon group, —COO—$D_1$ or —COO—$D_1$ via a hydrocarbon group (wherein $D_1$ represents a hydrocarbon group which may be substituted);

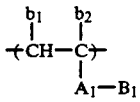

(IIa)

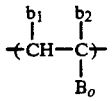

(IIb)

wherein $A_1$ has the same meaning as $A_o$ in formula (I) described above; $B_1$ represents an aliphatic group having from 1 to 18 carbon atoms or an aromatic group having from 6 to 12 carbon atoms; $b_1$ and $b_2$, which may be the same or different, have the same meaning as $a_1$ and $a_2$ in formula (I); and $B_o$ represents —CN, —CONH$_2$, or

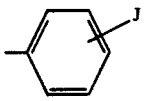

(wherein J represents a hydrogen atom, a halogen atom, an alkoxy group or —COO$D_4$ (wherein $D_4$ represents an alkyl group, an aralkyl group, or an aryl group));

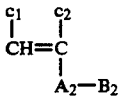

(III)

wherein $A_2$ has the same meaning as $A_1$ in formula (IIa); $B_2$ has the same meaning as $B_1$ in formula (IIa); and $c_1$ and $c_2$, which may be the same or different, have the same meaning as $a_1$ and $a_2$ in formula (I);

Binder Resin (A'): a copolymer having a weight average molecular weight of from $1\times10^3$ to $2\times10^4$ and formed from at least a monofunctional macromonomer (MA') and a monomer represented by the above formula (III), wherein said macromonomer (MA') has a weight average molecular weight of not more than $2\times10^4$ and has a polymerizable double bond group represented by the above formula (I) at only one terminal of the main chain of a polymer containing at least one of the polymer components represented by the above formulae (IIa) and (IIb) and a polymer component containing at least one acidic group selected from —COOH, —PO$_3$H$_2$,

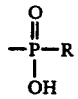

(wherein R represents a hydrocarbon group or —OR' (wherein R' represents a hydrocarbon group));

Binder Resin (B): a graft type copolymer having a weight average molecular weight of from $3\times10^4$ to $1\times10^6$ formed from a monomer and as a copolymer component at least one of a monofunctional macromonomer (M) having a weight average molecular weight of from $1\times10^3$ to $2\times10^4$ having a polymerizable double bond group at the terminal of the polymer main chain of a B block of an AB block copolymer composed of an A block containing at least one of a polymer component containing at least one acidic group selected from —PO$_3$H$_2$, —COOH, —SO$_3$H, phenolic OH,

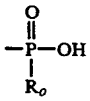

(wherein $R_o$ has the same meaning as R as described above), and a cyclic acid anhydride-containing group and a B block containing at least a polymer component represented by the following formula (IV);

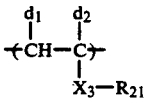

(IV)

wherein $d_1$ and $d_2$ each represents a hydrogen atom, a halogen atom, a cyano group, a hydrocarbon group, —COO—$R_{24}$ or —COO—$R_{24}$ via a hydrocarbon group (wherein $R_{24}$ represents a hydrocarbon group which may be substituted), and $X_3$ represents —COO—, —OCO—, $-(CH_2)_{l_3}OCO-$, $-(CH_2)_{l_4}COO-$, (wherein $l_3$ and $l_4$ each represents an integer of from 1 to 3), $$-O-,\ -SO_2-,\ -CO-,\ -\overset{R_{23}}{\overset{|}{C}}ON-,\ -SO_2\overset{R_{23}}{\overset{|}{N}}-$$

(wherein $R_{23}$ represents a hydrogen atom or a hydrocarbon group), —CONHCOO—, —CONHCONH—, or

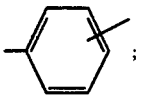

and $R_{21}$ represents a hydrocarbon group, provided that, when $X_3$ is

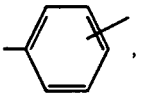

$R_{21}$ represents a hydrogen atom or a hydrocarbon group.

2. The electrophotographic light-sensitive material of claim 1, wherein the resin (A) contains at least one of aryl group-containing methacrylate components represented by the following formula (Va) or (Vb) as the copolymer component represented by the above formula (III);

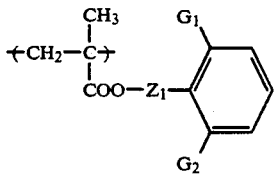

(Va)

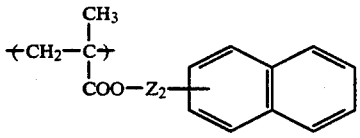

(Vb)

wherein $G_1$ and $G_2$ each independently represents a hydrogen atom, a hydrocarbon group having from 1 to 10 carbon atoms, chlorine, bromine, —$COL_1$, or $COOL_2$ (wherein $L_1$ and $L_2$ each represents a hydrocarbon group having from 1 to 10 carbon atoms), and $Z_1$ and $Z_2$ each represents a direct bond or a linking group having from 1 to 4 linking atoms for bonding —COO— and the benzene ring.

3. The electrophotographic photosensitive material of claim 1, wherein the resin (B) contains at least one kind of a monomer represented by the following formula (VI) as a monofunctional monomer constituting the copolymer together with the monofunctional macromonomer (M);

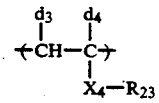

(VI)

wherein $d_3$, $d_4$, $X_4$ and $R_{23}$ have the same meaning as $d_1$, $d_2$, $X_3$ and $R_{21}$, respectively, in formula (IV).

4. The electrophotographic photosensitive material of claim 1, wherein the resin (A') further has at least one polar group selected from —$PO_3H_2$, —$SO_3H$,

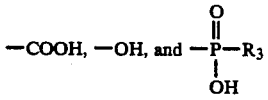

(wherein $R_3$ has the same meaning as $R_1$) bonded to the terminal of the main chain of the graft copolymer.

5. The electrophotographic photosensitive material of claim 3, wherein said monofunctional macromonomer (M) is present in a proportion of from 1 to 60% by weight in said binder resin (B).

6. The electrophotographic photosensitive material of claim 1, wherein said binder resin (A) or (A') and said binder resin (B) is present at a weight ratio of from 5 to 50/95 to 50.

* * * * *